US008810392B1

(12) United States Patent
Teller et al.

(10) Patent No.: US 8,810,392 B1
(45) Date of Patent: Aug. 19, 2014

(54) DEVICE AND METHOD FOR MONITORING THE PRESENCE OF ITEMS AND ISSUING AN ALERT IF AN ITEM IS NOT DETECTED

(75) Inventors: Eric Teller, San Francisco, CA (US); Martin T. King, Vashon Island, WA (US); Cheryl Grunbeck, legal representative, Vashon Island, WA (US); Claes-Fredrik Mannby, Mercer Island, WA (US); Michael J. Smith, Seattle, WA (US)

(73) Assignee: Google Inc., Mountain View, CA (US)

( * ) Notice: Subject to any disclaimer, the term of this patent is extended or adjusted under 35 U.S.C. 154(b) by 450 days.

(21) Appl. No.: 13/019,701

(22) Filed: Feb. 2, 2011

Related U.S. Application Data

(60) Provisional application No. 61/301,560, filed on Feb. 4, 2010, provisional application No. 61/301,544, filed on Feb. 4, 2010.

(51) Int. Cl.
*G08B 1/08* (2006.01)

(52) U.S. Cl.
USPC ..... 340/539.32; 235/385; 340/539.11; 340/572.1

(58) Field of Classification Search
USPC ..... 340/539.32, 572.1, 539.23, 539.11; 235/385; 705/28
See application file for complete search history.

(56) References Cited

U.S. PATENT DOCUMENTS

| | | | | |
|---|---|---|---|---|
| 5,939,981 | A * | 8/1999 | Renney | 340/539.32 |
| 6,084,517 | A * | 7/2000 | Rabanne et al. | 340/573.4 |
| 7,295,114 | B1 | 11/2007 | Drzaic et al. | |
| 7,880,613 | B1 | 2/2011 | Maeng | |
| 2005/0134459 | A1 * | 6/2005 | Glick et al. | 340/572.1 |
| 2005/0285739 | A1 * | 12/2005 | Velhal et al. | 340/572.1 |
| 2006/0202840 | A1 * | 9/2006 | Korbonski | 340/539.32 |
| 2007/0210930 | A1 * | 9/2007 | Pyo et al. | 340/573.1 |
| 2008/0174425 | A1 * | 7/2008 | Torning | 340/540 |
| 2008/0204233 | A1 * | 8/2008 | Agrawal et al. | 340/572.1 |
| 2009/0077675 | A1 | 3/2009 | Cabouli | |
| 2010/0039266 | A1 * | 2/2010 | Faris et al. | 340/572.4 |
| 2010/0188226 | A1 * | 7/2010 | Seder et al. | 340/572.1 |
| 2010/0289646 | A1 * | 11/2010 | Raniere | 340/572.1 |
| 2010/0302032 | A1 * | 12/2010 | Abed | 340/539.32 |

* cited by examiner

*Primary Examiner* — Thomas Mullen
(74) *Attorney, Agent, or Firm* — Fish & Richardson P.C.

(57) ABSTRACT

Disclosed herein are methods and systems that involve monitoring presence of items based on context. An exemplary method involves: (i) determining a context for a given user; (ii) determining a proximity framework between a monitoring device and one or more items, based on the determined context, wherein the proximity framework comprises (a) one or more proximity requirements, each proximity requirement indicating a required proximity between the monitoring device and at least one of the items and (b) a notification process corresponding to each proximity requirement; (iii) monitoring proximity of each of the items relative to the monitoring device, based on a presence signal from each of the items, in order to determine when one of the proximity requirements is not met; and (iv) responsive to determining that one of the proximity requirements is not met, initiating the corresponding notification process.

35 Claims, 22 Drawing Sheets

DEVICE AND METHOD FOR MONITORING THE PRESENCE OF ITEMS AND ISSUING AN ALERT IF AN ITEM IS NOT DETECTED

CROSS-REFERENCE TO RELATED APPLICATIONS

This application claims priority to U.S. Provisional Application No. 61/301,560, entitled "Device and Method for Monitoring the Presence of Items and Issuing an Alert if an Item is Not Detected", filed on Feb. 4, 2010, and to U.S. Provisional Application No. 61/301,544, entitled "System and Method for Real-Time Based Interaction of a Mobile Phone with a User in Response to Location Detection," filed on Feb. 4, 2010, which are herein incorporated by reference for all purposes.

BACKGROUND

A person typically needs various portable items near him throughout the day. For example, a person may use his reading glasses and laptop at both his house and office, and he may need his wallet and keys wherever he goes. In the absence of such items, a person may become frustrated, inefficient, or even endangered. Such items therefore must not be forgotten, misplaced, or lost.

Despite a person's best intentions and attempts, however, it is almost inevitable that he will eventually forget or misplace something that is necessary or important for him to have near. A wallet, for example, may be forgotten at a restaurant, or keys may fall out of a pocket and slip between couch cushions. In either situation, a person may not realize that his personal item has disappeared from his presence until a later time when it is too late or too inconvenient to retrieve the missing item.

SUMMARY

The present application discloses systems and methods that generally involve monitoring of items based on context.

In a first aspect, an example computer-implemented method involves: (i) determining a context; (ii) determining a proximity framework between a monitoring device and one or more items, based on the determined context, wherein the proximity framework comprises (a) one or more proximity requirements, each proximity requirement indicating a required proximity between the monitoring device and at least one of the items and (b) a notification process corresponding to each proximity requirement; (iii) monitoring proximity of each of the items relative to the monitoring device, based on a presence signal from each of the items, in order to determine when one of the proximity requirements is not met; and (iv) responsive to determining that one of the proximity requirements is not met, initiating the corresponding notification process.

In a second aspect, an example computer-implemented method involves: (i) receiving, via a user-interface of a monitoring device, user input that comprises one or more user-provided context signals; (ii) determining, based at least in part on the one or more user-provided context signals, a context in which to apply a proximity framework for one or more items and wherein the proximity framework comprises (a) one or more proximity requirements, each proximity requirement indicating a required proximity between the monitoring device and at least one of the items and (b) a notification process corresponding to each proximity requirement; (iii) monitoring context via the monitoring device; and (iv) detecting when the context substantially matches the identified context and responsively: (a) determining whether any one of the proximity requirements is not met based on a presence signal from each item; and (b) responsive to determining that one of the proximity requirements is not met, initiating the corresponding notification process.

In a third aspect, an example computer-implemented method involves: (i) determining a context for a given user; (ii) determining a group of one or more items that is associated with the current user context; (iii) determining a proximity framework for the group of items based at least in part on the current user context, wherein the proximity framework comprises (a) one or more proximity requirements and (b) at least one notification process corresponding to each proximity requirement, and wherein each proximity requirement indicates a required proximity between a monitoring device and at least one of the items; (iv) monitoring a proximity of each item from the group relative to the monitoring device, based on a presence signal from each item, in order to detect when any one of the proximity requirements is not met; and (v) responsive to detecting that one of the proximity requirements is not met, initiating the corresponding notification process.

In a fourth aspect, an example computer-implemented method involves: (i) determining a context for a given user; (ii) determining a proximity framework based at least in part on the current user context, wherein the proximity framework comprises (a) a proximity requirement between a monitoring device and an item-category comprising a plurality of items, and (b) at least one notification process corresponding to the proximity requirement; (iii) monitoring, based on a presence signal from each item, whether or not the proximity requirement between the monitoring device and the item-category is met for at least one of the items in the item category; and (iv) responsive to a determination that the proximity requirement between the monitoring device and the item-category is not met for at least one of the items in the item-category, initiating the corresponding notification process.

In a fifth aspect, an example computer-implemented method involves: (i) determining a proximity framework between a monitoring device and an item, and wherein the proximity framework comprises (a) a proximity requirement between the item and the monitoring device, and (b) at least one notification process corresponding to the proximity requirement; (ii) monitoring a presence signal from the item and detecting when the presence signal is unavailable for a predetermined period of time; and (iii) responsive to detecting that the presence signal is unavailable for a predetermined period of time, initiating the corresponding notification process, wherein the notification process comprises: (a) sending a location-query message to a monitoring-support system that determines whether another monitoring device has detected the presence signal from the item; (b) receiving, from the monitoring-support system, a message indicating whether or not the presence signal from the item has been detected by another monitoring device; and (c) providing an indication of whether or not the item has been detected by another monitoring device.

In a sixth aspect, an example computer-implemented method involves: (i) identifying a context in which at least a predetermined quantity of the given type of item should be detected by the monitoring device, wherein each item of the given type is detectable via a presence signal transmitted from the item, and wherein a proximity framework between the monitoring device and the given type of item comprises (a) a proximity requirement for at least the predetermined quantity of the given type of item to be detectable in the identified context, and (b) at least one notification process corresponding to the proximity requirement; (ii) determining that a context is the identified context and responsively: (a) searching for and receiving any presence signals that are transmitted by the given type of item; (b) based at least in part on a number of presence signals received at the monitoring device from items of the given type, determining a total item count for the given type of item; (c) determining whether or not the proximity requirement for at least the predetermined quantity of the given type of item is met by the total item count; (e) if it is determined that the proximity requirement is not met, then initiating the corresponding notification process; and (f) otherwise, refraining from initiating the corresponding notification process.

In a seventh aspect, an example computer-implemented method involves: (i) determining a context for a given user; (ii) determining a proximity framework between a plurality of items based on the determined context, wherein the proximity framework comprises (a) one or more proximity requirements, each proximity requirement indicating a required proximity between at least two of the plurality of items and (b) a notification process corresponding to each proximity requirement; (iii) for each of the proximity requirements, monitoring proximity between the at least two items for which the proximity requirement indicates the required proximity in order to determine whether or not the proximity requirement is not met; (iv) responsive to determining that one of the proximity requirements is not met, initiating the notification process corresponding to the proximity requirement that is not met.

In an eighth aspect, an example system for a monitoring device includes: a wireless interface configured to wirelessly detect presence signals transmitted from nearby items; a non-transitory computer-readable medium; and program instructions stored on the non-transitory computer-readable medium and executable by at least one processor to: (i) determine a context for a user associated with the monitoring-device system; (ii) use the determined context as a basis to determine a proximity framework between the monitoring device and one or more items, wherein a presence signal is transmitted from each item, wherein the proximity framework comprises: (a) one or more proximity requirements, each proximity requirement indicating a required proximity between the monitoring device and one of the items, and (b) a notification process corresponding to each proximity requirement; (iii) monitoring, via the presence signals detected at the at least one wireless interface, proximity of each of the items relative to the monitoring device in order to determine when one of the proximity requirements is not met; and (iv) responsive to a determination that one of the proximity requirements is not met, cause the monitoring device to initiate the notification process corresponding to the proximity requirement that is not met.

In a ninth aspect, an example computer-implemented method involves: (i) determining a current context for a given user; (ii) comparing the current context to historical context data; (iii) determining a proximity framework between a monitoring device and one or more items, based on the comparison between the current context and the historical context data, wherein the proximity framework comprises (a) one or more proximity requirements, each proximity requirement indicating a required proximity between the monitoring device and at least one of the items and (b) a notification process corresponding to each proximity requirement; (iv) monitoring proximity of each of the items relative to the monitoring device, based on a presence signal from each of the items, in order to determine when one of the proximity requirements is not met; and (v) responsive to determining that one of the proximity requirements is not met, initiating the corresponding notification process.

In a tenth aspect, an example system for a monitoring-support system includes a non-transitory computer-readable medium and program instructions stored on the non-transitory computer-readable medium and executable by at least one processor to: (i) receive one or more found-item messages at a monitoring-support system, wherein the found-item messages identify items that have been detected by one or more first monitoring devices that do not hold rights to the identified items; (ii) receive a lost-item message at the monitoring-support system, wherein lost-item message identifies a lost item that a second monitoring device did not detect as expected, wherein the second monitoring device has rights to the lost item; (iii) responsively determine whether or not the lost item has been identified in one of the received found-item messages; and (iv) send a message to the second monitoring device that indicates whether or not the lost item has been detected by one of the first monitoring devices.

In an eleventh aspect, an example computer-implemented method involves: (i) receiving, in a monitoring-support system, one or more found-item messages, wherein the found-item messages identify items that have been detected by one or more first monitoring devices that do not hold rights to the identified items; (ii) receiving, in the monitoring-support system, a lost-item message that identifies a lost item that a second monitoring device did not detect as expected, wherein the second monitoring device has rights to the lost item; (iii) responsively determining whether or not the lost item has been identified in one of the received found-item messages; and (iv) sending a message to the second monitoring device that indicates whether or not the lost item has been detected by one of the first monitoring devices.

These as well as other aspects, advantages, and alternatives, will become apparent to those of ordinary skill in the art by reading the following detailed description, with reference where appropriate to the accompanying drawings.

DETAILED DESCRIPTION

Figure 1:
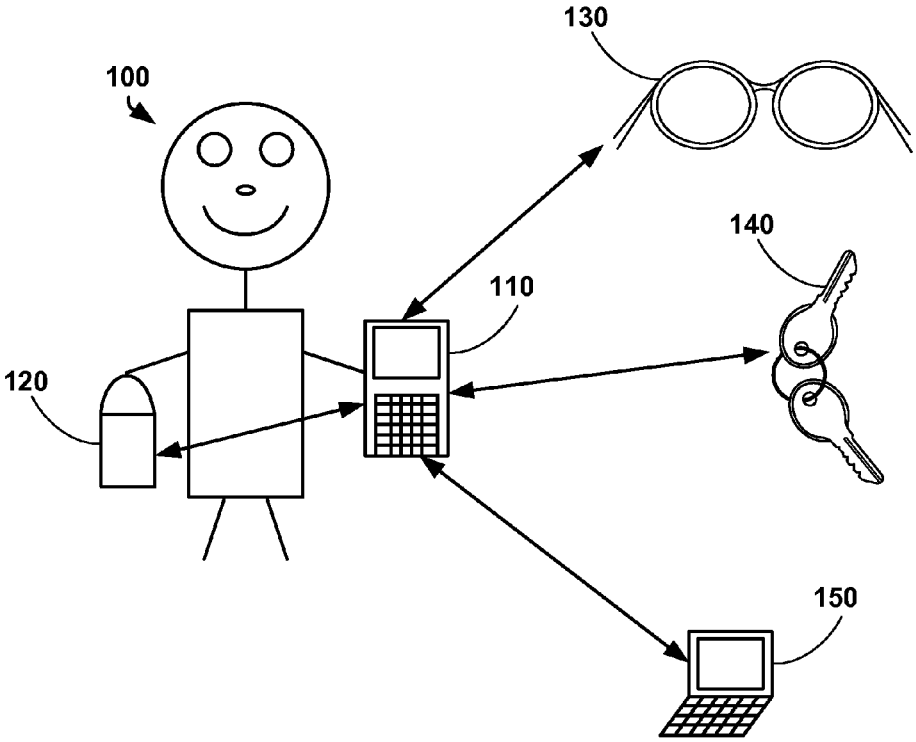
FIG. 1 is depicts a representative scenario in which a monitoring device is paired with multiple items and issues an alert if an item cannot be sensed.

The following detailed description describes various features and functions of the disclosed systems and methods with reference to the accompanying figures. In the figures, similar symbols typically identify similar components, unless context dictates otherwise. The illustrative system and method embodiments described herein are not meant to be limiting. It will be readily understood that certain aspects of the disclosed systems and methods can be arranged and combined in a wide variety of different configurations, all of which are contemplated herein.

A method and monitoring device are described that alert a user who has or is about to misplace, forget, lose, or otherwise have an item removed from the user's presence. The monitoring device monitors the presence of items in its vicinity, using a short-range wireless communication or sensing technology, such as Near Field Communication (NFC), Bluetooth, RuBee, radio-frequency identification (RFID), or any other method of wireless communication or sensing. If the monitoring device is no longer able to detect the presence of the item, thereby implying that the item has been lost, forgotten, stolen, or otherwise missing, the device issues a visual, audible, and/or physical alert to the user. The alert indicates to the user that they may want to search for or retrieve the missing item.

Herein, a "monitoring device" should be understood to be any device or item capable of sensing or detecting the presence of another device or item. Further, an "item" should be understood to be anything that is detectable by a monitoring device. As such, an item that is configured to detect other items may also be considered a monitoring device, and a monitoring device that is detectable may be considered an item.

In some embodiments, an item is paired with a monitoring device and the monitoring device issues an alert if the item can no longer be detected by the monitoring device (e.g., the monitoring device can no longer sense or communicate with the item). For example, a mobile phone may be equipped with an RFID reader, and it may monitor an RFID tag attached to and associated with a car key. If the mobile phone attempts to read the RFID tag associated with the key and is unable to, the mobile phone issues an alert.

In some embodiments, an item is paired with a monitoring device and the monitoring device issues an alert if the monitoring device detects that the item is more than a predetermined distance away from the monitoring device and therefore potentially about to go missing. For example, a mobile phone may be equipped with a Bluetooth device, and it may monitor another Bluetooth device attached to and associated with a laptop computer. The mobile phone may monitor both the presence of the laptop computer and the distance that the laptop computer is away from the mobile phone. A monitoring device may utilize various methods to determine the item's distance from the monitoring device. For example, the monitoring device may monitor signal strength to determine when a signal becomes faint or attenuated, or the monitoring device may rely on a communication or sensing technology that allows the calculation of an actual distance between the monitoring device and the item. If the monitoring device determines that the item is more than a predetermined distance away from the mobile phone, it issues an alert. The alert may be the same as or different than the alert that is generated when an item goes missing.

In some embodiments, items are associated with one another and are paired to a monitoring device, and the monitoring device issues an alert if one or more of the items is determined to be missing. The items may be associated with one another manually, or the monitoring device may group items together if it notices that certain items are typically sensed together. For example, a user may ski and may use skis, ski boots, goggles, a helmet, and a jacket every time he skis. RFID tags may be attached to and associated with each of these items, and the items may be paired to a mobile phone that is equipped with an RFID reader. The mobile phone may automatically associate the items with one another when it notices, for example, that the skis, ski boots, goggles, helmet, and jacket are sensed together every Saturday morning. If the mobile phone detects the presence of the skis, goggles, helmet, and jacket, but does not detect the presence of the ski boots, the mobile phone may issue an alert so that the user does not forget the ski boots.

Items may be paired with a monitoring device automatically or manually. In some embodiments, a monitoring device automatically senses the presence of an item and automatically pairs with the item and begins monitoring the item. To identify the item, the monitoring device may include a database of items or may wirelessly connect to a database of items. In some embodiments, a monitoring device automatically senses the presence of an item and asks a user for permission to pair with and monitor the item. In some embodiments, a monitoring device does not automatically sense an item, but instead a user must manually pair the item with the monitoring device.

Various embodiments of the invention will now be described. The following description provides specific details for a thorough understanding and an enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments. The terminology used in the description presented below is intended to be interpreted in its broadest reasonable manner, even though it is being used in conjunction with a detailed description of certain specific embodiments of the invention.

FIG. 1 depicts a representative scenario in which a user's 100 mobile phone 110 acts as a monitoring device for multiple items. The mobile phone 110 is equipped with an RFID reader capable of sensing the presence of RFID tags that are attached to and associated with various items, including a purse 120, reading glasses 130, keys 140, and a laptop computer 150. The mobile phone 110 monitors the purse 120, reading glasses 130, keys 140, and laptop computer 150 to ensure that the user 100 has not misplaced or lost the items.

The mobile phone 110 may monitor the items by periodically sensing the presence of the items. The mobile phone 110 may alert the user 100 if it determines that (1) one of the items that is being monitored can no longer be detected, or (2) if it detects the absence of an item that is typically present at a certain time, date, or location. As an example of the first scenario, the user 100 may have the mobile phone 110 monitor for the presence of the user's reading glasses 130 to ensure that the user doesn't set her reading glasses down and leave the reading glasses behind. If the mobile phone 110 fails to detect the reading glasses, it generates an alert to notify the user that the reading glasses are no longer present. As an example of the second scenario, the user 100 may take her reading glasses 130 to work every morning at 8:00 a.m. The mobile phone 110 may monitor the presence of the reading glasses every morning from 7:55 a.m. until 8:05 a.m. The user may have configured her mobile phone 110 to monitor the reading glasses 130 between these times, or the mobile phone may have automatically configured this preference by observing patterns associated with the items that it is monitoring. If the mobile phone does not detect the reading glasses 130 during the relevant time period, the mobile phone generates an alert to remind the user that they need to remember to take their reading glasses to work.

In addition to detecting the presence or absence of an item, the mobile phone may also detect when an item exceeds a certain distance from the mobile phone. For example, the user may configure her mobile phone 110 to issue an alert if the mobile phone 110 senses the reading glasses but the reading glasses 130 are more than 100 feet away from the mobile phone. Therefore, if the user walks out her house and walks more than 100 feet away from the reading glasses 130, the mobile phone 110 issues an alert that notifies the user that the glasses have exceeded a desired separation distance.

Figure 2A:
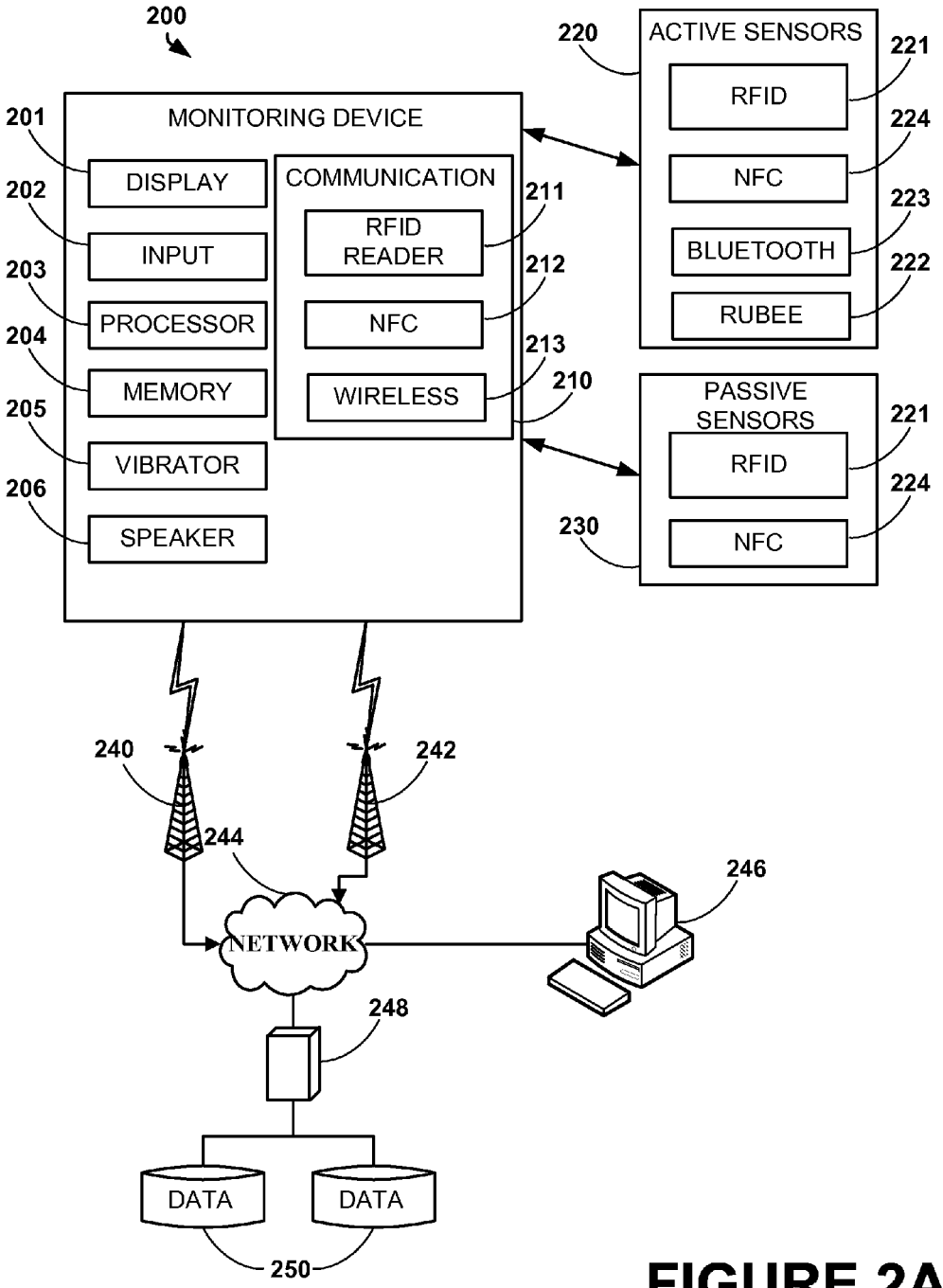
FIG. 2A is a block diagram showing hardware components of a device for monitoring the presence of an item and for issuing an alert if the item is not sensed.

FIG. 2A is a block diagram illustrating hardware components of the monitoring device used to detect the presence of an item, and to issue an alert if the item is missing. In some embodiments, the device may also issue an alert if an item exceeds a desired distance away from the device. Those skilled in the relevant art will appreciate that the invention can be practiced in a variety of mobile (handheld or portable) devices, including: mobile telecommunications devices, personal digital assistants (PDAs), email devices, digital music and video players, portable gaming devices, accessories such as watches, and mobile phones. Such devices have one or more processors for executing software instructions. Aspects of the invention may be stored or distributed on computer-readable media, including magnetically or optically readable computer disks, hard-wired or preprogrammed chips (e.g., EEPROM semiconductor chips), or other data storage media.

As shown in FIG. 2A, a monitoring device 200 may be configured to monitor the presence of active sensors 220, passive sensors 230, or both active and passive sensors. The monitoring device 200 typically includes a display component 201, an input component 202, a processor 203, a memory 204, a vibration component 205, and a speaker 206. The display component 201 may be an LCD screen, an OLEO screen, LEOs, or the like, to display an alert and other information to a user. The input component 202 may be a keypad, touch-screen, keyboard, touchpad, or the like. The processor 203 executes instructions stored in the memory 204. The vibration component 205 vibrates the monitoring device to physically alert a user alone, or in conjunction with, an audible alert. The speaker 205 is used to generate an audible alert to the user.

The monitoring device 200 includes one or more communication components 210, such as an RFID reader 211, an NFC communication component 212, and/or another wireless communication component 213, such as a Bluetooth or RuBee component. The communication components 210 may also include components used for other wireless communication protocols, such as G8M, CDMA, GPR8, EDGE, UMT8, IEEE 802.11, IEEE 802.16, etc.

The monitoring device 200 monitors an active sensor 220 or passive sensor 230 that is associated with an item, using any of the aforementioned wireless technologies and protocols. An "active" sensor is a sensor that can autonomously transmit messages to the monitoring device using a communication protocol. Accordingly, the active sensor 220 may include an active RFID tag 221, a RuBee radio tag 222, an active NFC tag 224, a Bluetooth device 223, or the like. A "passive" sensor is a sensor that requires external excitation from the monitoring device to provoke signal transmission to the monitoring device. The passive sensor 230 may include a passive RFID tag 231, a passive NFC tag 232, or the like.

The monitoring device 200 may communicate with servers or other computing devices via a mobile telecommunications network or other wireless telecommunications network. For example, the monitoring device 200 may establish a communication channel with a mobile transceiver 240 using any known standard, such as G8M, CDMA, GPR8, EDGE, UMT8, etc. Alternatively or additionally, the monitoring device 200 may establish a communication channel via a wireless local area network (WLAN) using a wireless hotspot or access point 242. The wireless access point 242 may use any known wireless communication protocols, such as IEEE 802.11 or IEEE 802.16. The monitoring device may communicate with the access point 242 using the Unlicensed Mobile Access (UMA) or the Generic Access network (GAN) protocol. The mobile transceivers and access points are connected via public and/or private networks 244 to remote services operating on a server 248 and other computing devices 246. The server 248 may access data storage areas 250 to obtain or store data.

Figure 2B:
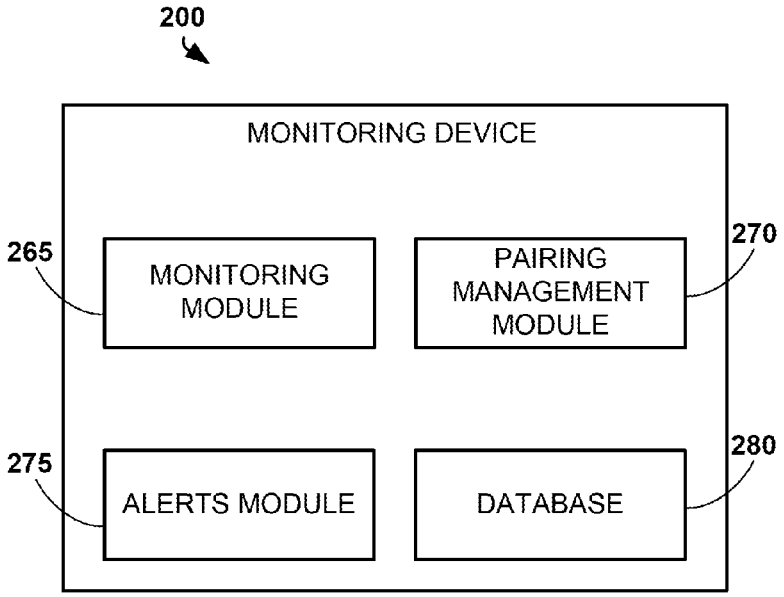
FIG. 2B is a block diagram showing software modules of a device for monitoring the presence of an item and for issuing an alert if the item is not sensed.

FIG. 2B is a block diagram illustrating software components of the monitoring device 200 used to detect the presence of an item, and to issue an alert if the item is not detected. While aspects of the invention, such as certain functions, are described as being performed exclusively on a single device, the invention can also be practiced in distributed environments where functions or modules are shared among disparate processing devices that are linked through a communications network, such as a Local Area Network (LAN), Wide Area Network (WAN), or the Internet. In a distributed computing environment, program modules may be located in both local and remote storage devices and executed by mobile device, server, or other computing device processors.

In FIG. 2B, the monitoring device 200 includes a monitoring module 265, a pairing management module 270, an alerts module 275, and a database 280. The monitoring module 265 enables the monitoring device to communicate with and/or detect passive or active sensors that are associated with items. The monitoring module 265 allows the monitoring device 200 to transmit a signal to the sensor and receive identifying information from the sensor. The monitoring module 265 automatically, or based on manual instruction, detects items having sensors that are in the vicinity of the monitoring device.

The pairing management module 270 manages the pairing of items with the monitoring device 260. The pairing management module 270 may automatically pair with items that are detected by the monitoring module 265, or may prompt the user for permission to pair with a detected item. The pairing management module 270 may also prompt the user for preferences associated with the paired item, such as the type of alert to generate when the item is no longer detected. Alternatively, the pairing management module 270 may apply default or general pairing preferences to paired items.

The alerts module 275 generates alerts associated with missing items. The alerts module 275 determines when the monitoring device 260 should issue an alert, and the type of alert to issue. In determining whether to issue an alert, the alerts module 275 may consider numerous factors, including the nature and type of item that is being monitored, the location of the monitoring device, the date or time, the day of the week, the other items that are being monitored, the other items that had been monitored in the past, the duration of time that the item was sensed, the distance the item is from the monitoring device, the velocity at which the monitoring device is moving relative to the item (either away or toward the item), the preferences of the user, the preferences of other users, trends, or on any other factor.

The database 280 stores data related to currently-monitored or previously monitored items, the monitoring device, the user's preferences, and any other needed data to implement the technology described herein.

Figure 3A:
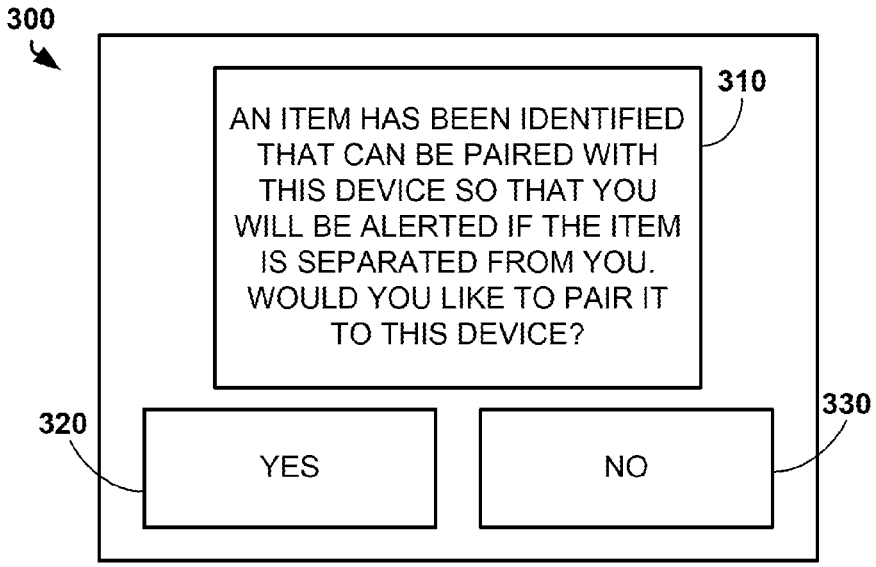
FIG. 3A is a representative interface that is displayed on a monitoring device to allow a user to pair an item to the monitoring device.

FIG. 3A depicts a representative interface 300 that is displayed after the monitoring device has detected an item that could be paired with the monitoring device. A text box 310 is displayed by the monitoring device to alert a user that an item was identified that has not previously been paired with the monitoring device. The monitoring device may identify the type of item from an identification code transmitted by the item, and the text box 310 may therefore describe or otherwise identify the detected item.

The monitoring device may also prompt the user for input relating to the item that has been detected. A "Yes" button 320 and a "No" button 330 allow the user to select whether he or she desires to pair the item to the monitoring device. If the user elects not to pair the item, the monitoring device may prompt the user with additional questions to determine when or if the mobile device should prompt the user to pair the device with the item again. If the user elects to pair the item with the device, the monitoring device may ask the user for his or her alert preferences for the newly paired item.

Figure 3B:
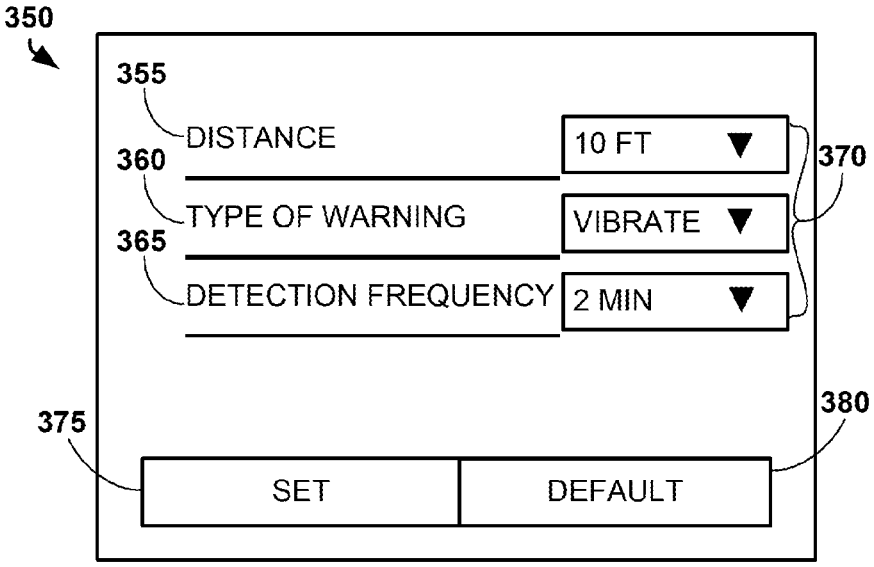
FIG. 3B is a representative interface that is displayed on a monitoring device to allow a user to adjust pairing preferences with respect to an item.

FIG. 3B depicts a representative interface 350 of a pairing preferences menu. The monitoring device may allow a user to adjust pairing preferences after a user elects to pair an item with the monitoring device or if the user elects to edit the pairing preferences. In the depicted example, the monitoring device prompts the user with a "Distance" category 355, a "Type of Warning" category 360, and a "Detection Frequency" category 365. Under the Distance category 355, the user may choose a distance that the item may be separated from the monitoring device before the monitoring device generates an alert. The distance may be manually specified by a user with a number (e.g., 10 feet, 20 meters) or a relative measure (e.g., "short," "medium," "far"). Under the Type of Warning category 360, the user may choose the type of alert that the monitoring device should use to alert the user if the item is determined to be lost or forgotten. For example, the user could select an audible notification, a text notification on the monitoring device or on a different device, an email message to the monitoring device or to a different device, a vibration notification, etc. Under the Detection Frequency category 365, the user may specify the frequency at which the monitoring device should attempt to detect or sense the item. The frequency may be specified by an exact timing (e.g., every minute, every five minutes) or by a relative measure of timing (e.g., "frequently," "infrequently"). To the right of each category are dropdown menus 370 which allow the user to select a value for the categories. In all categories, the user may specify that the monitoring device automatically select an appropriate setting depending on the particular item and other factors.

A "Set" button 375 and a "Default" button 380 are displayed below the categories. The user may select the Set button 375 to set the pairing preferences for the item. The user may select the Default button 380 to return the category values to their default values.

One skilled in the art will appreciate that the monitoring device may monitor multiple items at the same time. The monitoring device may therefore display the representative interfaces depicted in FIGS. 3A and 3B for each item that it detects.

Figure 4:
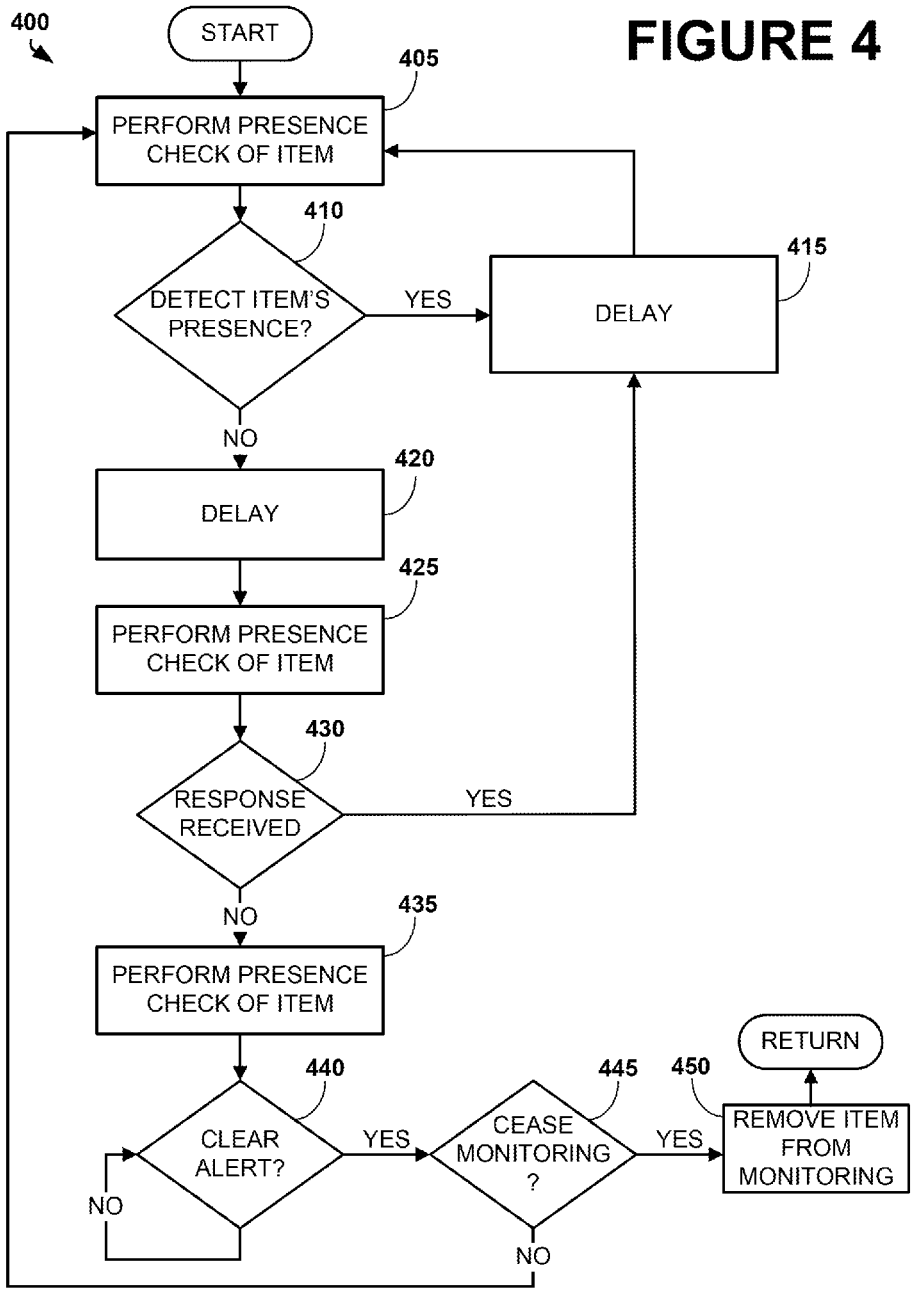
FIG. 4 is a flow diagram showing steps performed by a monitoring device to monitor an item and to issue an alert.

FIG. 4 is a flow diagram of a process 400 implemented by the monitoring device to monitor an item and issue an alert if the item is not detected. The process depicted in FIG. 4 is repeated for each item of a list of items being monitored by the monitoring device.

At a block 405, a monitoring device performs a presence check of an item. If the item is identified and tracked by the use of a passive sensor, the presence check includes transmitting a signal to excite the passive sensor and cause the passive sensor to transmit a corresponding identification number to the monitoring device. For example, if a passive or battery-assisted passive RFID tag is associated with and attached to the item, an RFID reader on the monitoring device must transmit a signal to the RFID tag to elicit the tag's identification information. If the item is identified and tracked by use of an active sensor, the monitoring device may not need to transmit a signal at block 405 to perform a presence check of the item. For example, if an active RFID tag is attached to and associated with an item, the active RFID tag may transmit an identification signal autonomously. Alternatively, the monitoring device may send a query signal to elicit a response from any neighboring active RFID tags. In general, at block 405 the monitoring device attempts to sense the presence of the item by eliciting a signal and/or other identifying information from a sensor associated with the item.

At a decision block 410, the monitoring device determines whether it has detected the item's presence. To do so, the monitoring device compares identification information that it received from sensors associated with a nearby item or items with data identifying the item being monitored. If the received identification information matches the identification information associated with the monitored item, the item has been detected in proximity to the monitoring device and the process proceeds to a block 415. At block 415, the monitoring device delays for a period of time. The delay period is designed to moderate the number of presence checks that are performed by the monitoring device. Moderating the number of presence checks conserves the power of the monitoring device and, in some cases, the sensors. The length of the delay period may depend, for example, on parameters set by a user, the characteristics of the item, the time of day, the day of the week, month, or year, or other factors. For example, a user may be unable to work without his reading glasses. The user may typically leave his house for his office between 7:55 a.m. and 8:05 a.m. During this time period when it is essential that the user not forget his reading glasses, the monitoring device may delay for only a short duration of time (e.g., 30 seconds), enabling the monitoring device to alert the user quickly (e.g., before he drives away from his house) if he has forgotten his reading glasses. However, a short delay period during the user's work day may unduly drain the monitoring device's power because the user is less likely to forget his reading glasses at an inconvenient location, so the process may delay for a longer period of time. In some embodiments, there is no delay period. After the delay period, the process reverts back to block 405 where the monitoring device again checks for the presence of the item.

If the monitoring device does not detect the item at block 410 (i.e., if the received identification information does not match the identification information associated with the monitored item), the process proceeds to a block 420. At block 420, the monitoring device delays for a length of time. The delay period is designed to reduce the likelihood that temporary signal interference, spurious identification information, or temporary misplacement of an item will cause an alert to be generated by the monitoring device. The delay period may depend, for example, on parameters set by a user, the characteristics of the item, the time of day, the day of the week, month, or year, or other factors.

At a block 425, the monitoring device performs a second presence check of the item. At a decision block 430, the monitoring device determines whether it has detected the item's presence. As at decision block 410, the monitoring device compares received identification information with stored identification information associated with the monitored item. If the monitoring device detects the presence of the item, the process proceeds to block 415 where a delay is implemented before rechecking for the presence of the item. If the monitoring device does not detect the presence of the item, i.e., if the received identification information does not match the stored identification information for the item, the process proceeds to a block 435.

At block 435, the monitoring device generates an alert to the user. The monitoring device may generate a visual alert with its display component, an audible alert with its speaker component, and/or a physical alert with its vibrator component. The monitoring device may determine which type of alert to generate based on user preference, the type of the item that is no longer detected, or other factors.

In some embodiments, an alert may involve an attempt to notify the user via predetermined contact information. For example, the alert may involve a call or text message to a predetermined phone number, or an email to a predetermined email address. The predetermined contact information may be the user's and/or may be that of another user, such as a secretary, family member, or friend, for instance. In some embodiments, the alert may involve first making an attempt to contact the user, and if no indication that the user received the alert is received, then making an attempt to contact a backup user (e.g., a secretary, spouse, family member, or friend).

It will be appreciated that two attempts to detect an item are made in process 400 before an alert is generated for the user. In some embodiments, the monitoring device may issue an alert after only one attempt to detect the item. For example, a high-value item like a diamond ring may suggest a quicker response time before the generation of an alert. In some embodiments, more than two attempts may be made to detect an item before generating an alert.

At a decision block 440, the monitoring device prompts a user to clear the alert. If the user does not clear the alert, the process returns to decision block 440, and the user is again prompted to clear the alert. In some embodiments, the process delays for a predetermined period of time before again prompting the user to clear the alert. If the user clears the alert, the process proceeds to a decision block 445. At decision block 445, the monitoring device prompts the user as to whether it should cease monitoring the item. If the user elects to continue monitoring the item, the process returns to block 405. In some embodiments, the process delays before returning to block 405. For example, the process may delay until the item has been detected by and re-paired with the monitoring device. If the user elects to cease monitoring the item, the monitoring device stops monitoring the item, and the process continues to a block 450.

At block 450, the monitoring device removes the item from the list of items being monitored. In some embodiments, the monitoring device prompts the user for monitoring parameters that the user may specify. For example, if the user elects to both clear the alert and cease monitoring the item, the monitoring device may prompt the user to cease monitoring related items, or to adjust the user's monitoring preferences with respect to other items that are currently being monitored. Once removed from the list of items being monitored, the device will no longer attempt to detect the presence of the item.

One skilled in the art will appreciate that the aforementioned process may be performed with additional or fewer steps, or with different steps. In some embodiments, the monitoring device does not merely check for the item's presence to determine whether it should issue an alert, but it also monitors the distance the item is away from the device. The monitoring device may calculate the distance that the item is away from the device using numerous methods known in the art. For example, it may determine the distance by measuring the attenuation of the signal strength from the item's sensor. Similarly, the monitoring device may calculate the distance it is away from the item by measuring the time it takes for the monitoring device to transmit a signal to the item and then receive a response from the item.

In deciding whether to issue an alert, the monitoring device may consider the distance of the item and/or a number of other factors, including item characteristics, user preferences, manufacturer or retailer preferences, the presence of other items, or the preferences of other users with respect to the item.

Figure 5:
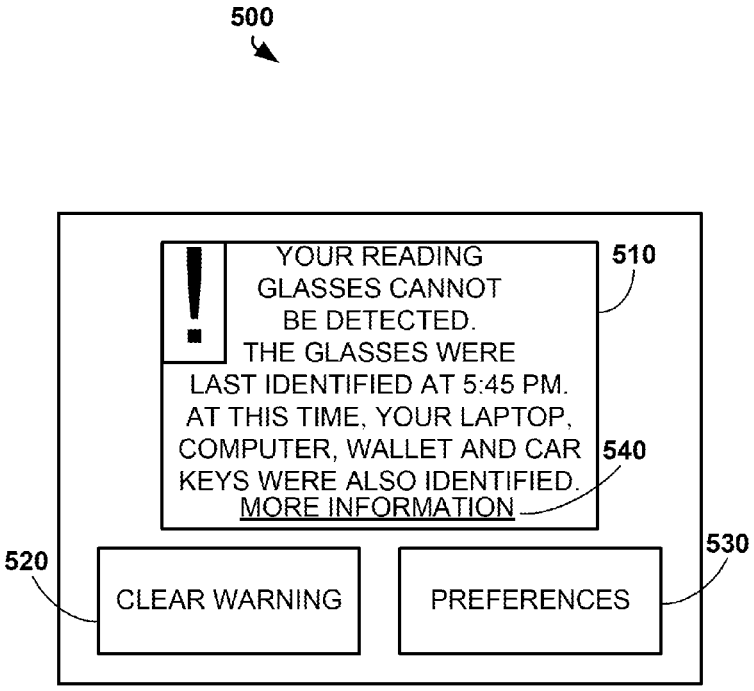
FIG. 5 is a representative interface that is displayed on a monitoring device to alert a user if a monitored item is no longer detected.

FIG. 5 depicts a representative interface 500 that is displayed on a monitoring device to alert a user if a monitored item can no longer be detected. A text box 510 is displayed, warning the user that an item cannot be detected. The text box may also provide the user with information that may help the user identify the item's location. For example, the text box 510 not only states that the user's reading glasses cannot be located, it also states when the glasses were last detected, and provides a description of other items that were detected at the same time. The user may use this information as a way of retracing his or her steps to find the missing item.

The monitoring device also provides a "More Information" button 540. If a user selects the More Information button, the monitoring device displays additional information about the item and the conditions that existed at the time it was last sensed. For example, the monitoring device may provide the location coordinates of the monitoring device when the monitoring device last sensed the item.

The monitoring device also presents a "Clear Warning" button 520 and a "Preferences" button 530 to allow a user to specify how the monitoring device should process the alert. If the user selects the Clear Warning button 520, the monitoring device will remove the alert from the screen. The monitoring device may present further options to the user that would allow, for example, the user to prevent the monitoring device from generating future alerts for the item. If the user selects the Preferences button 530, the monitoring device may present a Pairing Preferences menu 350, as depicted in FIG. 3B, or it may present a different preferences menu. The user may then change the timing or format of alerts that are generated by the monitoring device in the future.

In some embodiments, the monitoring device may automatically monitor items temporarily, conditionally, or permanently, or a user may manually specify a time condition. If an item is monitored temporarily, it means that the item is only monitored for a limited time. If an item is monitored conditionally, it means that the item is only monitored under certain conditions, such as during the morning and evening when a user is going to or coming home from work. These monitoring limitations may be determined by the nature or type of item that is being monitored or for other reasons. For example, a monitoring device need not monitor a latte purchased by the user more than 2 hours after the purchase.

In some embodiments, the monitoring device is a pair of sunglasses that a blind user wears. The sunglasses may vibrate or make a sound to alert the blind user that an item paired with the sunglasses can no longer be detected.

In some embodiments, the monitoring device is a hearing aid or the speaker of the monitoring device is included in a hearing aid, and an audible alert is played directly into a user's ear if the user is about to forget or lose an item.

In some embodiments, the monitoring device associates two objects together, and issues an alert if it senses that a user is about to forget a first one of the two objects, but it does not issue an alert if it senses that the user is about to forget only the second one of the two objects. The monitoring device may thus determine the relative importance of specific items. For example, a mobile phone may associate a glasses case and reading glasses together. If the mobile phone detects that the user forgot the glasses case and not the reading glasses, the mobile phone may not issue an alert because a user typically does not need his glasses case if he is wearing his glasses. However, if the mobile phone determines that the user forgot his reading glasses and not the glasses case, the mobile phone may issue an alert if it determines that the glasses are indeed forgotten.

In some embodiments, a monitoring device may monitor whether an item has been sensed and issue an alert if the item has not been sensed by a predetermined time or event. As an example, a user may need to remember a camping tent. The tent may be stored in an attic. The user may set the monitoring device to monitor the tent and may specify that the monitoring device should issue an alert if the user does not have the tent in his or her presence when leaving the house to go camping.

In some embodiments, a user may remotely pair an item with a monitoring device. The user may use a computer, mobile phone, or another communications device and may communicate through a network with the monitoring device to send a command to the monitoring device that pairs it with an item. For example, a child may go to school with a monitoring device and a lunch box. The child's mother may remotely pair the lunchbox with the child's monitoring device so that the child will be alerted if he forgets to bring the lunchbox home from school. Similarly, a teacher may remotely pair homework or books with a student's monitoring device, and the student's monitoring device may alert the student if she forgets her homework or books at home.

In some embodiments, a first monitoring device is used to monitor an item, and a second monitoring device issues an alert if the first monitoring device cannot sense an item. For example, a student may have a monitoring device that monitors a class pet. A teacher may have a monitoring device that communicates with the student's monitoring device over a network or directly. If the student takes the class pet home for a weekend and forgets to bring it back to the classroom on Monday, the teacher may be alerted.

In some embodiments, a monitoring device communicates with a weather service and considers weather data when determining whether to issue an alert.

In addition to the above-mentioned embodiments where a monitoring device takes the form of a mobile device, a monitoring device may be embodied in devices and items such as a tablet computer, headphones, a wallet, a keychain device, a watch, a household appliance, a home security system, a desktop computer, a stand-alone monitoring system that can be affixed or attached to an item of a user's choosing, televisions, video-gaming systems, home stereos, home theatres, any home-electronic device, in-car computing systems, any device worn by a user, or any device carried by a user. Further, those skilled in the art will understand that a monitoring device may take the form or be included as part of almost any kind of computing device.

As noted generally above, some embodiments involve monitoring items in a context-dependent manner. Such embodiments, in which monitoring devices select which items to monitor and/or what alerts should be used based on context, will now be described in greater detail.

Example Applications of Context-Dependent Item Monitoring

From both the disclosure above and the disclosure that follows, those skilled in the art will understand that there are countless applications in which example embodiments may be applied. For instance, example methods for monitoring items based on context may be applied in consumer products, professional services, medical fields (e.g., to support doctors, nurses, and emergency medical technicians (EMTs)), heavy industry, shipping services (e.g., to enhance tracking and reporting services), construction (e.g., to support field crew and supervisors), sporting events (e.g., to keep track of equipment and provide spectators with an enhanced experience), agriculture (e.g., to track equipment and product inventories), the energy industry, aviation (e.g., to enhance and automate pre-flight engine and system verification processes), law enforcement, public safety, and entertainment and performance arts, among others.

To provide a more specific example, consider applications of example methods in the medical field. In such applications, monitoring may be based upon a context that includes the type of medical position that is held by the user. For example, what items are monitored, and how and when those items are monitored, may depend at least in part on whether a user is a doctor, an EMT, or even a patient.

If the user is a doctor, for instance, example methods may be used to determine when the user is on the way to a certain room for a certain surgery, and based on this context, determine whether the necessary instruments, personnel, etc. are in the room. Other doctor-centric functionality is also possible.

If the user is an EMT, for instance, example methods may be used to determine when the user is about to leave or is on the way to the scene of an accident (and may further determine the nature of the accident). When such a context exists, an example embodiment may further involve determining what items the user needs in order to provide emergency medical care at the scene, and alerting the user if those items are not in the ambulance associated with the user. Further, when the EMT-user leaves the scene of an accident or some time thereafter, example methods may be used to determine whether the user has retrieved all items from the scene of the accident, and alert the user if items were left behind (possibly indicating the location of the items as well). Other EMT-centric functionality is also possible.

And if the user is a patient, for instance, example methods may be used to determine the patient's location within the hospital (e.g., the patient's room, an operating room, the hospital cafeteria, etc.), and to determine which personal effects, medical devices, medicines, etc. should be monitored, based upon the patient's location within the hospital.

In addition to the specific applications described heretofore, a number of other specific applications of example embodiments are described below. It should be understood that any specific applications described herein are provided for purposes of illustrating the more-general example embodiments, and should not be construed as limiting the scope of the invention.

In the above example, and in other applications of example embodiments, those skilled in the art will recognize that many sources of information may serve as context signals, or provide information from which context signals may be derived. For example, context signals may include: (a) the current time, (b) the current date, (c) the current day of the week, (d) the current month, (e) the current season, (f) a time of a future event or future user-context, (g) a date of a future event or future user-context, (h) a day of the week of a future event or future user-context, (i) a month of a future event or future user-context, (j) a season of a future event or future user-context, (k) a time of a past event or past user-context, (l) a date of a past event or past user-context, (m) a day of the week of a past event or past user-context, (n) a month of a past event or past user-context, (o) a season of a past event or past user-context, (p) ambient temperature near the user (or near a monitoring device associated with a user), (q) a current, future, and/or past weather forecast at or near a user's current location, (r) a current, future, and/or past weather forecast at or near a location of a planned event in which a user and/or a user's friends plan to participate, (s) a current, future, and/or past weather forecast at or near a location of a previous event in which a user and/or a user's friends participated, (t) information on a user's calendar, such as information regarding events or statuses of a user or a user's friends, (u) information accessible via a user's social networking account, such as information relating a user's status, statuses of a user's friends in a social network group, and/or communications between the user and the user's friends, (v) noise level or any recognizable sounds detected by a monitoring device, (w) items that are currently detected by a monitoring device, (x) items that have been detected in the past by the monitoring device, (y) items that other devices associated with a monitoring device (e.g., a "trusted" monitoring device) are currently monitoring or have monitored in the past, (z) information derived from cross-referencing any two or more of: information on a user's calendar, information available via a user's social networking account, and/or other context signals or sources of context information, (aa) health statistics or characterizations of a user's current health (e.g., whether a user has a fever or whether a user just woke up from being asleep), (bb) the items a user has indicated a need for in the past or has gone back to get in the recent past, (cc) the items a user currently has (e.g., having a beach towel makes it more likely that a user should also have sunscreen), and (dd) a user's recent context as determined from sensors on or near the user and/or other sources of context information. Those skilled in the art will understand that the above list of possible context signals and sources of context information is not intended to be limiting, and that other context signals and/or sources of context information are possible in addition, or in the alternative, to those listed above.

Example Context-Aware Monitoring Devices

Figure 6:
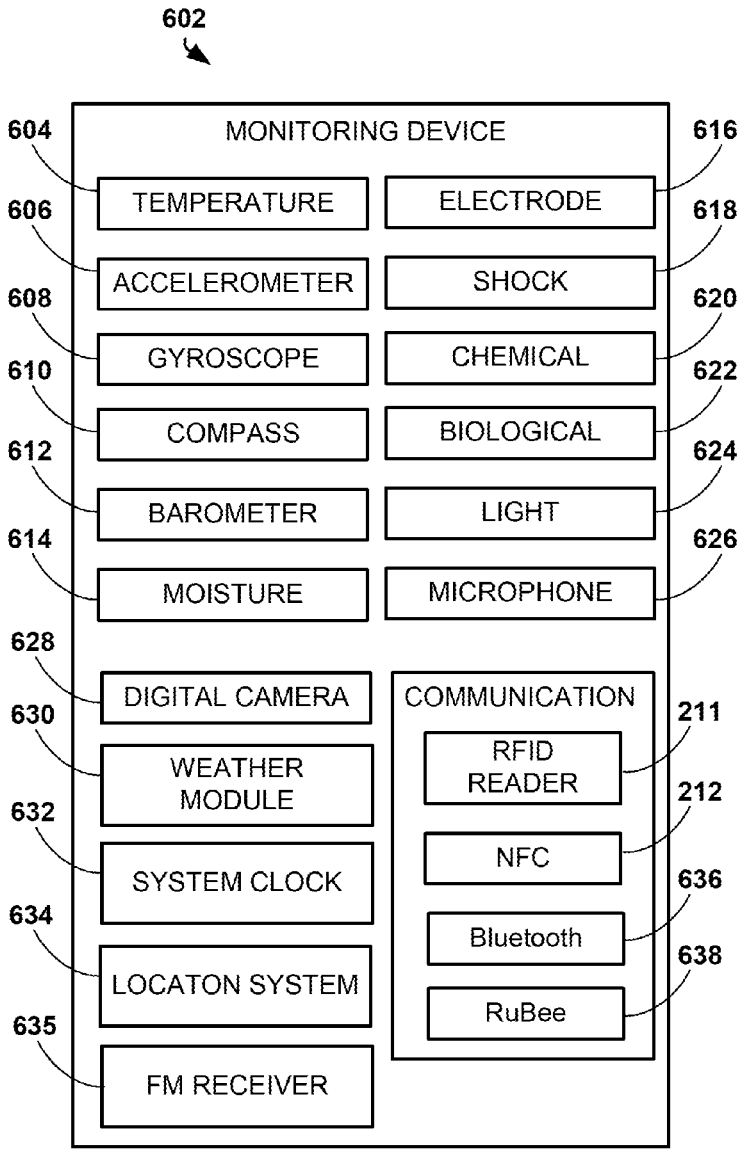
FIG. 6 is a block diagram illustrating a monitoring device that includes sensors and program logic to determine context, according to an example embodiment.

FIG. 6 is a block diagram illustrating a monitoring device that includes sensors and program logic to determine context, according to an example embodiment. As such, monitoring device 602 may determine context, and then use the determined context as a basis for determining which items to monitor, how it should monitor these items, and/or how to notify the user if an item is not detected as the device expects.

The determined context may take the form of, include, and/or be determined from "context signals," which may be any signals or information pertaining to a given scenario associated with the monitoring device, a device associated with the monitoring device (e.g., a "trusted" device), and/or a user associated with the device.

In some embodiments, the determined context may take the form of, include, or be based upon consideration of a determined user-context. Herein, a "user-context" should be understood to be a characterization of a scenario associated with a user at a given point in time. User-context may also take into account user-provided information and preferences.

For example, the determined user-context may be based upon context signals that relate to a user's environment, surrounding, and/or location, as well as to various time-related information (e.g., current time, date, day of week, weekday, weekend, month, day of month, day of year, year, etc.). The determined user-context may also be based upon context signals that are provided by a user (e.g., a label for a location such as "work" or "home", or user-provided status information such as "on vacation"), context signals derived from user-provided information (e.g., information provided in a user's documents or emails, or on a user's social networking profile), and/or user-specific information learned by the monitoring device based on observation of user-context over time and/or user-provided feedback regarding observed user-context. Yet further, user-context may be based upon context signals indicating proximity of certain items to the user (e.g., the monitoring device using its sensing capabilities to detect an item that is specifically associated with the user's car and concluding that at least part of the user-context is "in the car").

In some embodiments, the user-context may be as simple as the value of a certain context signal (e.g., time of day or location). The user-context may also be the values for a set of context signals (e.g., the time of day, the day of the week, and the location of the user). In other embodiments, the monitoring device 602 may apply further intelligence to determine user-context, and extrapolate from the information provided by context signals.

As shown, monitoring device 602 may include various sensors for acquiring context signals from which the user-context may be determined. More specifically, monitoring device 602 includes a temperature sensor 604, an accelerometer 606, a gyroscope 608, a compass 610, barometer 612, a moisture sensor 614, one or more electrodes 616, one or more shock sensors 618, one or more chemical sample and/or analysis systems 620, one or more biological sensors 622, an ambient light sensor 624, a microphone 626, and a digital camera 628 to capture images and/or video. It should be understood that a monitoring device according to an example embodiment may not include all of the illustrated sensors and may additionally or alternatively include other types of sensors as well.

Monitoring device 602 also includes various modules configured to acquire context signals from various data sources. These modules may be implemented in hardware, software, and/or firmware. In particular, monitoring device 602 includes a weather module 630 for acquiring and deriving context signals from weather report feeds, a system clock 632 providing a reference for time-based context signals, a location system 634 (e.g., GPS), and an FM radio receiver 635. It should be understood that a monitoring device according to an example embodiment may not include all of the illustrated modules, and may additionally or alternatively include other types of modules as well.

In a further aspect, an example monitoring device may include modules for receiving various other types of data feeds that may provide context signals. For instance, an example monitoring device may receive data feeds such as news feeds and/or feeds from financial markets, among others, which provide context signals or from which context signals may be derived. As a specific example, a monitoring device might determine from a financial-market feed that provides stock-price data that a stock owned by a user is crashing or is about to crash. Alternatively, the monitoring device might determine that the same stock is at risk of dropping in price via analysis of news feed and evaluation of possible effects of current news on a user's portfolio. In either case, the monitoring device might responsively monitor the user's laptop and mobile broadband card, for example, so that the user can quickly get online and sell the stock or make another appropriate transaction, if necessary.

And in another aspect, an example monitoring device may include modules for evaluating user-provided data from various sources, and determining context information therefrom. For example, a user's calendar may be evaluated to determine what events they have planned, and what items should be monitored before or during the events. As another example, a module may be configured to evaluate data from a user's social networking account. For instance, a monitoring device might determine items that a user's friends are bringing to an event the user is scheduled to attend, and suggest that the user bring the same items and/or related items, or that the user need not bring an item because their friend is bringing it. Many other examples are also possible.

Further, the monitoring device includes one or more communication components 210, some of which were described generally in reference to FIG. 2A. These communication components are generally used to monitor and sense the presence of various items and/or other monitoring devices. These components may be configured to receive and/or detect presence signals from items and other monitoring devices using various communication protocols. As shown, the one or more communication components 210 include an RFID reader 211, an NFC communication component 212, a Bluetooth component 636, and a RuBee component 638. It should be understood that a monitoring device according to an example embodiment may not include all of the communication components shown, and may additionally or alternatively include other types of communication components that are not shown, such as WiFi, UMTS, WiMax, LTE, EDGE, 1xRTT, and/or optical communication components, among others.

In a further aspect, the ability to detect nearby items may also be used to determine a user context. For example, a user might place an item such as an RFID tag or an NFC device in a certain room of their home, in their car, or in other such locations, and associate the item with the location. Accordingly, when the monitoring device 602 detects the presence of the item, this may serve as a context signal that the user is at the associated location (e.g., "in the living room" or "in the car"). As another example, a business might install a device that emits a presence signal associated with its place of business. When the monitoring device 602 detects this presence signal, this may serve as a context signal that the user is at the place of business (e.g., "at the grocery store"). Many other examples are also possible.

In another aspect, while the communication components 210 may generally serve to monitor the proximity of items and issue appropriate alerts, the communication components may also operate in the background to sense nearby items and determine available context signals in order to build a database that may be analyzed to learn and adapt the manner in which the device monitors various items. For example, monitoring device 602 may implement a process to periodically or continually observe available context signals and/or items from which presence signals are available, and to store data records recording these observations.

More specifically, monitoring device 602 may use its sensors to scan for available context signals in the background, and periodically create a data record indicating which context signals are available. Further, the monitoring device may use its modules to determine other context signals, and include an indication of these context signals in each data record that is created. Yet further, the device 602 may implement a background process using its communication modules, which searches for presence signals from items, and includes an indication of which items are detected in each data record. The user-context and item-presence data generated in such background processes may generally be referred to as "historical user-context data." As will be described in greater detail later, such historical user-context data may be used by monitoring device 602 as a basis for intelligently defining and/or suggesting user-contexts, item groups, proximity requirements for certain items and/or associations between certain user-contexts and certain proximity requirements for certain items.

Note that because monitoring device 602 is typically a device that is not permanently affixed to a user, there may be an assumption, in certain situations and for certain context signals, that the monitoring device is on a user's person or near to the user, such that context signals received by the device are reflective of user's environment. In other words, the context of the monitoring device may be assumed to be the same as or similar to the user-context of a user associated with the monitoring device. This may apply, for example, to context signals such as the user's geographic location or other location-dependent signals, where the signal may only be relevant to user-context if the device receiving the signal is near the user. Other signals, such as a user's schedule from their calendar, may not depend on a device being near a user to be relevant. Alternatively, the context upon which monitoring is based may simply be that of a monitoring device itself.

In those embodiments where a device is assumed to be near a user for purposes of determining user-context, further assurance may be provided before using a location-dependent context signal to determine user-context. In particular, the monitoring device may provide an option to the user of performing an "on the person" check, which may be based on certain context signals. For example, if the user has requested that an "on the person" check be performed, a monitoring device 602 may use temperature sensor 604 to check whether the temperature is higher than that indicated by a weather report for the device's location. If it is higher, this may interpreted as resulting from a user's body heat, which in turn means the phone is likely on the user's person. Alternatively, it is possible that the user may create a dedicated user item that they generally keep on their person, such as a watch, bracelet, item of jewelry, or the like. If such an item is labeled as being a user's identifying item, then detecting a presence signal from this item may be interpreted as being near the user.

The option of performing an "on the person" check may be provided using various other techniques as well. For example, the monitoring device 602 may include an inertial measurement unit (IMU) (not shown in FIG. 6), which may be used to recognize the user's gait or length of the user's strides as they walk. As another example, a speech-recognition module (not shown) may be used to recognize a user's voice. And as another example, a fingerprint recognition system may be used to identify the current carrier of the device as the appropriate user. Other examples are also possible.

In a further aspect, a network of "trusted" monitoring devices associated with a user may be established. The trusted devices may include, for example, the user's own monitoring devices and/or monitoring devices of other users (e.g., friends and family of the user) that the user has registered as trusted devices. In some embodiments, trusted devices may also include monitoring devices that are located in a location the user has deemed to be safe (e.g., a user's home or office). In such embodiments, detection of an item by a trusted device may provide context information to a monitoring device.

For example, a given user might register their spouse's mobile phone as a trusted device. Further, the user may set up a packing list that includes items that should be monitored when the user is traveling to and from a vacation destination. (Note that the timing of the user's travel may be determined from a user's calendar that includes the user's flight information, or a user's flight confirmation email, for example.) Accordingly, when the user's mobile phone cannot detect an item from the packing list, the mobile phone may check whether the spouse's mobile phone can detect the item, before alerting the user.

As one additional example, a given user might need a certain item at for an event the user will travel to immediately after work. The monitoring device may determine the timing of the event is such that the user does not have time to return home after work to retrieve the item, and accordingly, may monitor the item when the user is about to leave for work, in order to remind the user if they are about to forget the item when they leave for work. However, the monitoring device may also determine based on the user-context, that the user is meeting their child at the event. Accordingly, the monitoring device may check whether a monitoring device associated with the child, which is registered as a trusted device, can detect the item. If the child's device can detect the item, this may be taken to mean the child already has the item. Since the child is meeting the user at the event where the item is needed, the monitoring device may refrain from notifying the user when the child already has the item. Further, it the monitoring device may continue to check with the child's device, so that if for some reason, the child leaves the item somewhere, the user can be notified. Other examples are also possible.

Proximity Frameworks

In example embodiments, the set of rules that indicates which items should be in proximity of each other and/or the user, and what alerts and/or alarms should be initiated when the items are not in proximity of each other and/or the user, may be referred to as a "proximity framework." Accordingly, an example monitoring device 602 may determine which proximity framework should be implemented at a given point in time based on the user-context at that time.

A given proximity framework may include one or more "proximity requirements," which each indicate proximity relationship between two or more items, as well as at least one "notification process" (e.g., an alarm, alert, etc.) that corresponds to the violation of each proximity requirement. As such, a proximity framework may be as simple as a single proximity requirement (e.g., "the keys should be detected by the mobile phone") and a single notification process (e.g., "the mobile phone should ring"), or may be much more complex.

Figure 7:
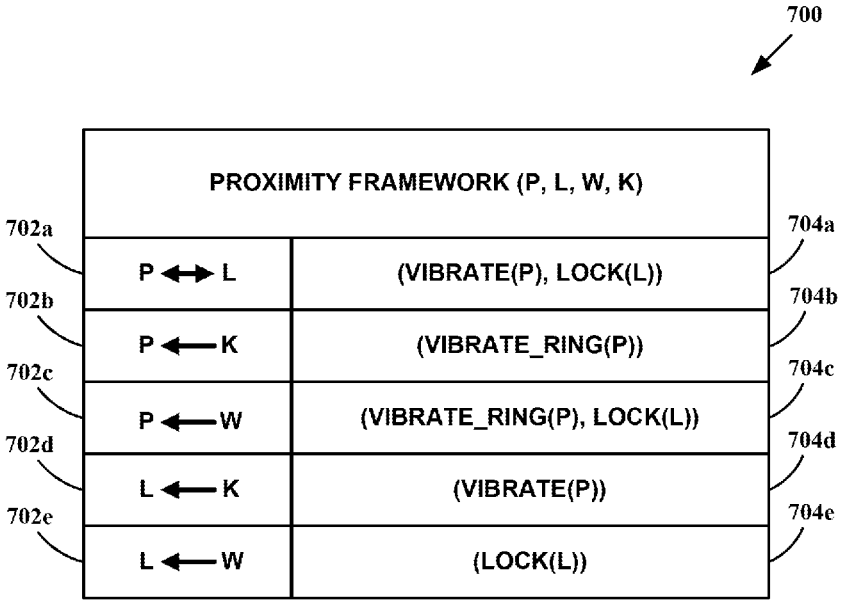
FIG. 7 is a table showing an example proximity framework for a set of items.

FIG. 7 is a table 700 showing an example proximity framework for a set of items. As shown, this set of items that includes a mobile phone (P), a laptop (L), a wallet (W), and a key (K). The illustrated proximity framework includes: (i) proximity requirements 702*a*-702*e* and (ii) notification processes 704*a*-704*e*, which correspond to proximity requirements 702*a*-702*e*, respectively.

As shown, proximity requirement 702*a* indicates that mobile phone P and laptop L should both be able to detect each other's presence. Proximity requirement 702*a* may be referred to as "bidirectional", as it requires both that mobile phone P detects the presence of laptop L, and that laptop L detect the presence of mobile phone P. Therefore, corresponding notification process 704*a* indicates the appropriate action in the event that either or both of mobile phone P and laptop L cannot detect the other. In particular, notification process 704*a* indicates that mobile phone P should vibrate and laptop L should be locked, in the event that proximity requirement 702*a* is violated.

Example Proximity Requirements

As shown, it is possible to have bidirectional proximity requirements, such as proximity requirement 702*a*, as well as unidirectional proximity requirements, such as proximity requirements 702*b*-702*e*. Unidirectional proximity requirements only require that a monitoring device detect the presence of an item. Unidirectional proximity requirements may typically be applied for items that are not configured for monitoring, such as a key or wallet to which an RFID tag is affixed. For example, proximity requirements 702*b* and 702*d* indicate that mobile phone P should detect the presence of key K and wallet W, respectively. Similarly, proximity requirements 702*d* and 702*e* indicate that laptop P should detect the presence of key K and wallet W, respectively.

When a unidirectional proximity requirement is violated, the monitoring device will typically initiate the corresponding notification process. For example, according to notification process 704*b*, when mobile phone P cannot detect the presence of key K, mobile phone P vibrates and rings to alert the user. Similarly, according to notification process 704*e*, when laptop L cannot detect the presence of wallet W, the laptop locks itself so it cannot be used (and possibly requires the user to enter a password or some unique identifier in order to unlock).

It should be understood that when a proximity framework involves two monitoring devices, the proximity framework may include either a bidirectional or unidirectional proximity requirement between two or more monitoring devices. In a further aspect, a proximity requirement may be also defined between more than two monitoring devices and/or items. For example, a proximity requirement may require that the monitoring device detect the presence of each of two or more items. As another example, a proximity framework may include an omnidirectional proximity requirement specifying that three or more monitoring devices should all monitor one another. (Those skilled in the art will understand that to implement such an omnidirectional proximity requirement, each of the monitoring devices may treat the omnidirectional requirement as a unidirectional proximity requirement to monitor the other devices.)

In some embodiment, the detection of a presence signal from another monitoring device and/or the failure to detect a presence signal may be inferred by a monitoring device. In particular, some monitoring devices may be able infer that another device is not present, or has moved beyond a required distance from the device, without relying exact location information of the device (e.g., GPS coordinates) or local communication with the device (e.g., detecting a presence signal from an RFID or NFC tag). The inference that an item is no longer present could be based upon differences between context signals at the two devices. For example, if a monitoring device senses a very different temperature and/or level of ambient light as compared to a device it is monitoring, this may be interpreted as in indication that the device is not present or is a certain distance from the device (or may be taken as a contributing to a calculation of the likelihood that the device is present). As another example, a monitoring device may determine that another device is not present when the monitoring devices experiences significant movement and/or acceleration while the other device does not (e.g., when a monitoring device is taken in car getting up to highway speeds, while the other device is left behind). Other contextual differences may additionally or alternatively be used to infer the separation of two devices.

Distance-Based Proximity Requirements

In a further aspect, a proximity requirement may indicate that a given item should be within a predetermined distance from the monitoring device. For instance, items that a user typically keeps on their person may be required to be within five feet of the monitoring device. Many other examples are also possible.

In some embodiments, a distance condition may be evaluated separately from presence. For example, a monitoring device might detect the presence signal from an item, and then determine the distance to the item. This may be the case when the presence signal itself provides the item's location or the distance between the item and the monitoring device, or when a distance calculation is based on the presence signal (e.g., when signal strength is used to determine distance). This may also be the case when separate messaging is used to determine distance. For example, an item may provide its location to a location server (e.g., an HLR in a RAN), which may act as an intermediary server between the item and the monitoring device. Then, when the monitoring device detects the presence signal from the item, the monitoring device may further query the location server for the item's location, which it can then use to determine distance to the item.

In a further aspect, a proximity requirement may also specify possible directions of movement and/or rate of movement. For example, a proximity requirement may specify that an item should not move in a certain direction or certain directions relative to the monitoring device. Additionally or alternatively, a proximity requirement may specify a maximum speed that an item moving away from or towards a monitoring device should not exceed. Variations on these example proximity requirements are possible.

In a further aspect, a proximity requirement may specify that an item or items have a certain orientation or arrangement relative to the monitoring device, or that certain items have a certain orientation or arrangement relative to each other. For example, a proximity requirement might specify that item A and B should be closer to each other than they each are to item C. Accordingly, to evaluate whether this proximity requirement is met, a monitoring device may determine the locations of items A, B, and C, and then determine the distance between A and B, the distance between A and C, and the distance between B and C. The monitoring device may then initiate a corresponding notification process if the distance between A and B is greater than the distance between A and C and/or the distance between B and C. Many other examples of proximity requirements specifying certain item orientations and/or arrangements are also possible.

Example Notification Processes

As discussed generally above, notification processes may take on various forms, and convey varying levels of urgency. For example, a monitoring device may associate certain "panic" alerts with scenarios calling for more-immediate attention from the user (e.g., leaving a phone or laptop in a public place). Alternatively, some alerts that are less urgent may be provided as suggestions (e.g., suggestions related to items needed for a visit to a friend's house down the street), while those with an intermediate level of urgency may be presented as strong suggestions (e.g., suggestions related to items needed for trip to another city).

It is also possible that when one monitoring device detects that a proximity requirement has been violated, it may cause another monitoring device to alert the user. For example, according to notification process 704*d*, if laptop L cannot detect the presence of key K, then the laptop may instruct mobile phone P to vibrate and ring in order to alert the user. Yet further, it is possible that a notification process may involve one monitoring device causing another monitoring device to initiate another notification process. For example, according to notification process 704*c*, if mobile phone P cannot detect the presence of wallet W, then the mobile phone may both: (i) vibrate and ring in order to alert the user, and (ii) instruct laptop L to lock itself.

In yet a further aspect, notification processes may be conditional, and vary the manner in which a user is notified, or whether a user is notified at all, based upon various factors.

For example, a mobile phone may determine whether it is likely being carried on a user's person, or located elsewhere, such as in a purse, and adjust the notification process accordingly. In particular, a mobile phone (or any other type of monitoring device) may include sensors to detect, for example, outside surface illumination and/or external temperature, and may be configured to track its own location. Context signals derived from these sensors and location tracking may then be used to determine context by evaluating, for example, whether the device is likely being carried on a user's person (e.g., in the user's pocket), whether it is likely that the user is carrying the device with them, but in a carrying container or bag of some sort (e.g., a purse, backpack, or briefcase), and/or whether it is likely the user has moved out of range from their phone. The notification process may then be adjusted based upon the determined context.

More specifically, the mobile phone may determine that it is in a dark location using its outside-surface illumination sensor, and that the external temperature is high enough to indicate that the phone is likely located proximate to a user's body, and conclude therefrom that it is likely in the user's pocket or elsewhere on the user's person. The notification process may then be adjusted by, for example, turning on vibration, increasing the duration and/or intensity of vibration, and/or turning off or lowering the volume of the ringer when notifying the user that a proximity requirement is not met. On the other hand, if the phone determines that it is in a dark location, and that the external temperature is not as high as it would be if located proximate to the user's body, then notification process may then be adjusted by, for example, turning on the ringer, increasing the volume and/or duration of the ringer, and/or turning off or reducing the intensity of vibration when notifying the user that a proximity requirement is not met. Those skilled in the art will understand that numerous variations on these examples are possible, without departing from the scope of the invention.

As an additional example, when a notification process has been initiated and the phone is ringing and/or vibrating, the phone may use data from an accelerometer and/or gyroscope to detect movement that is characteristic of a user removing their phone from their pocket (possibly in conjunction with detecting movement from a dark to a light location in the midst of the notification process). Similarly, accelerometer and/or gyroscope data may be used to detect movement that is characteristic of a user fumbling for their phone (e.g., rapid short movements in varying directions), which occurs after initiating a notification process. In either case, the user's action may indicate that the user is aware of the notification process, and that the notification process has thus served its purpose. Accordingly, continuation of a notification process or a portion thereof may be conditioned upon absence of such movement during the notification process. For instance, ringing and/or vibrating functions may be disabled upon detecting such movement. However, the device may continue to display a graphic notification on its display, in order to indicate the particular reason for the notification (e.g., the proximity requirement corresponding to the notification process).

In a further aspect, a proximity framework may also define relationships between proximity requirements and as such, notification processes may also be conditioned upon these relationships. Using proximity framework 700 as an example, if mobile phone P cannot detect laptop L (in violation of proximity requirement 702*a*), but mobile phone P can detect key K and wallet W (in compliance with proximity requirements 702*b* and 702*c*), this likely means it is the laptop L that has been left behind by the user. In this case (i.e., when proximity requirement 702*a* is not met, but proximity requirements 702*b* and 702*c* are both met), the proximity framework may specify that the notification process should involve ringing, vibrating, and/or visually displaying an alert message on mobile phone P, as well as locking laptop L.

On the other hand, if mobile phone P cannot detect laptop L, and mobile phone P also cannot detect key K and wallet W, this likely means that the mobile phone has been left behind by the user. When this relationship between proximity requirements exists (i.e., when none of proximity requirements 702*a*, 702*b* and 702*c* are met) the proximity framework may specify that the notification process should involve locking mobile phone P (and possibly ringing, vibrating, and/or visually displaying a notification on mobile phone P as well). Those skilled in the art will understand that numerous variations on these examples are possible, without departing from the scope of the invention.

Methods for Selecting Proximity Framework Based on User-Context

Figure 8:
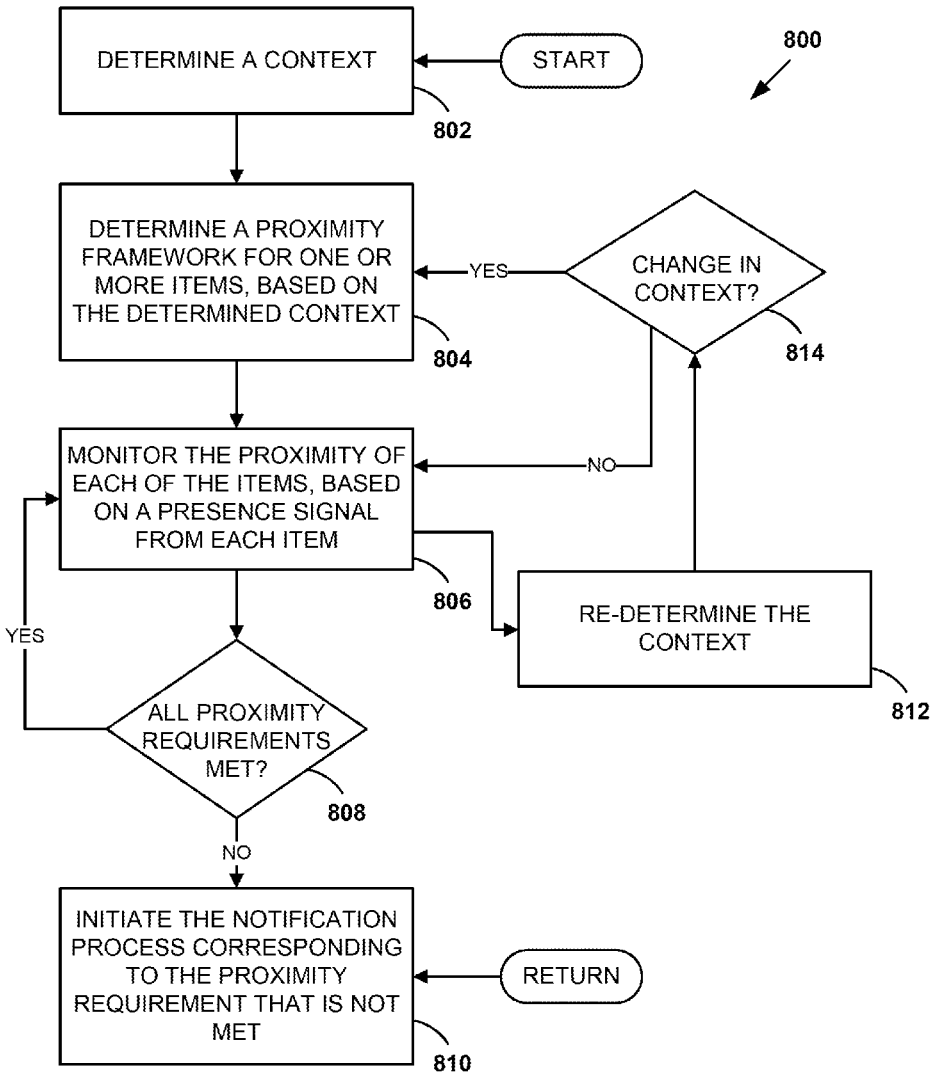
FIG. 8 is a flow chart illustrating a method in which a proximity framework for monitoring one or more items is selected according to determined context.

As noted above, an example monitoring device may include intelligence for deciding that certain proximity frameworks should be implemented in certain contexts. For example, FIG. 8 is a flow chart illustrating a method according to an example embodiment. Method 800 illustrates an embodiment in which a proximity framework for monitoring one or more items is selected according to determined context.

More specifically, method 800 involves a monitoring device determining a context, as shown by block 802. The determined context may be, for example, a user-context for a user-associated with the device, a context of the monitoring device itself, and/or a combination thereof. The monitoring device then determines a proximity framework based on the determined context, as shown by block 804. In a basic form, the proximity framework may include (a) one or more proximity requirements, with each proximity requirement indicating a required proximity between the monitoring device and at least one of the items, and (b) a notification process corresponding to each proximity requirement. The monitoring device may then monitor the proximity of each of the items, based on a presence signal from each item, as shown by block 806.

As the monitoring device monitors proximity of the items, the monitoring device determines whether all the proximity requirements are met, as shown by block 808. When all proximity requirements are met (e.g., all presence signals are detected), the monitoring device continues to monitor the proximity of each of the items. However, if the monitoring device determines that one of the proximity requirements is not met, the monitoring device may responsively initiate the notification process corresponding to the proximity requirement that is not met, as shown by block 810.

In further aspect, while monitoring the items, the monitoring device may from time to time re-determine the context, as shown by block 812. The monitoring device may then check whether the context has substantially changed, such that the proximity framework should be re-evaluated, as shown by block 814. If the context remains substantially unchanged, the monitoring device continues to monitor the proximity of each of the items.

In an example embodiment, the function of determining the context may involve acquiring and/or determining values for context signals that relate to a user's environment or surrounding, location, timing information context signals that are provided by a user, context signals derived from user-provided information (e.g., information provided in a user's documents or emails, or on a user's social networking profile), context signals determined from sensors or modules on the monitoring device (e.g., context signals acquired via one of the sensors or modules of monitoring device 600), user-specific information learned by the monitoring device based on observation of user-context over time and/or user-provided feedback regarding user-context, and/or context signals indicating proximity of certain items that are associated with certain locations or other specific user-contexts.

In some embodiments, the proximity framework includes proximity requirements indicating that the presence of items should be detected. Such a proximity requirement may be satisfied whenever the presence signal from the item is sensed by the monitoring device. However, it is possible that a given proximity requirement may further specify that a device be within a certain distance from the monitoring device, or include other more-specific requirements.

For example, a proximity requirement may specify that two items that are being monitored must be within certain distance from one another. In this case the monitoring device may determine the locations of the two items and from the locations, the distance between the items. The monitoring device may then compare this distance to the maximum distance that is permissible, as specified by the proximity framework. Further, those skilled in the art will understand that this concept may be extended to proximity requirements that indicate that three or more items must all be within a certain distance from one another. Yet further, distance requirement may be conditional. For instance, proximity requirement may indicate that a first item should be detected, and if a second item is detected, that the first item should also be within a certain distance.

Some embodiments may also involve one or more proximity requirements specifying that a certain item or items should not be detected, or should be at least a certain distance away from the monitoring device. In such embodiments, the corresponding notification process may be initiated in response to detecting the item, or in response to determining that the item is too close. For example, when the monitoring device determines that the user-context is "watching television," a proximity requirement may be defined in an effort to prevent a user from sitting too close to their television set.

More specifically, the monitoring device may first determine that the user-context is "watching television" by, for example, detecting an RFID or NFC tag that is associated with a television (and is possibly detectable only when the television is turned on), determining that the user is in a location where the user typically watches television (e.g., "family room" or "TV room"), or detecting radiation associated with a television screen, among others. When it is determined that the user context is "watching television", the monitoring device may implement a proximity framework with a requirement that the user be a certain distance from the television. In a further aspect, the distance may depend on the value of a context signal indicating the size of the television, if such a signal is available. Alternatively, a predetermined distance may be required. In either case, the monitoring device may then monitor the distance between television and a mobile phone or another monitoring device that is on the user's person, and notify the user if they are too close.

Note that the above example also illustrates an application in which the determined user-context includes a user's specific location within a more general location. In particular, to determine the user was near the television, the monitoring device could first determine that the user is located in their living room (e.g., a general location), and then determine where in the living room the user is located (e.g., a specific location within the general location), in order to determine the user's distance to the television. In so doing, the monitoring device intelligently combines information from multiple context signals to derive a more specific user-context than would be possible if it relied solely on the information provided by the individual context signals.

In another further aspect, multiple proximity requirements may be defined between the same items in order to provide for granular notification of the user. In particular, proximity requirements may be defined for a number of distance ranges between the monitoring device and a given item, and a notification process associated with each. In an example embodiment, the associated notification processes increase in urgency as the distance from the monitoring device increases.

While a single notification process may be associated with each proximity requirement, it is also possible that a multiple notification processes may be associated with a single proximity requirement. For instance, plurality of possible notification process for a given proximity requirement may include: (a) an emergency notification process, (b) a standard-alert notification process, (c) a suggestion notification process, and/or (d) a do-nothing process. Further, the proximity framework may specify how to determine which of the notification process associated with a given proximity requirement should be used at a given time. As such, an example method 800 may further involve setting the notification process for a given proximity requirement to be one of plurality of possible notification process for the proximity requirement.

As noted above, the notification process for a given proximity requirement may be selected from multiple possible processes based on certain context signals. To provide a specific example, consider a scenario where the monitoring device determines that the user-context is "in the car." When a user is in their car, they may wish to have their sunglasses with them in certain situations, but not in others (e.g., nighttime). Further, the need for sunglasses may be more urgent at some times (e.g., near sunrise or sunset, when the sun is low to the horizon and likely to create a glare), than at other times (e.g., at midday, when the sun is directly overhead). Accordingly, when the user-context is "in the car", the monitoring device may vary the notification process associated with the user's sunglasses not being detected according to the time of the day.

For example, the monitoring device may select between three notification processes, which all correspond to a proximity requirement for the user's sunglasses, based on the time of day. In particular, if the monitoring device determines it is near to sunrise or sunset, the monitoring device may use a notification process that involves: using a loud ringer on the user's mobile phone (possibly even overriding a phone setting of vibrate or silent), vibrating the user's mobile phone, displaying an on-screen notification on the phone, and continuing these alerts until the user physically stops the notification process (e.g., by responding to the on-screen alert by pressing a button on the phone). If it is mid-day, and the sun is overhead, the need still exists, but may be considered less urgent. Accordingly, the monitoring device may use a notification process that involves: ringing or vibrating to the user's mobile phone according to the phone's setting, displaying an on-screen notification, and only doing so for a predetermined period before automatically turning off the alarm. And if it is determined to be nighttime, the monitoring device may simply disable the notification process, as the sunglasses are not needed.

In some embodiments implementing the above method for monitoring sunglasses, further context signals may be used to more intelligently vary the notification process. For example, the monitoring device may determine the date and look up the specific time of sunrise and/or sunset, in order to determine if it is near sunrise or sunset.

As another example, if it is near sunset or sunrise, the monitoring device may determine a user's direction of travel, and whether the direction of travel is into or away from the sun. When the user is driving towards the sun, the monitoring device may increase the urgency of the alert even further. The direction of travel may be determined using various techniques. For instance, before or during a drive, the monitoring device may determination the direction of a planned destination (such as indicated by a GPS mapping function or on a user's calendar). Further, during a drive, the device may determine the direction of travel using GPS and/or sensors such as an accelerometer, compass, and/or gyroscope. Variations on the above examples are possible.

In practice, a monitoring device that implements method 800 may serve as a centralized "hub" that monitors the presence of other items. In such an embodiment, the hub may keep track of all information and track proximity of all items in the proximity framework.

In other embodiments, the monitoring device may be part of a "mesh" network, where a number of different devices all serve as monitoring devices, and monitor one another. For instance, a mesh network of all items associated with a given user may be created and captured with the proximity framework. In such a mesh network, each monitoring device may perform an example method, such as method 800. (Thus, from the perspective of one monitoring device, the other monitoring devices may be treated as items that are being monitored.)

And in other embodiments, the monitoring device may be part of a semi-mesh network that includes a number of monitoring devices and a number of items. In such an embodiment, some or all of the monitoring devices may monitor one another, while the items, which are not configured as monitoring devices, are monitored by some or all of the monitoring devices.

Example Proximity-Monitoring Method for a Group of Items

In some embodiments, an example monitoring device may group items, and associate a certain proximity framework for the particular group of items with a given context. A monitoring device may then keep track of available context signals, and detect when the current context is substantially the same as the context associated with the group. When this context is detected, the monitoring device responsively implements the associated proximity framework.

Figure 9:
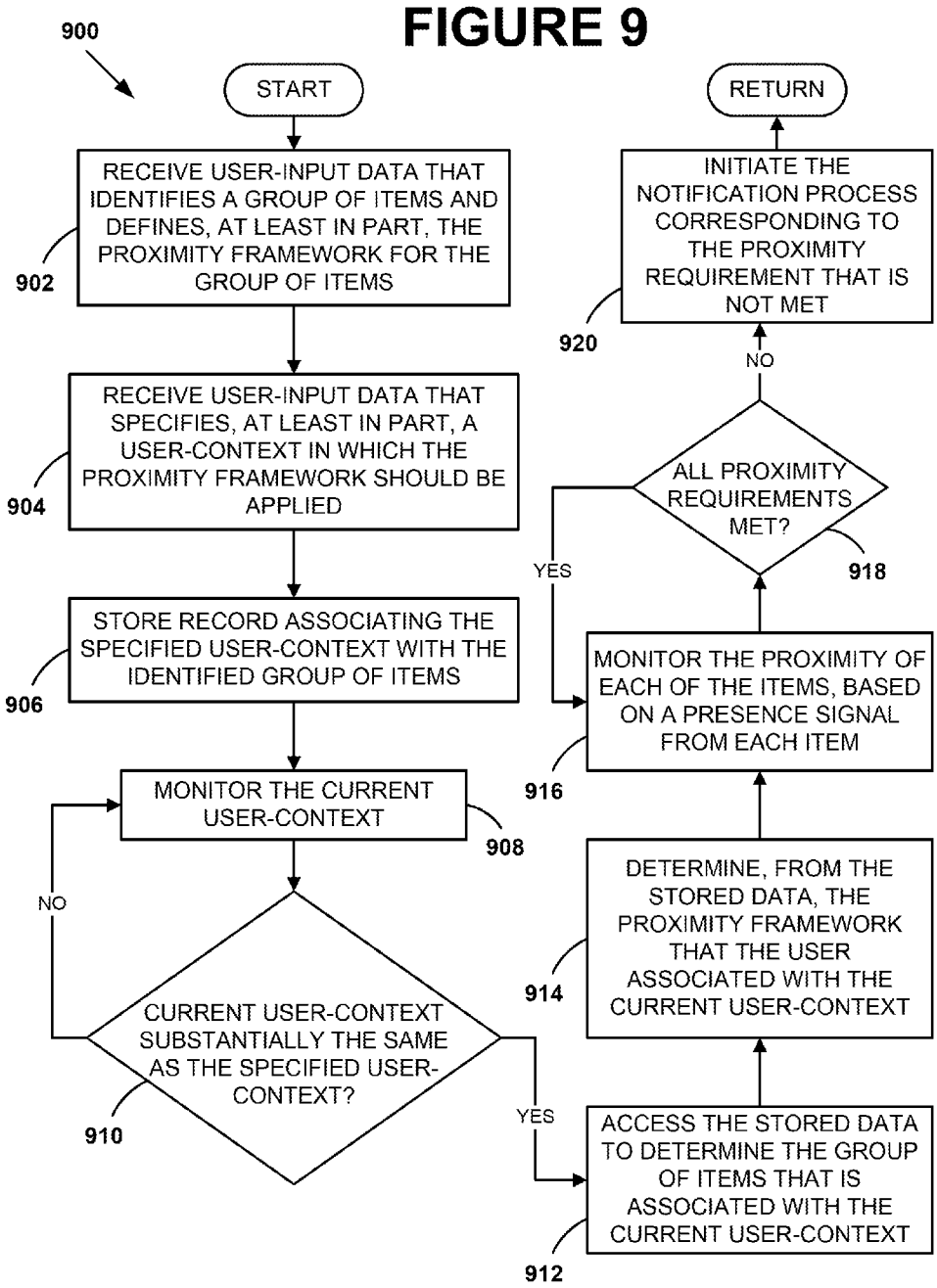
FIG. 9 is a flow chart illustrating a method according to an example embodiment in which a group of items and its associated proximity framework are determined based upon a determined context.

For example, FIG. 9 is a flow chart illustrating a method according to an example embodiment in which a group of items and its associated proximity framework are determined based upon a determined user-context. More specifically, method 900 involves the monitoring device receiving user-input data that identifies a group of items and defines, at least in part, the proximity framework for the group of items, as shown by block 902. The method further involves receiving user-input data that defines, at least in part, a user-context in which the proximity framework should be applied, as shown by block 904. The monitoring device may further store a data record associating the specified user-context with the identified group of items, as shown by block 906.

The monitoring device may then monitor the current user-context (e.g., by keeping track of various context signals), as shown by block 908. As it does so, the monitoring device may evaluate whether the current user-context is substantially the same as the specified user-context, as shown in block 910. If the monitoring device detects that the current user-context is substantially the same as the stored user-context, then the monitoring device accesses the stored data to determine the group of items that is associated with the current user-context, as shown by block 912. The monitoring device may also determine, from the stored data, the proximity framework that the user associated with the current user-context, as shown by block 914.

Once the proximity framework is determined, the monitoring device proceeds to monitor the group of items in the manner specified by the proximity framework. For example, the monitoring device may then monitor the proximity of each of the items based on the presence signal from each item, as shown by block 916. As it monitors proximity, the monitoring device evaluates whether all the proximity requirements are met, as shown by block 918. When all proximity requirements are met (e.g., all presence signals are detected), the monitoring device continues to monitor the proximity of each of the items. However, if the monitoring device determines that one of the proximity requirements is not met, the monitoring device may responsively initiate the notification process corresponding to the proximity requirement that is not met, as shown by block 920.

It should be understood that while method 900 relied upon user-provided data to define the proximity framework and its corresponding context, blocks 906-916 may also be carried out when the stored proximity framework and/or its corresponding context are defined, in whole or part, by the monitoring device. Other variations of method 900 are possible as well.

Example Proximity-Monitoring Method for an Item-Category

In some situations, a user may have a number of items that are interchangeable. In such situations, a proximity requirement may only require the presence of one item from an item-category that includes a number of items. For example, a user may have a number of different belts, and wish to be reminded to put on a belt on the morning to be saved the embarrassment of having a co-worker point out that they forget to put a belt on. Accordingly, a proximity requirement for the "belt" item-category may specify that at least one of the user's belts should be within a short distance from the user (perhaps by assuming that being a short distance from a device that is typically on a user's person, such as a mobile phone, is indicative of being a short distance from the user's person). The proximity-requirement for the "belt" item-category may therefore be met when just one of a number of different belts is detected.

Figure 10:
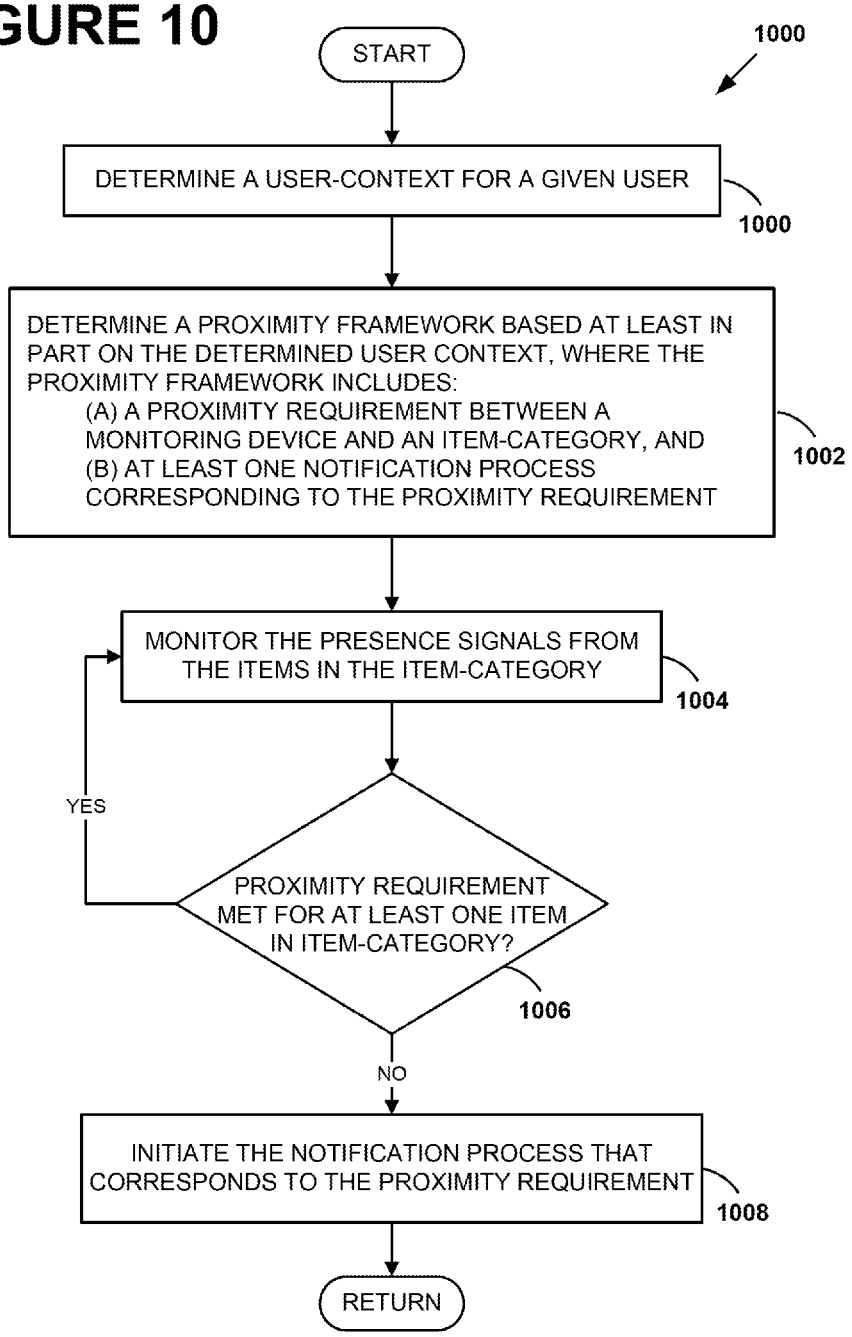
FIG. 10 is a flow chart illustrating a method that accounts for item-category proximity requirements, according to an example embodiment.

FIG. 10 is a flow chart illustrating a method that accounts for item-category proximity requirements, according to an example embodiment. According to an example embodiment, the item-category includes a number of items that are generally considered interchangeable, or are at least interchangeable in a certain context. As such, the presence of any one of the items in the item-category may satisfy the proximity requirement for the item-category.

More specifically, method 1000 involves a monitoring device determining a user-context for a given user, as shown by block 1002. The monitoring device then determines a proximity framework based at least in part on the determined user context, where the proximity framework includes: (a) a proximity requirement between a monitoring device and an item-category, and (b) at least one notification process corresponding to the proximity requirement, as shown by block 1004. The monitoring device then implements the proximity framework by monitoring the presence signals from the items in the item-category, as shown by block 1006. The implementation of the proximity framework further involves the monitoring device determining whether the proximity requirement between the monitoring device and the item-category is met for at least one item in the item-category, as shown by block 1008. If the monitoring device determines that the proximity requirement is not met between the device and any of the items in the item-category, the monitoring device responsively initiates the notification process that corresponds to the proximity requirement, as shown by block 1010.

Example Method for Monitoring Inventory

In some embodiments, an example method may be used to monitor the inventory or stock of an item or items, and to provide the user with functionality for understanding and managing the inventory of such items. For example, a user might use a mobile-phone based application to define desired quantities of certain grocery items the user likes to have at their home. The mobile phone may then determine whenever the user is in their kitchen, or near their refrigerator or pantry, and take an inventory of the grocery items. If the mobile phone determines that the user is out of or running low on a certain grocery item, then the mobile phone may initiate a notification process to alert the user accordingly.

Figure 11:
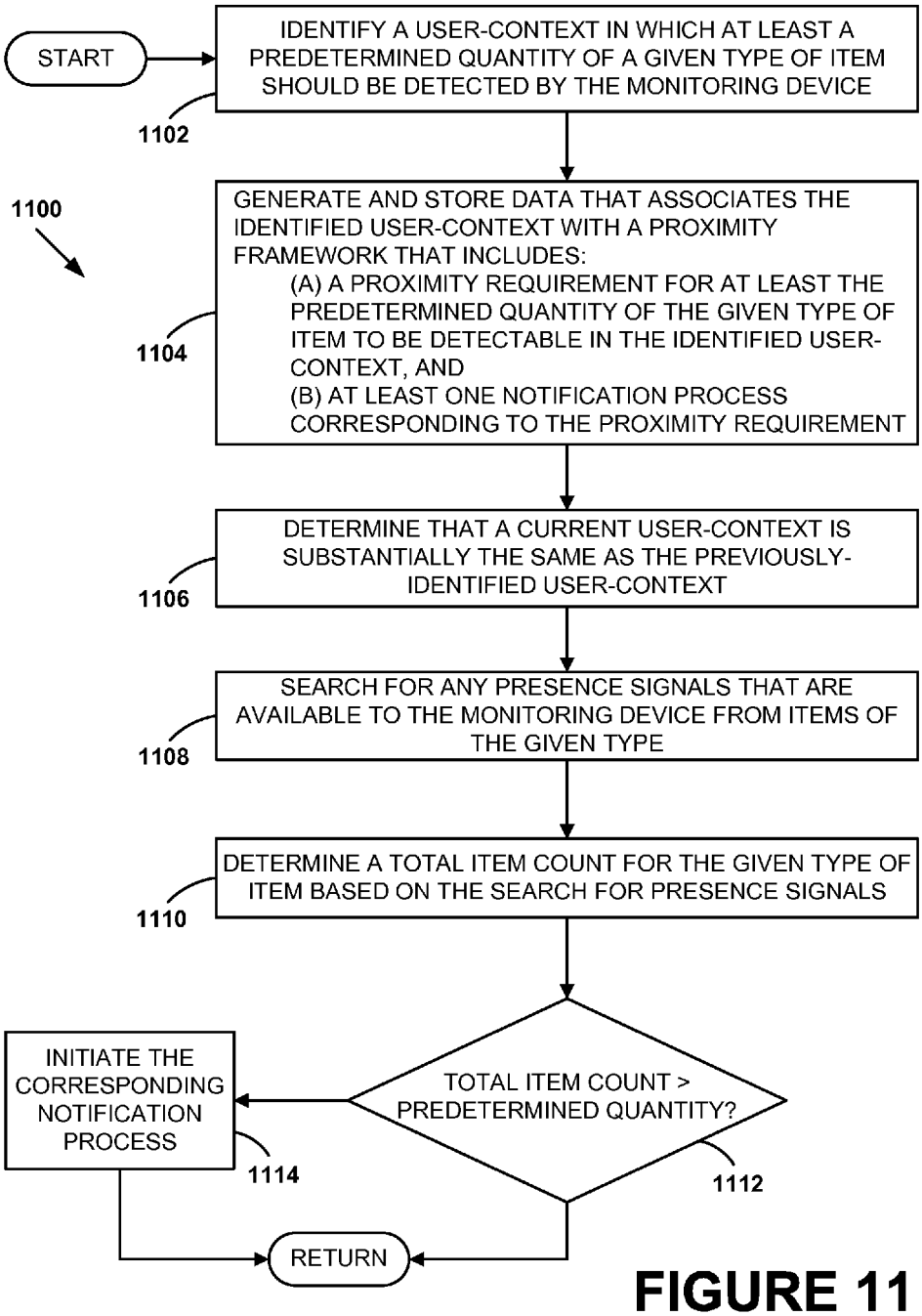
FIG. 11 is flow chart illustrating a method that is applicable to monitor an inventory of an item, according to an example embodiment.

FIG. 11 is flow chart illustrating a method that is applicable to monitor an inventory of an item, according to an example embodiment. In particular, method 1100 involves a monitoring device identifying a user-context in which at least a predetermined quantity of a given type of item should be detected by the monitoring device, as shown by block 1102. The monitoring device may then generate and store data that associates the identified user-context with a proximity framework that includes (a) a proximity requirement for at least the predetermined quantity of the given type of item to be detectable in the identified user-context, and (b) at least one notification process corresponding to the proximity requirement, as shown by block 1104. Then, at a later time, the monitoring device may determine that a current user-context is substantially the same as the previously-identified user-context, as shown by block 1106.

Responsive to detecting the previously-identified user-context, the monitoring device may search for any presence signals that are available to the monitoring device from items of the given type, as shown by block 1108. The monitoring device may then determine a total item count for the given type of item based on the search for presence signals (e.g., based on the number of items of the given type that were detected), as shown by block 1110. Next, the monitoring device may determine whether or not the proximity requirement for the predetermined quantity to be detectable is met by the total item count, as shown by block 1112. If it is determined that the proximity requirement is not met, then the monitoring device initiates the corresponding notification process, as shown by block 1114. Otherwise, the monitoring device may refrain from initiating the corresponding notification process.

In further aspect not shown, a different notification process may be initiated when the proximity requirement is satisfied. For example, a message may be displayed to the user letting them know that they have adequate stock of the item. Other alternative notification processes are also possible.

The function of initially identifying the user-context in which the predetermined quantity of an item should be present may take various forms. For instance, the monitoring device may provide a user-interface via which the user may specify the particular item or items, set the desired quantity for each item, and/or specify the context in which the monitoring device should check for the desired quantity. Alternatively, the monitoring device may intelligently identify and/or suggest user-contexts in which to take inventory of certain items. In particular, the monitoring may observe, over time, where and when items of a given type are typically detectable, and how many items of the type are typically detectable at a given location and/or time. By so doing, the monitoring device may learn the inventory patterns of certain items, and the contexts in which the inventory of the items can be determined. Alternatively, the monitoring device may be pre-programmed to look for certain items in certain contexts. Further, the user-context may be determined based on some combination of user-provided context and item-inventory information, learned context and item-inventory information, pre-programmed context and item-inventory information, and/or information of other types and from other sources.

As a specific example, the user might create a grocery list that includes items they generally like to have in their kitchen, and possibly define a quantity of each item at which a low inventory notification should be provided. Further, the monitoring device may receive instructions from the user indicating the context in which the inventory of items on the grocery list should be checked. For example, the monitoring device could be paired with an item or another monitoring device that is located in the kitchen, such as a detectable refrigerator, for instance, and the context of being "in the kitchen" could be associated with the context signal of detecting the refrigerator. The monitoring device may then create a data record that associates the "in the kitchen" user-context, which exists whenever the refrigerator is detected, with the proximity framework that specifies the inventory requirements for the items on the grocery list.

The monitoring device may alternatively or additionally generate such a grocery list based on learned information. For example, the monitoring device may be set by the user or may be programmed to take an inventory survey of grocery items whenever it determines that the user-context is "in the kitchen." By collecting data that indicates which types of grocery items are detected while the user is in the kitchen and/or how many items of a given type are detected, the monitoring device may, over time, generate a proximity framework that includes inventory requirements for items on the grocery list.

For example, the monitoring device may observe the count of soft-drink cans dropping to two cans in a number of instances, and further observe that the count of soft-drink cans increases to eight cans within two days in all or a majority of these instances. Based on this observation, the monitoring device may conclude that the user likes to restock soft drinks when are down to two cans. Accordingly, the monitoring device may add soft-drinks to the grocery list and create a notification process to be initiated when it detects that two cans or less are present. Alternatively, rather than automatically adding soft-drinks to the grocery list, the monitoring device may prompt the user with a suggestion to add soft-drinks to the grocery list, and may only do so upon receiving a confirmation from the user.

In practice, the monitoring device may store the grocery list as a proximity framework, where one or more proximity requirements is defined for each item on the grocery list. For example, to add soft-drinks to the grocery list, the monitoring device may update the proximity framework defining the grocery list with a proximity requirement that at least two cans be detected. Further, a notification process that alerts the user that stock of soft-drinks is low may be associated with this proximity requirement. Yet further, an additional notification process may be associated with this proximity requirement that alerts the user when no soft-drinks are detected. The alert when no soft-drinks are detected may be more urgent than the alert when soft-drink inventory is low and/or may differ in another manner, or may be the same as the alert when inventory is low.

An example method, such as method 1100, may further involve a monitoring device assisting a user in the process of restocking items. Continuing with the example of a grocery list, the monitoring device may detect and/or receive an indication from the user that the current user-context is, for example, "at the grocery store" or "going to the grocery store." The user may simply input this as their current context. Alternatively, this user-context may be determined based on certain context signals. For example, the monitoring device may determine the user's current location is associated with a grocery store, or may detect the presence of an item or items associated with a grocery store. Other examples are also possible. Regardless of how it is determined that the user is at the grocery store, the monitoring device may responsively initiate a grocery-shopping proximity framework that assists the user with grocery shopping.

For example, the monitoring device may display a grocery list that initially indicates the last-observed inventory of grocery items in the user's kitchen. Then, as the user shops, the monitoring device may detect items that are added to the cart and/or items that are purchased, and update the displayed grocery list accordingly. For example, the monitoring device may scan for the presence of grocery items (e.g., by searching for RFID tags associated with grocery items). The monitoring device may determine that an item has been added to the user's shopping cart when it detects the presence of the item continually over a period of time when the user moves a predetermined distance. For instance, if the monitoring device detects an RFID tag associated with a certain item at a first time and later at a second time, and the user has moved a distance that is greater than the range of RFID between the first and second time, this likely indicates that the item is traveling with the user. The monitoring device may therefore conclude that the item was added to the cart, and update the inventory of the item on the shopping list accordingly.

Many additional features may also be provided to assist the user in restocking inventory of items. For example, a further feature of a grocery-list application may involve displaying suggested coupons for items in the user's cart. Some additional features may be provided if RFID tags are provided at the checkout of a grocery store, such that the monitoring device can determine the user is checking out (or if it is determined in another manner that the user is about to checkout or is checking out). For example, when an RFID associated with the checkout is detected, the grocery list may be updated to indicate that the items currently in the cart have been or are being purchased. This feature may allow for various services to be provided. For instance, an estimation of the user's bill may be generated and displayed to the user. Other additional features are also possible.

It should be understood, that the functionality described above in reference to inventory-monitoring for a grocery list example may also apply to shopping lists or item-inventory lists of any kind, and more generally, to any application of an example inventory-monitoring method, without departing from the scope of the invention.

In a further aspect of an example method, a monitoring device may also allow a user to check inventory on demand, and/or provide inventory updates even when low-inventory and out-of-stock alerts are not necessary. For example, the monitoring device may provide a user-interface via which a user can request current inventory for items on a given item-inventory list. Additionally or alternatively, the monitoring device may periodically send an inventory status report to the user. Such an inventory status report may be provided in various ways. For instance, an inventory status report may be displayed on the monitoring device, may be sent via a text message and/or e-mail message, or may be sent in a letter via standard postal service. Other examples are also possible.

The example method may involve keeping track of item count for a given type of item. It should be understood that item "type" may be defined in various ways. For example, referring again to the example of a grocery list, soft-drinks may be considered interchangeable, so all types of soft drinks (e.g., cola, lemon-lime, orange, etc.) may be counted together. However, soft-drinks types or sub-types could also be established by brand or by flavor, or by brand and flavor. As another example, more general categories of beverages could be defined. For instance, juice, milk, and tea might all be considered to be "healthy beverages", and thus viewed as interchangeable for purposes of tracking inventory of healthy beverages. Generally, item-types may be provided in a flexible manner, and may be defined by the user, learned by the monitoring device, and/or provide from other sources (e.g., pre-programmed or acquired from a centralized monitoring support system). The above examples are intended to illustrate the flexibility of item-types, and are not intended to limit the scope of the invention in any manner.

In a further aspect, an inventory-monitoring method such as method 1100 may be implemented in a system where presence signals from all items of certain type are the same or provide common identifying information. In such embodiments, the type of item may be determined by evaluating the presence signal. To provide a specific example, RFID tags that transmit a 38-digit number might be used on all soft-drink cans. Thus, the same 38-digit number might be used to identify all cans of lemon-lime soft drinks.

Alternatively, the RFID tag might provide more granular information that can be used to determine item-type in a more sophisticated and/or flexible manner. To do so, a 38-bit RFID tag might include 4 bits indicating a container type (e.g., can, bottle, etc.), 4 bits corresponding to soft-drink brand, 4 bits corresponding to flavor type (e.g., lemon-lime, orange, cola, etc.), and so on. Provided with such information, a monitoring device may provide more flexibility in how item-inventory is tracked. For instance, the monitoring device could track soft-drinks in a very general manner (e.g., tracking inventory of all soft-drinks of any flavor, brand, and container), in a very specific manner (e.g., by tracking orange soft-drink bottles of a certain brand), or with a level of specificity somewhere between these examples.

In a further aspect, it is also possible that items of a certain type may all have completely different RFID tags from one another. However, a monitoring device may either include or have access to an item-type database that maps unique item identifiers to type-information associated with the item. Accordingly, in such an embodiment, a monitoring device may still track inventory for a given type of item by using the item-type database to determine which type of items it is detecting.

In yet a further aspect, it is possible that a given presence signal may be associated with an item count that is greater than one. As just one example, a twelve-pack box of soft-drink cans may have just one RFID tag on the box. Accordingly, the monitoring device may update the total item count by twelve when it detects such an RFID tag. Many other examples are also possible. Note also that in the above example, NFC and/or other communication technologies may be used instead of or in conjunction with RFID.

In some embodiments, an example inventory-tracking method may further use certain context signals to estimate inventory in cases where a specific item count is not available (or to verify a count based on detected presence signals). For instance, a monitoring device may estimate a rate of consumption or use for a certain type of item, and monitor inventory based thereon. As one example, a user may generally keep only one gallon of milk in their refrigerator, but may wish to be notified to buy more before they actually run out. In this case, simply detecting a presence signal from the gallon of milk may be insufficient, because the presence signal does not indicate when the amount of milk in the jug is low. However, the monitoring device could learn that a user typically buys new milk every two weeks (either by the user providing this information, or by observing milk inventory over time, so some combination thereof). Then, when same milk jug has been detected for a week and a half, for example, the monitoring device may suggest that the user is running low, and ask if milk should be added to the grocery list. Many other examples are also possible.

In a further application of an example inventory-tracking method, some embodiments may involve providing a notification that indicates whether it is possible for the user to acquire additional stock of an item. For example, a monitoring device may track inventory of items in a user's refrigerator, and compare space used in the refrigerator to space available in the refrigerator. Then, when the user is at the grocery store, the monitoring device may evaluate how much space is needed for perishable items in the user's grocery cart, and notify the user if there is not enough room in their refrigerator for all the perishable items in their cart.

Methods for Learning User-Context and Item-Presence Relationships

As noted several times herein, some embodiments may involve a monitoring device learning which items are present in which contexts, and generating proximity rules based thereon. In particular, an example monitoring device may build a database of historical user-context data for its user, which it can use to intelligently create item-groups, item-categories, proximity requirements, full proximity frameworks, and/or to associate or suggest association of certain user-contexts with certain proximity requirements or frameworks. To do so, the monitoring device may from time-to-time evaluate the data and determine when a proximity framework for an item or a group of items may be associated with a certain user-context. As such, when that user-context is detected at a later time, the monitoring device may respond by automatically implementing the associated proximity framework, or by notifying the user that the user-context has been detected, and providing the user with the option to implement the associated proximity framework.

Figure 12A:
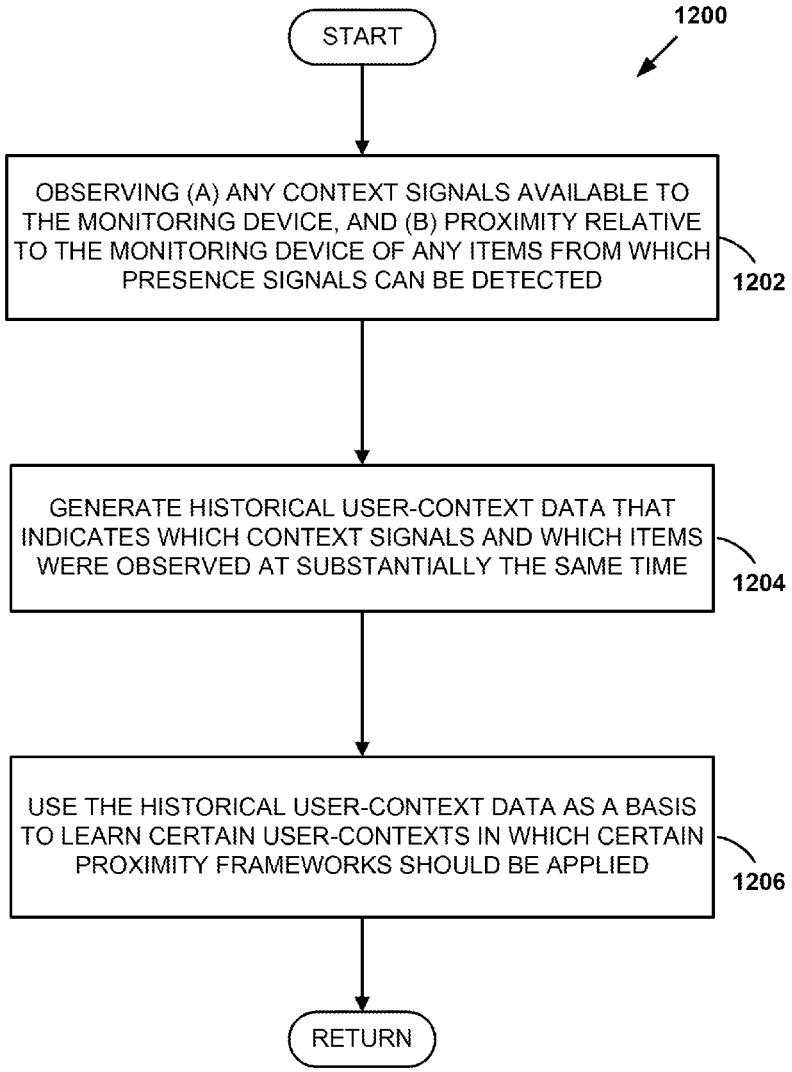
FIG. 12A is a flow chart illustrating a method for dynamically learning relationships between contexts and proximity frameworks, according to an example embodiment.

FIG. 12A is a flow chart illustrating a method for dynamically learning relationships between contexts and proximity frameworks, according to an example embodiment. In particular, method 1200 involves the monitoring device observing: (a) any context signals available to the monitoring device and (b) proximity relative to the monitoring device of any items from which presence signals can be detected, as shown by block 1202. As user-context and proximity of various items are observed over time, the monitoring device may generate historical user-context data that indicates which context signals and which items were observed at substantially the same time, as shown by block 1204. The monitoring device may then use the historical user-context data as a basis to learn certain user-contexts in which certain proximity frameworks should be applied, as shown by block 1206.

Automatic Generation of Historical User-Context Data

Figure 12B:
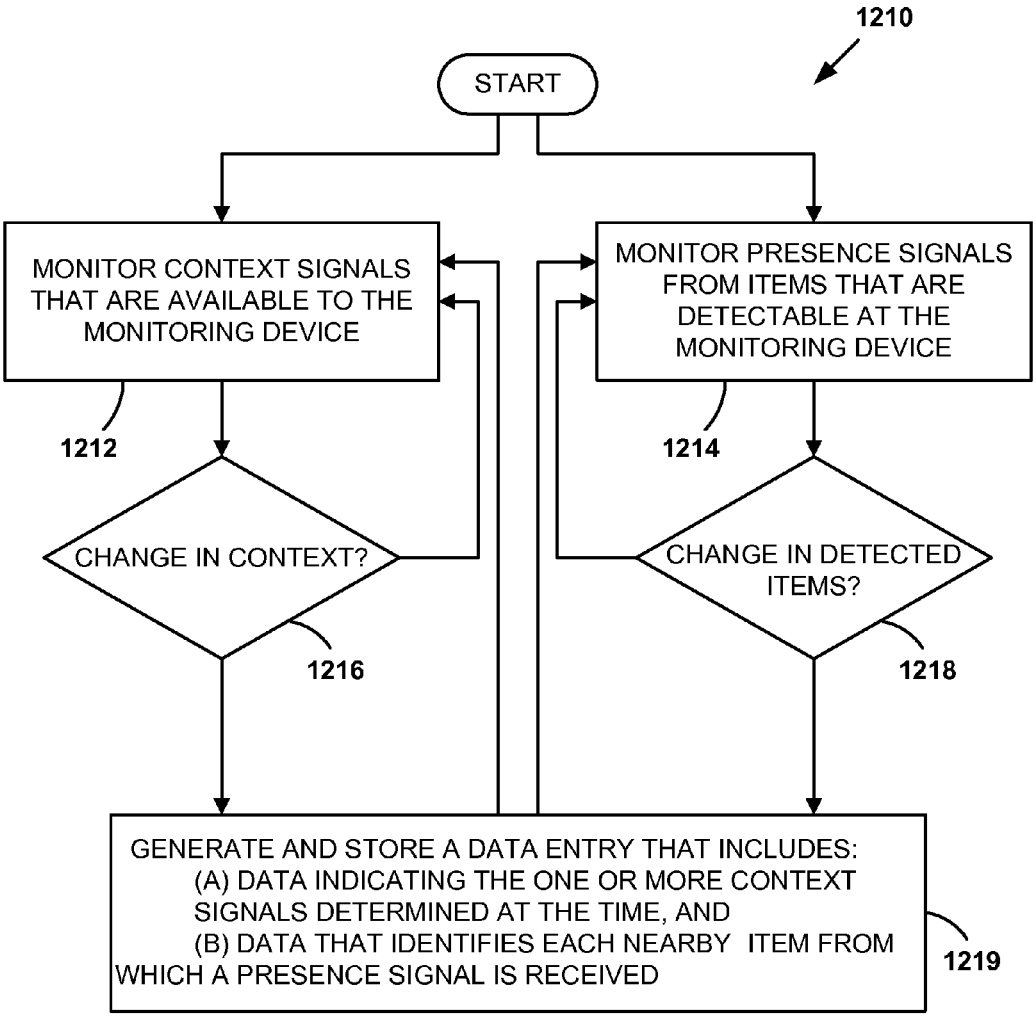
FIG. 12B is a flow chart illustrating a method carried out by a monitoring device to automatically populate a historical context database, according to an example embodiment.

A monitoring device may automatically generate historical user-context data by periodically or continually searching for all available context signals and any items from which a presence signal can be detected. For example, FIG. 12B is a flow chart illustrating a method carried out by a monitoring device to automatically populate a historical user-context database, according to an example embodiment. In particular, method 1210 involves the monitoring device monitoring one or more context signals, as shown by block 1212. The monitoring device also monitors presence signals from items that are detectable at the monitoring device, as shown by block 1214. Further, the monitoring device may evaluate the context signals and items present over time, and determine when there is a change in context and/or a change in which items are detected, as shown by blocks 1216 and 1218.

When a change is detected, the monitoring device may create a "snapshot" of the context and detected items at that time. In particular, the monitoring device may generate and store a data entry that includes: (a) data indicating the one or more context signals determined at the time and (b) data that identifies each nearby item from which a presence signal is received, as shown by block 1219. Further, the monitoring device may populate the historical user-context database by taking a snapshot (i.e., generating a database entry) each time a change in context and/or detectable item occurs.

In an example embodiment, the monitoring device may monitor the context signals on a substantially continual basis or may periodically determine context signals. Similarly, a monitoring device may search for presence signals on a substantially continual basis or may periodically search for available presence signals. Yet further, the same monitoring device may monitor some context signals and/or presence signals continuously, while monitoring other context signals and/or presence signals periodically.

In an example embodiment, the monitoring device may require a change of a certain significance at block 1216 and/or block 1218 in order to trigger the creation of a snapshot at block 1219. Such a requirement may result in user-context data being generated less frequently, and thus may be implemented in order to control the amount of data being generated, among other purposes. For example, a snapshot may be triggered by a binary change in a context signal (e.g., a context signal disappearing or a new context signal being received). As another example, a snapshot may be triggered when the value of a continuously-monitored context signal changes by a predetermined amount over a predetermined period of time or has changed by a predetermined amount since the last snapshot that was triggered by a change in that context signal. Further, for a context signal that is monitored periodically, the evaluation of whether a change is significant enough to warrant a snapshot may involve a comparison of a currently determined context signal to the last-determined context signal or a determination of the change in the context signal over a predetermined number of periods or since the last snapshot that was triggered by a change in that context signal. Other examples are also possible.

Further, the historical proximity data may simply indicate whether or not the presence signal of an item is detected at a given time. Additionally or alternatively, the monitoring device may determine the distance between itself and detected items, and generate data indicating the distance to detected items.

In another variation, the monitoring device may periodically generate a snapshot of context and item-presence according to a predefined schedule. Further, the monitoring device may do so in addition to or as an alternative to generating snapshots in response to changes in context and/or item-presence.

Figure 13A:
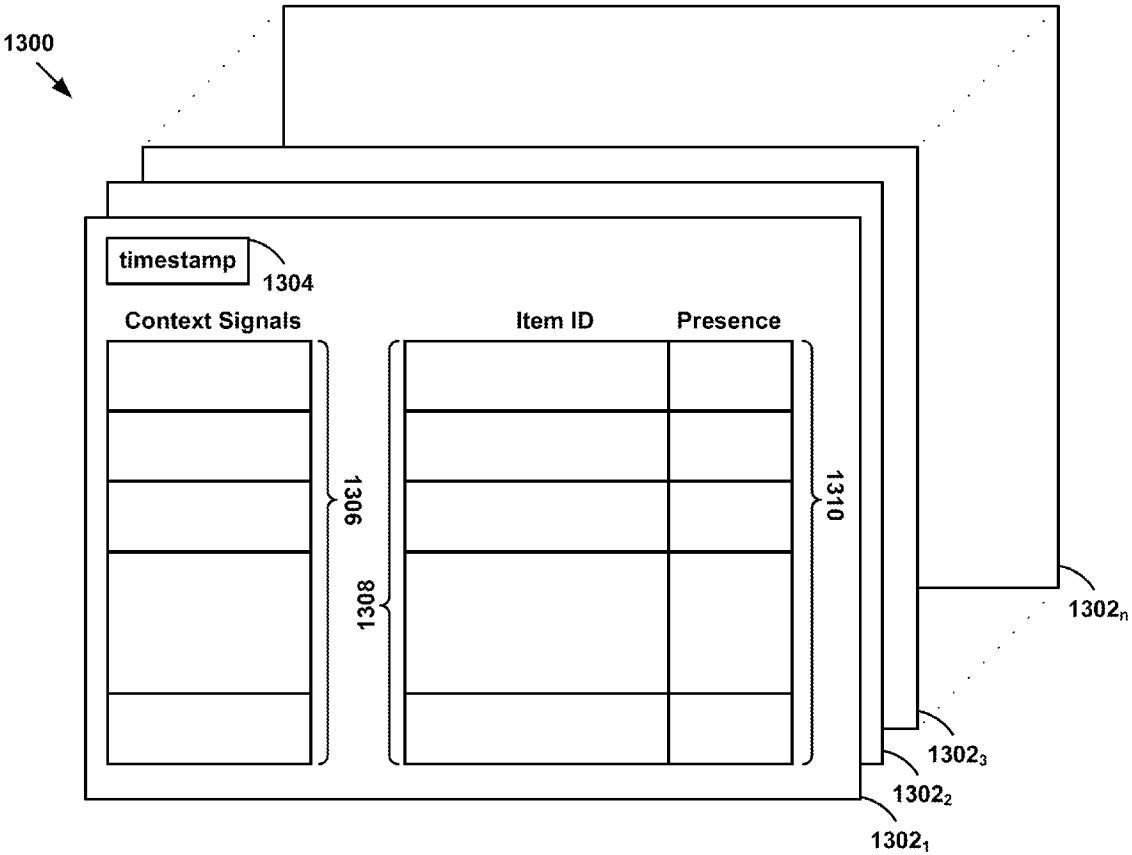
FIG. 13A is an illustration of snapshots in a historical context database, according to an example embodiment.

FIG. 13A is an illustration of snapshots in a historical user-context database, according to an example embodiment. The snapshots $\mathbf{1302}_1$-$\mathbf{1302}_n$ in historical user-context database 1300 may be generated, at least in part, using an example method such as that illustrated by FIG. 12B. Taking snapshot $\mathbf{1302}_1$ as a general example of a snapshot, each snapshot may include a timestamp 1304 that indicates a time at which the snapshot was created. Further, each snapshot includes context information, such as an indication of any context signals 1306 that the monitoring device received or determined at the time.

Each snapshot also includes proximity data related to items that were detected at the time. For example, in the illustrated embodiment, each snapshot includes a list of item IDs 1308 and a corresponding indication 1310 of whether or not a presence signal was detected from the associated item at the time. Note that the item-proximity information may provide an explicit indication that an item is not detected (e.g., by listing the item ID 1308, and setting the corresponding indication 1310 to indicate no presence signal was detected). This may provide some continuity between snapshots, as each snapshot may include an indication 1310 for the same list of item IDs 1308. In other embodiments, each snapshot may simply include a list of item IDs for items that were actually detected. It may then be assumed that inclusion on the list indicates presence was detected at the time, whereas omission from the list indicates no presence was detected at the time.

Generally, the timestamp 1304 may be any data that links context information (e.g., context-signals 1306) to item-detection data (e.g., item IDs 1308 and the corresponding indications of presence 1310) that is recorded at the same time. As such, the timestamp 1304 may be the actual time of the snapshot or some other measure of time. Alternatively, the timestamp may be any other type of unique identifier that is assigned to a set of context information and item-detection information that is observed by the monitoring device at substantially the same time.

It should be understood that the basic structure of historical user-context data that is shown in FIG. 13A is merely one example. The historical user-context database may vary in structure, and more or less data may be included within the illustrated "snapshot" structure, without departing from the scope of the invention.

Figure 12C:
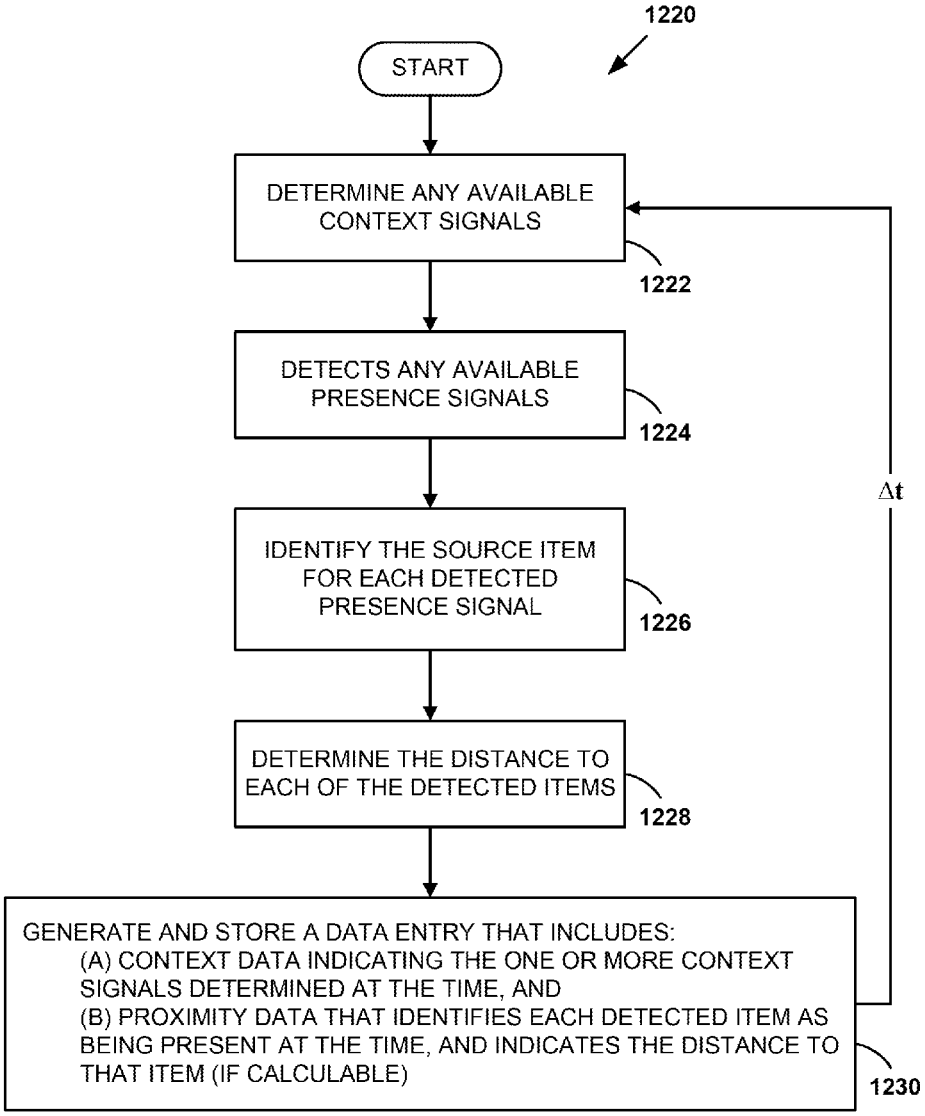
FIG. 12C is another flow chart illustrating a method carried out by a monitoring device to automatically populate a historical context database, according to an example embodiment.

FIG. 12C is another flow chart illustrating a method carried out by a monitoring device to automatically populate a historical user-context database, according to an example embodiment. Method 1220 illustrates an embodiment in which the monitoring device automatically generates periodic snapshots of context, item-presence, and distance to items.

More specifically, method 1220 involves the monitoring device, at a predetermined time, determining any available context signals, as shown by block 1222. The monitoring device also searches for and detects any available presence signals from items, as shown by block 1224. The monitoring device then identifies the source item for each detected presence signal, as shown by block 1226. The monitoring device also determines the distance to each of the detected items, as shown by block 1228. After acquiring this information, the monitoring device may generate and store a data entry that includes: (a) context data indicating the one or more context signals determined at the time, and (b) proximity data that identifies each detected item as being present at the time, and indicates the distance to that item (if calculable), as shown by block 1230. As shown, the monitoring device may repeat method 1220 at a time interval $\Delta t$.

As noted, a monitoring device may use a method that periodically records snapshots of context and item-presence, such as method 1220, alone or in combination with a method that records a snapshot of a new context and item-presence scenario, when a change in the scenario is detected. Both techniques may have benefits and drawbacks. For example, periodically recording snapshots may provide a better indication of the duration for which each context persists and the duration for which items remain present, as compared to change-triggered snapshots. However, it is possible that periodically recorded snapshots may miss certain context and item-presence combinations that occur entirely between snapshots. The probability of missing certain context and item-presence combinations may be reduced by reducing the time between snapshots. However, this also may have the effect of increasing the size of the user-context database, as snapshots may be generated and stored more frequently. Accordingly, the decision about whether to implement a periodic or change-triggered method to generate user-context data, or some combination of both methods, is a matter of engineering design choice.

Figure 13B:
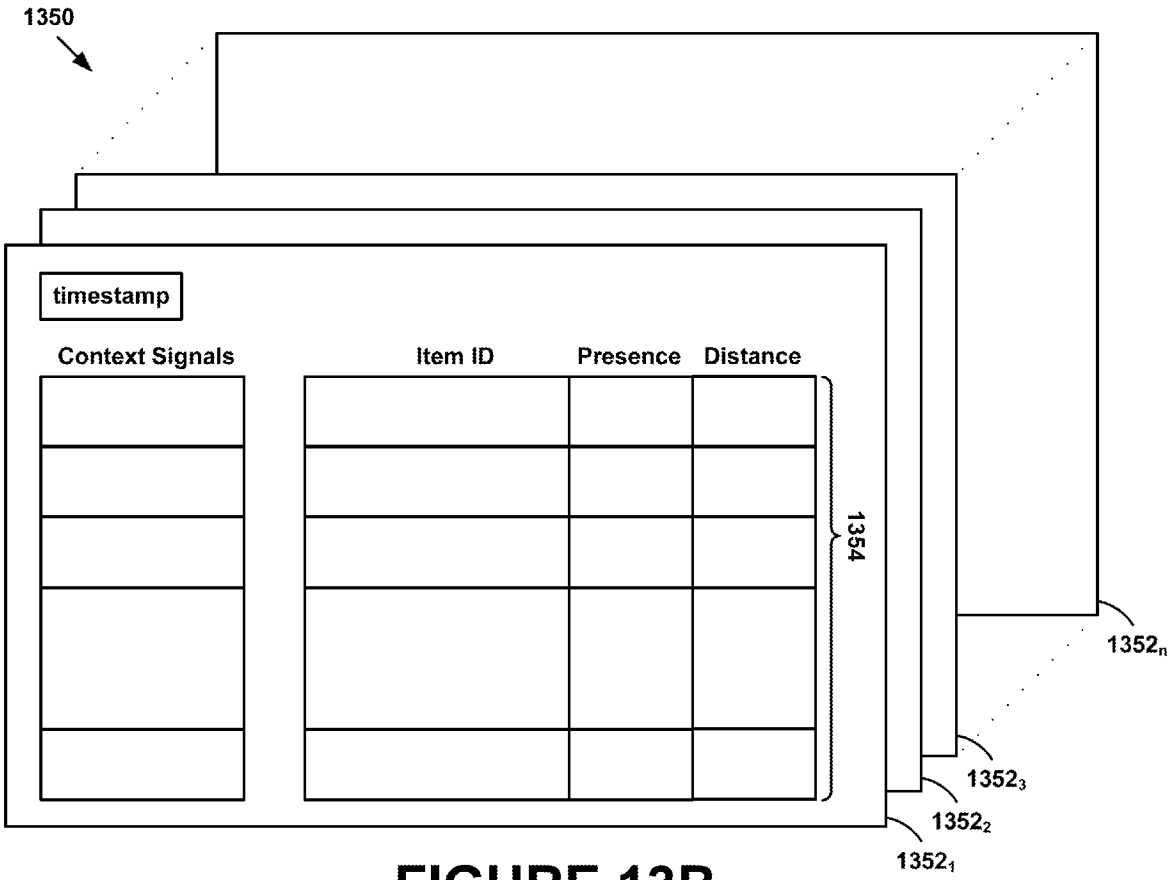
FIG. 13B is another illustration of snapshots in a historical context database, according to an example embodiment.

FIG. 13B is another illustration of snapshots in a historical user-context database, according to an example embodiment. The snapshots $\mathbf{1352}_1$-$\mathbf{1352}_n$ in historical user-context database 1350 may be generated, at least in part, using an example method such as that illustrated by FIG. 12C. Taking snapshot $\mathbf{1352}_1$ as a representative example of snapshots $\mathbf{1352}_1$-$\mathbf{1352}_n$, each snapshot is similar to the snapshots in FIG. 13A, except that the item-presence information each snapshot further includes an indication of distance 1354, which indicates the distance between the monitoring device and the item.

Generating Historical User-Context Data Based on User Instructions

As noted in various examples above, a monitoring device may provide a user-interface that allows the user access to functions such as: (i) defining proximity frameworks and user-contexts, (ii) associating the defined proximity frameworks and/or user-contexts with one another and/or with proximity frameworks and user-contexts determined or suggested by the monitoring device, and/or (iii) providing context and/or proximity framework information which can be used by the monitoring device to create proximity frameworks, determine user-contexts, and associate certain proximity frameworks with certain user-contexts.

Figure 14:
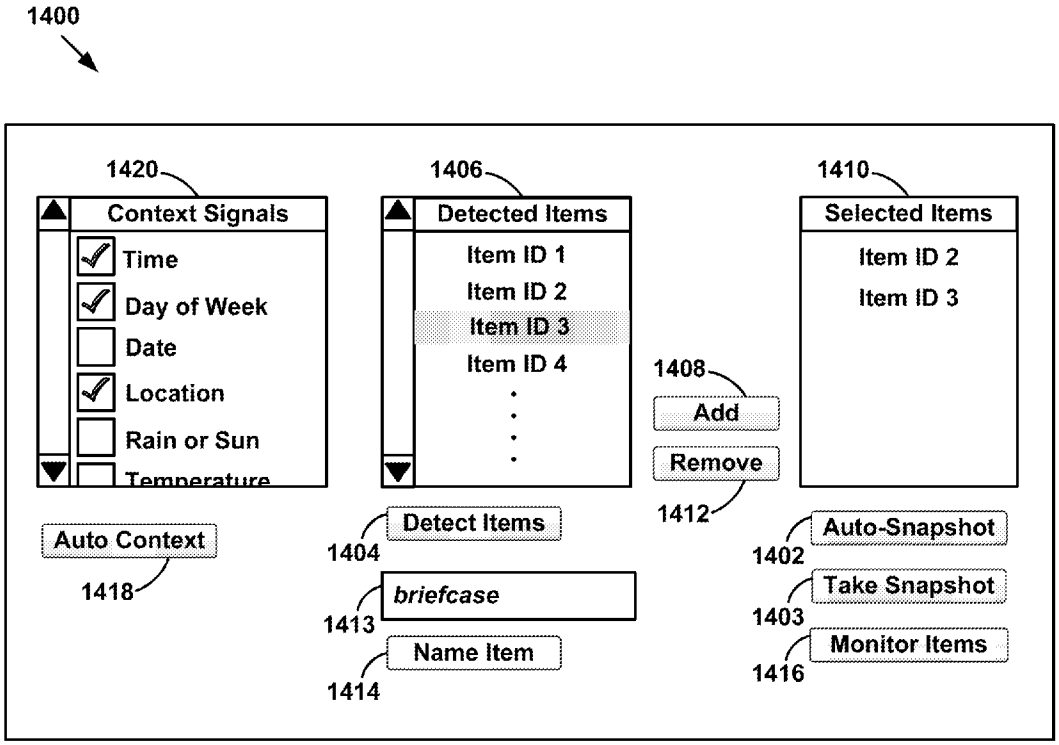
FIG. 14 is an illustration of a user-interface that may be provided by a monitoring device, according to an example embodiment.

FIG. 14 is an illustration of a user-interface that may be provided by a monitoring device, according to an example embodiment. The user-interface 1400 may provide a simple mechanism for taking a snapshot of context and item-presence at a given point in time. For instance, when the "Auto Snapshot" button 1402 is pressed, the monitoring device may automatically detect any items from which presence signals are available, determine all possible context signals, and perform a single iteration of method 1210 or method 1220 to create a snapshot identifying all detected items and all determined context signals.

User-interface 1400 may also provide a user with a greater level of control over the snapshot that is generated. For example, the Detect Items button 1404 may allow the user to search for present items, before taking a snapshot. Thus, in response to a press of the Detect Items button 1404, the user-interface may display a list of the IDs for items from which a presence signal is detected (e.g., the RFID or other unique ID), in the Detected Items box 1406. The user-interface further allows for the creation of a list of items that will be included in the snapshot. In particular, a user may select items in the Detected Items box 1406, and click the Add button 1408 to add the selected items to the Selected Items box 1410. As shown, selected items may also be removed by clicking the Remove button 1412. Provided with this functionality, a user may customize the list of items that will be included in a snapshot.

User-interface 1400 may also allow a user to specify which context signals to include in a snapshot or to request that context signals automatically be determined. In particular, the user may click on the "Auto Context" button 1418 in order to request that the monitoring device determine all available context signals. On the other hand, Context Signal box 1420 provides check boxes for selecting which context signals should be associated with the selected items in a snapshot. As shown, a user has selected the "Time," "Day of Week," and "Location" context signals. Accordingly, if the user clicks the "Take Snapshot" button 1403, a snapshot will be created that includes: (a) a user-context including the current time, the day of the week, and the current location and (b) item-information indicating that Item ID 2 and Item ID 3 were detected in association with this user-context.

In a further aspect, user-interface 1400 may provide an option for a user to create custom names for items. To do so, the user may select an item from Detected Items box 1406 (or possibly from Selected Items box 1410), enter text describing the item in form 1413, and then click the "Name Item" button 1414. For example, as shown, the user has highlighted Item ID 3 in the Detected Items box 1406, and entered the text "briefcase" in form 1413. Accordingly, clicking the Name Item button 1414 creates a record associating Item ID 3 with the name "briefcase" when a snapshot is created. This name may then be applied whenever Item ID 3 is detected in the future.

The monitoring device may also analyze the presence signals from detected items, so that the detected items can be displayed in Detected Items box 1406 in a more intelligible manner. For example, monitoring device may determine the type of item or a common name for the item (e.g., "briefcase"), and display the common name rather than the item ID. This may make it easier for the user to determine which detected item is which. The type or common name of an item may be determined in various ways. For example, the type may be encoded in the presence signal as described herein, and as such, the monitoring device may decode the presence signal to determine the type or common name for a detected item. Alternatively, the monitoring device may query a monitoring support system for the type or common name. To support such an embodiment, a monitoring support system may include or have access to an item-information database from which an item type or name can be looked up using an item ID. Other examples are also possible.

In another aspect, user-interface 1400 may allow a user to initiate the monitoring of items. In particular, a "Monitor Items" button 1416 may be provided. When a user clicks on the Monitor Items button 1416, the monitoring device may responsively implement a proximity framework that: (a) requires that a presence signal be detected from each item in the Selected Items box 1410, and (b) initiates a notification process if any one of the presence signals from the items in Selected Items box 1410 is not detected. Further, when the user clicks on the Monitor Items button 1416, a snapshot may also be stored. Yet further, if a snapshot is stored, the snapshot may be marked with data identifying this snapshot as being associated with a user-context and items that the user explicitly chose to monitor. Marking the snapshot may allow the monitoring device to place a greater weight on this snapshot when evaluating historical user-context data, which may be desirable since the snapshot corresponds to items that were explicitly selected for monitoring in the given user-context.

Learning from Historical User-Context Data

An example monitoring device may employ various techniques, which rely at least in part upon historical user-context data such as that illustrated by tables 1300 and 1350, to intelligently determine which user-contexts to associate with which proximity frameworks. For example, the monitoring device may define a proximity framework for a certain item or items when the items and a certain set of context signals are both observed at same time in at least a threshold number of instances. As another example, the monitoring device may define a proximity framework for a certain item or items when the items are observed in at least a predetermined percentage of instances where a certain set of context signals is also observed. Other examples are also possible.

In the above examples, the monitoring device defined and recognized user-context as groups of certain context signals. For example, the context signals for the time of day, the day of the week and the location might directly define a context; e.g., "8:00 am on a Wednesday at the user's home." However, an example embodiment may also involve more dynamic user-contexts, which are derived from context signals and possibly other information. For example, the monitoring device may learn that when the user is at home at 8:00 am on a weekday, the user is typically "getting ready for work." Accordingly, the user-context "getting ready for work" may be derived from time of day, day of week, and location context signals that indicate that it is 8:00 am on a Wednesday and the user is located at home.

The monitoring device may employ a number of different techniques in order to learn more-specific user-contexts, which go beyond the determined context signals. For example, the monitoring device may apply labeled learning techniques that make use of information indicating the differences between a number of different user-contexts. In some embodiments, the differentiating information for labeled learning may be provided by the user.

For example, if the user indicates at certain times that a first user-context exists, and at other times that a second user-context exists, then the monitoring device can record whatever context signals are available to it at each time (e.g., values from the sensors such as a light sensor, a sound sensor, and an accelerometer, and/or the time of day, day of week, week of month, month, date, location, temperature, weather forecast, etc.). The monitoring device may then apply a machine-learning process to the recorded data in order to learn to discriminate between the first user-context and second user-context automatically. To do so, the monitoring device may apply any well-known machine-learning process such as an artificial neural network (ANN) or a Decision Tree, for instance. After performing such a machine-learning process, the monitoring device may then be able to conclude from certain context signal values that the first or second context exists. It should be understood that while this process is described with reference to only two contexts, those skilled in the art will understand that it can be readily adapted to learn many contexts.

In a further aspect, it is also possible that an example monitoring device may implement a machine-learning process that does not rely on user-provided feedback. For example, the monitoring device may employ any number of well-known clustering techniques to evaluate historical user-context data, and identify groups of context signals (and possibly groups of items as well) in a "natural" or "reasonable" way. These clustering techniques are well-known in the art and thus the application of clustering techniques to historical user-context data, and in particular to context-signal and item-presence data, is not described further herein.

In yet a further aspect, once the monitoring device has learned that certain items and a certain user-context are typically associated with one another, it may prompt the user to provide any additional information needed to create a proximity framework for the items. For example, if certain context signals are determined to be associated a group of items, the monitoring device may inform the user that the monitoring device has noticed a trend of certain items being detected in a certain context. A user-interface may then be provided that allows the user to confirm that a proximity framework for the items should be associated with the identified user-context. This user-interface may be similar in form to the user interface illustrated in FIG. 3B, or may take any other appropriate form. Further, the user-interface may allow the user to associate certain notification requirements with proximity requirements for certain items. Yet further, the user-interface may allow the user to adjust suggested details or provide further details for the proximity requirements within the framework. For instance, the monitoring device might suggest that the presence signal from an item be monitored, and the user might add a distance requirement for the item. Other examples are also possible.

As a general matter, it should be understood that an example embodiment may involve continual learning and updating of associations between user-contexts and proximity frameworks, based on information observed over time and/or user-provided feedback. As such, the landscape of which proximity frameworks are applied in which user-contexts may continually evolve as more information is acquired by the monitoring device. Furthermore, it should be understood that dynamic learning and generation of context and proximity framework relationships may be applicable in all embodiments of the invention.

Use of Learned Item and User-Context Associations to Initiate Monitoring

Figure 15:
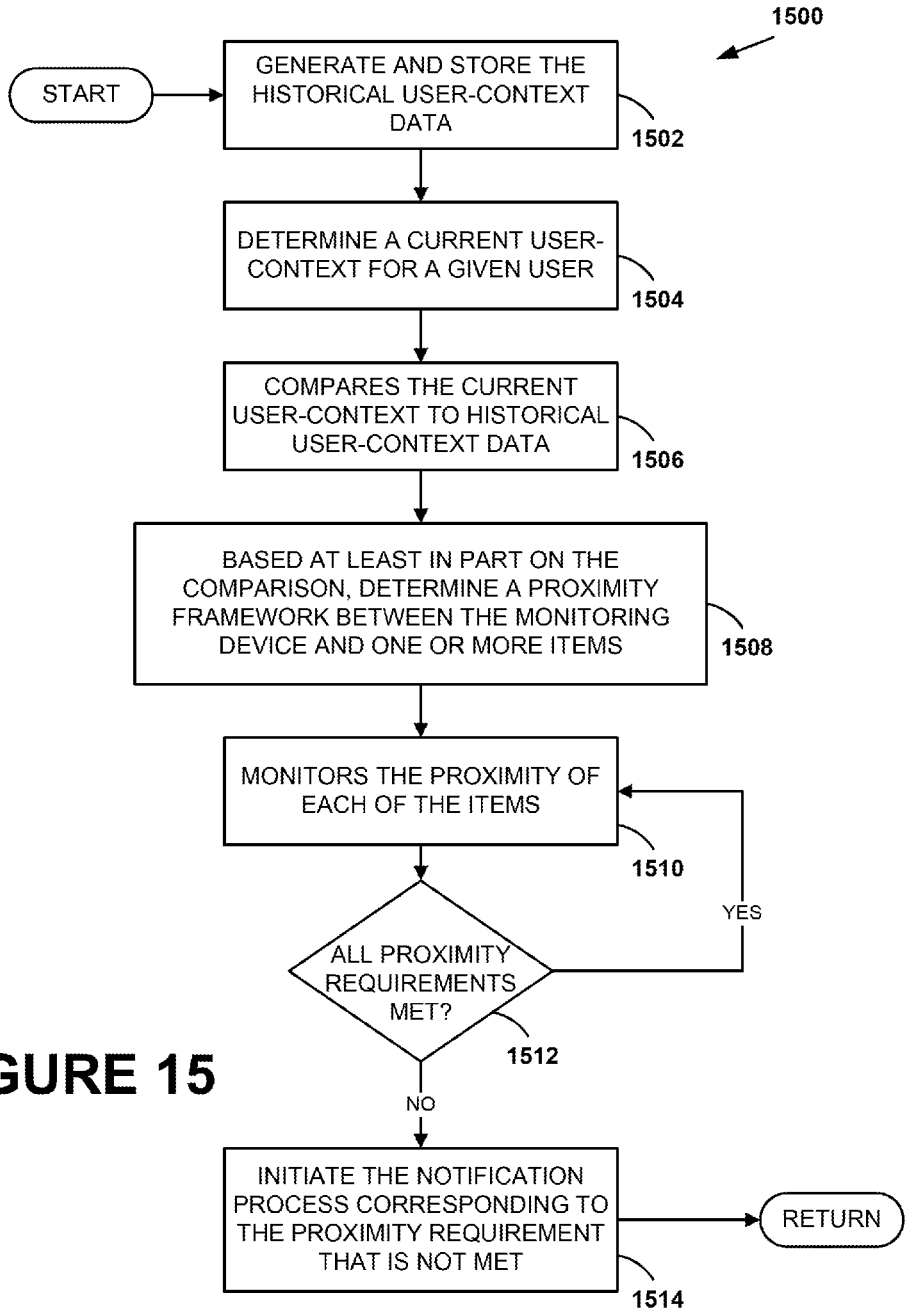
FIG. 15 is a flow chart illustrating a method for determining a proximity framework based on a comparison of a current context to a historical context, according to an example embodiment.

Once user-context and item associations have been learned, an example device may be configured to keep track of the current user-context and implement any proximity framework that has been associated with the current user-context. For example, FIG. 15 is a flow chart illustrating a method for determining a proximity framework based on a comparison of a current context to a historical context, according to an example embodiment. In particular, method 1500 involves a monitoring device generating and storing the historical user-context data, as shown by block 1502. The historical user-context data typically includes data for context signals and item-proximity, and may be generated, at least in part, using methodology such as that described herein.

At some time after the historical user-context database for the user has been sufficiently populated, the monitoring device may determine a current user-context for a given user, as shown by block 1504. The monitoring device then compares the current user-context to historical user-context data, as shown by block 1506. Then, based at least in part on the comparison, the monitoring device determines a proximity framework between the monitoring device and one or more items, as shown by block 1508. The monitoring device then monitors the proximity of each of the items, in order to determine when one of the proximity requirements is not met, as shown by blocks 1510-1512. When the monitoring device determines that one of the proximity requirements is not met, it initiates the notification process corresponding to that proximity requirement, as shown by block 1514.

The comparison of the current user-context to historical user-context may be accomplished using various techniques. For example, the monitoring device may receive currently-available context signals, and then determine what items were usually present at times in the past when substantially the same context signals were received. Based on this comparison, the monitoring device may conclude or at least suggest to the user that the same items should be detected currently. Accordingly, the monitoring device may implement or prompt the user to confirm implementation of a proximity framework for these items.

Example Monitoring-Support System

Figure 16:
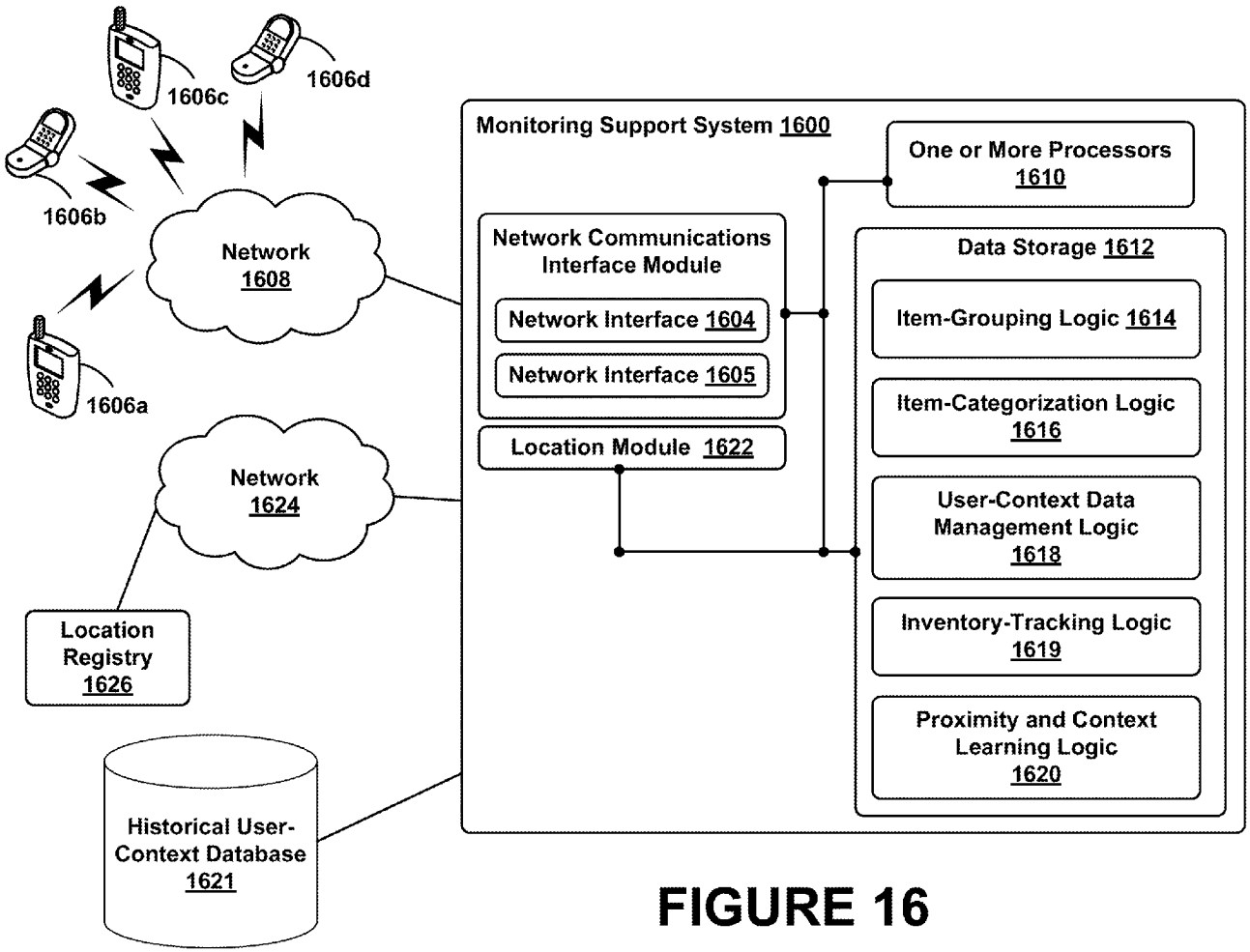
FIG. 16 is block diagram illustrating a monitoring-support system according to an example embodiment.

While monitoring devices have primarily been described herein as stand-alone devices, an example monitoring device may also be supported by a central monitoring-support system, which supports a network of monitoring devices. FIG. 16 is block diagram illustrating a monitoring-support system according to an example embodiment. As shown, monitoring-support system 1600 includes a network communications module with one or more network interfaces 1604, 1605. Network communications module facilitates communicating with monitoring devices 1606*a*-1606*d* via a network 1608. Further, while only two network interfaces are shown, it is possible that the monitoring-support system may have more or less network interfaces. In some embodiments, additional network interfaces may be provided so that the monitoring-support system can communicate with monitoring devices via a number of different types of networks. This may allow the monitoring-support system to support, and to collect context and proximity-framework information from, different types of monitoring devices, which may not be configured to communicate under the same communication protocol.

In a further aspect, monitoring support system 1600 also includes a location module 1622. The location module may use the network communications module to communicate, via network 1624, with location registry 1626. Configured as such, the location module 1622 queries the location registry 1626 for the locations of monitoring devices 1606*a*-1606*d*. Location registry 1626 may take various forms. For example, the location registry 1626 may take the form of a home location register (HLR) and/or visitor location register (VLR) in a radio access network. Other forms are also possible. It is also possible that the location module 1622 may be configured to communicate with a number of different location registries and/or location registries of different types.

As shown, the monitoring-support system 1600 also includes data storage 1612 and one or more processors 1610. The data storage includes program instructions that are executable by processor 1610 to carry out the functions of the monitoring-support system described herein. In particular, data storage 1612 includes item-grouping logic 1614, item-categorization logic 1616, user-context data management logic 1618, inventory-tracking logic 1619, and context-item relationship logic 1620.

The user-context data management logic 1618 allows the monitoring-support system to acquire, store, organize, and or access historical user-context data from a large number of monitoring devices, such as monitoring devices 1606*a*-1606*d*. (Note that this is not necessarily meant to imply that four is a "large" number of monitoring devices. It is possible that a monitoring-support device may coordinate information from hundreds, thousands, or even more monitoring devices.) For example, monitoring-support system 1600 may receive snapshots of item-presence and context at given points in time from monitoring devices 1606*a*-1606*d*. These snapshots may be generated by monitoring devices 1606*a*-1606*d* using any appropriate method. Accordingly, the received context and item-presence data may be stored in historical user-context database 1620.

Historical user-context database 1621 thus serves as a centralized source of context and item-presence data. The data may be represented as snapshots of context signals and detected items that co-existed at a given monitoring device at a given time (or over a given time period). Thus, historical user-context database 1621 may be visualized in a similar manner as shown in FIG. 13A and/or FIG. 13B, except that the snapshots stored in historical user-context database 1620 may further be categorized by the monitoring device from which they were received. Alternatively, historical user-context database 1621 may not track the source monitoring devices for the stored data. Further, the form and content of historical user-context database 1620 may vary in other ways without departing from the scope of the invention.

As one example, data in historical user-context database 1621 may additionally or alternatively be categorized by user. To facilitate this organization, monitoring devices 1606*a*-1606*d* may include a unique ID of the user, which may differ from the unique ID of the device. As such, the monitoring-support system can retrieve data from all monitoring devices associated with a given user in order to evaluate the data on a per-user basis.

The item-grouping logic 1614 allows the monitoring-support system 1602 to evaluate data from historical user-context database 1621 and identify groups of items that are commonly detected together. Further, groups of items may be identified based on data from all monitoring devices, based on a subset of the monitoring devices (e.g., all mobile phones, or all laptops), or on a per-monitoring-device basis. Additionally or alternatively, groups of items may be identified across all users, for a subset of users, or on a per-user basis. These item-groups may then be provided to the appropriate monitoring devices to facilitate functionality such as the example method of FIG. 9 and variations thereon.

The item-categorization logic 1616 allows the monitoring-support system 1600 to evaluate data from historical user-context database 1621 and identify groups of items that are commonly detected together. These item-categories may then be provided to various monitoring devices to facilitate functionality such as the example method of FIG. 10 and variations thereon.

More specifically, in order to more intelligently provide item-category functionality, monitoring devices may be configured to share item-category data with monitoring-support system 1600. The monitoring-support system 1600 may then update historical user-context database 1621 with the provided item-category data. The historical user-context database 1621 therefore provides a centralized pool of item-category information.

As such, an example monitoring device may communicate with the monitoring-support system 1600 to take advantage of its collective knowledge of item-categories. For example, a monitoring device might query the support system to request item categories associated with a given user-context. As another example, a monitoring device might query the support system to learn of any item-category or item-categories that are associated with a particular item or group of items. The monitoring device may then use the item-category information provided by the support system to update item categories associated with the user of the device, to define proximity requirements for item-categories, to determine which notification processes should be associated with the proximity requirements for the item-categories, and/or to associate certain contexts with proximity frameworks that include proximity requirements for item-categories, among other possible functions.

The inventory-tracking logic 1619 allows the monitoring-support system 1600 to evaluate data from historical user-context database 1621 and to coordinate inventory tracking across multiple devices and possibly across multiple users. Accordingly, inventory-tracking logic 1619 may be used to support monitoring devices in functions of example inventory-tracking methods, such as the method of FIG. 11 and variations thereon.

The context-item relationship logic 1620 allows the monitoring-support system 1602 to evaluate data from historical user-context database 1621 and intelligently generate: (i) suggested groupings for items, (ii) suggested item-categories, (iii) suggested proximity requirements (and possibly full proximity frameworks including both proximity requirements and corresponding notification processes), (iv) suggested associations between certain items and certain user-contexts, (v) suggested associations between certain proximity requirements and certain context-signals, and/or (vi) suggested associations between certain proximity frameworks and certain context-signals. Other types of suggestions may also be generated. Further, such suggestions may be based on data from a single user, data from a subset of users (e.g., all users having the same profession, or having other shared characteristics), or data from all users. Yet further, the suggestions may be designed to be relevant to one specific user (e.g., by incorporating information and/or preferences that are specific to that user), to a subset of users, or may be created generically so as to be relevant to all users.

In order to generate suggestions, context-item relationship logic 1620 may include methods such as those described in FIGS. 12A-12C, except that the monitoring-support system 1600 may use the pooled user-context data from a number of users, which is available from historical user-context database 1621, in order to perform such methods. Further, the monitoring-support device may apply the machine-learning techniques described herein to the pooled user-context data in order to generate suggestions that may be provided to various monitoring devices.

Example Peer-to-Peer Monitoring Device Network and Methods

In a further aspect, a peer-to-peer network of monitoring devices may be established via monitoring-support system 1600. In particular, monitoring devices may share locally learned or user-defined item-groups, locally learned or user-defined item-categories, locally learned or user-defined associations between items and proximity, etc. with other monitoring devices via monitoring-support system 1600.

Peer-to-Peer Lost and Found Network

In a further aspect, a monitoring-support system such as that illustrated in FIG. 16 may be configured to support a peer-to-peer lost and found system. In particular, monitoring devices may report a "lost" item to the monitoring-support system upon determining that a proximity requirement is not met for the item. Further, monitoring devices may also determine whether a detected item is associated with the user of the device, and if not, report the item as "found" to monitoring-support system.

Figure 17:
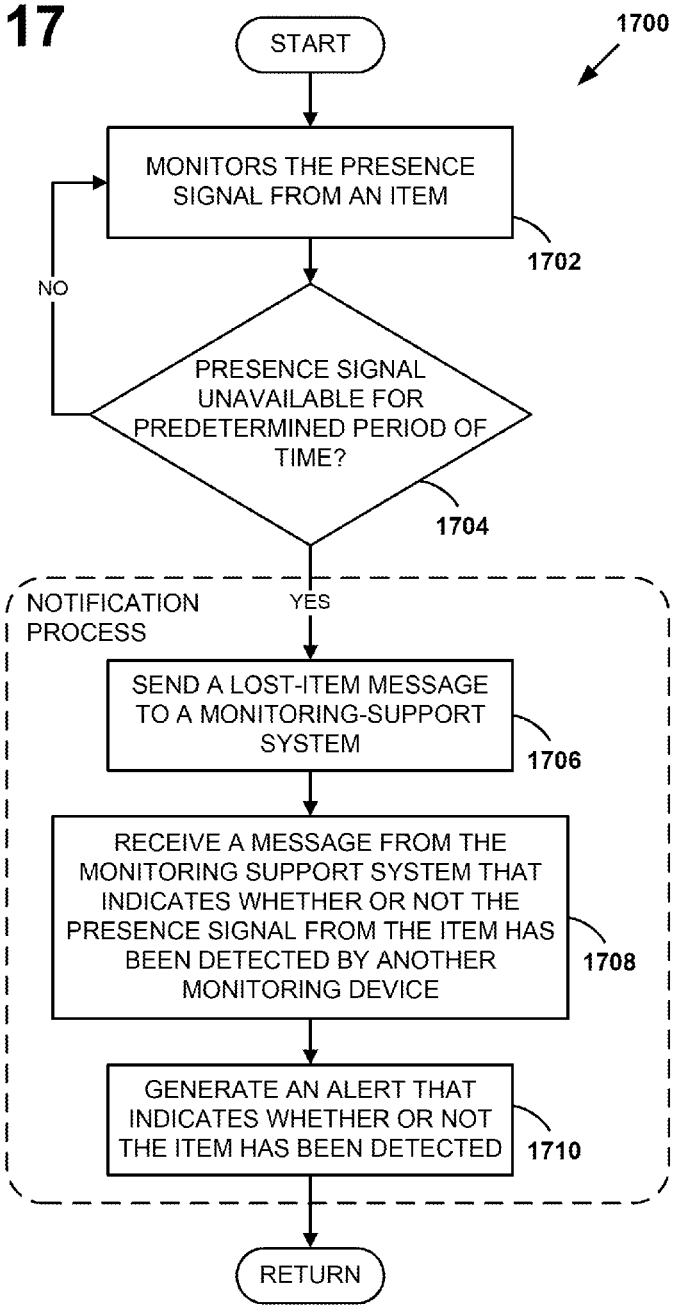
FIG. 17 is a flow chart illustrating a method carried out by monitoring device with lost-and-found functionality, according to an example embodiment.

FIG. 17 is a flow chart illustrating a method carried out by monitoring device with lost-and-found functionality, according to an example embodiment. In particular, method 1700 involves a monitoring device monitoring a presence signal from an item, as shown by block 1702, and detecting when the presence signal is unavailable for a predetermined period of time, as shown by block 1704. Responsive to detecting that the presence signal is unavailable, the monitoring device initiates the notification process that corresponds to the proximity requirement for the item. As shown, the notification process involves the monitoring device sending a lost-item message to a monitoring-support system, as shown by block 1706. In response, the monitoring device then receive a message from the monitoring support system that indicates whether or not the presence signal from the item has been detected by another monitoring device, as shown by block 1708. The monitoring device then generates an alert that indicates whether or not the item has been detected by another monitoring device, as shown by block 1710.

Figure 18:
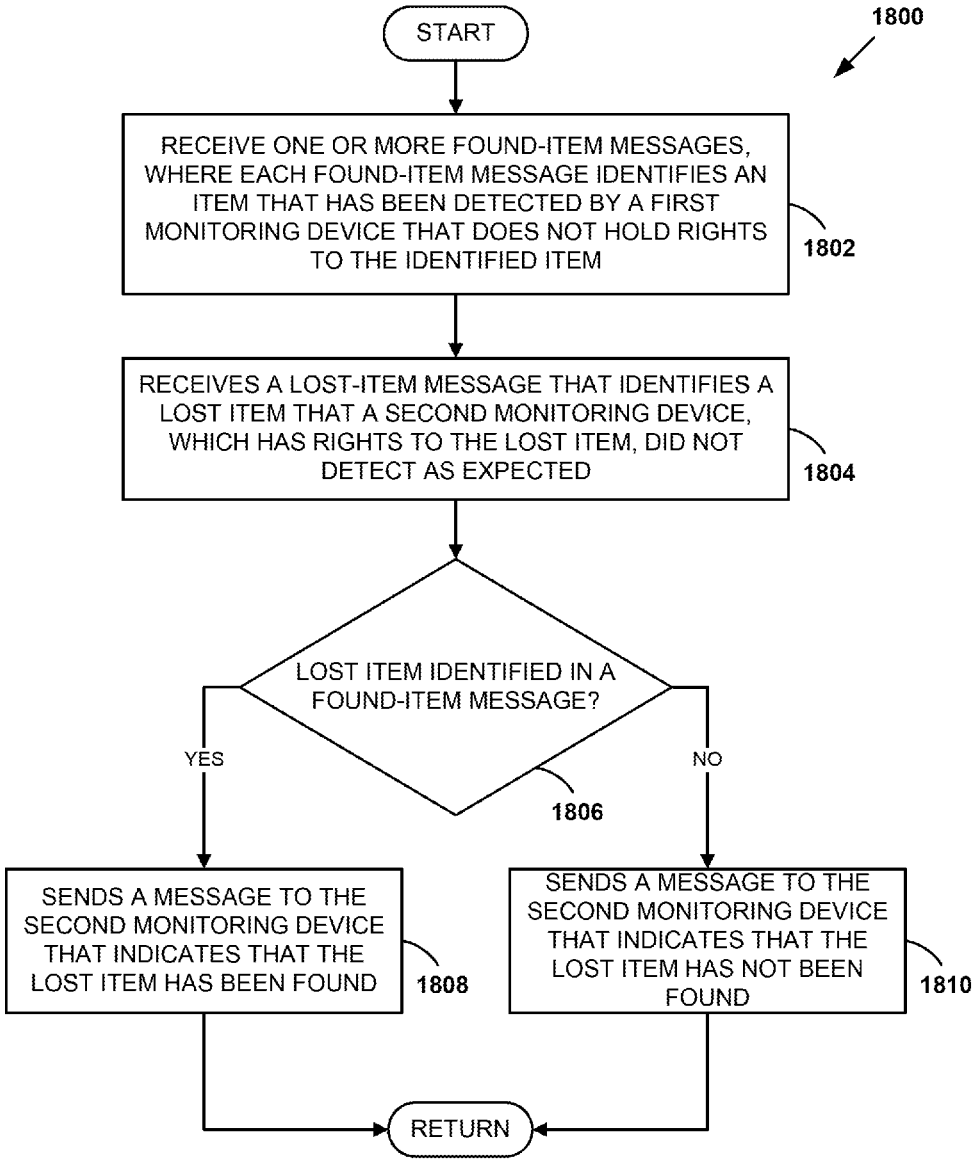
FIG. 18 is flow chart illustrating a method that may be carried out by a monitoring-support system to facilitate a lost-and-found service, according to an example embodiment.

FIG. 18 is flow chart illustrating a method that may be carried out by a monitoring-support system to facilitate a lost-and-found service, according to an example embodiment. In particular, method 1800 involves a monitoring-support system receiving one or more found-item messages, where each found-item message identifies an item that has been detected by a first monitoring device that does not hold rights to the identified item, as shown by block 1802. The monitoring-support system also receives a lost-item message that identifies a lost item that a second monitoring device, which has rights to the lost item, did not detect as expected, as shown by block 1804. In response, the monitoring-support system determines whether or not the lost item has been identified in one of the received found-item messages, as shown by block 1806. If the monitoring-support system determines that the lost item has been identified in a found-item message, then it sends a message to the second monitoring device that indicates that the lost item has been found, as shown by block 1808. On the other hand, if the lost item has not been identified in a found-item message, then the monitoring-support system sends a message to the second monitoring device that indicates that the lost item has not been found, as shown by block 1810.

In some embodiments, additional information may be provided in a message indicating that a lost item has been found. For example, the message may include the device location, context information or other information relating to the device that detected the lost item, contact information for that device's associated user (if that user has authorized use of such information), and/or other types of information.

In a further aspect, the user may be provided with options to take one or more actions in response to a message indicating that the lost item has been found. For example, if the lost item is a device that can be locked and/or can have some or all if of its memory deleted, such as mobile phone or a laptop computer for instance, the user may be provided with an option to lock and/or erase data from the lost device. Alternatively, the user-context of the locating device may be evaluated by the monitoring-support system, which may lock and/or erase data from the lost device, depending upon the user-context. For example, if the monitoring-support system determines that the lost device is located in a public and/or unsafe place (e.g., a bench in a park, or the back seat of a taxi cab), then the monitoring-support system may automatically lock and/or erase data from the lost device. On the other hand, if the monitoring-support system determines that the lost device is located in a safe place (e.g., the user's home), then the monitoring-support system may refrain from taking such actions.

In some embodiments, a monitoring-support server may allow a user to set up a network of trusted devices. When an item is not detected as expected by a given monitoring device, but is detected by a trusted device of that monitoring device then the monitoring-support system may respond in various different ways. For example, the monitoring-support system may treat detection of a monitored item by the trusted device as equivalent to detection by the given monitoring device. Alternatively, when a given monitoring device does not detect an item but a trusted device does, the monitoring-support system may notify the monitoring device that the trusted device has detected the item (and further may provide options to ignore the notification or contact the user associated with the trusted device).

In an embodiment where the monitoring-support server supports lost-and-found functionality, an alert for a lost item may be dependent, at least in part, on whether the item is found by a trusted device. For example, a mobile phone may be set up to monitor a user's laptop. However, while the mobile phone is monitoring the laptop, the user may leave the laptop at work, and a trusted device at the user's office may detect the laptop. Since the trusted device detected the laptop, the monitoring-support system may refrain from notifying the user, or notify the user in a less urgent manner.

In a further aspect, notification (or lack thereof) may vary between trusted devices. For example, because user may need their laptop for work, a user may be notified when they forget their laptop at home, even if the laptop is detected by a trusted device at the user's home.

Notification when a trusted device detects an item may also vary depending on context. For instance, in a context where a user's need for the item is greater, the user may be notified about a forgotten item, even when the item is detected by a trusted device. However, in a context where the need for the same item is lesser, notification may be canceled upon detection of the item by the same trusted device.

Yet further, whether or not detection by a trusted device alleviates the need for an alert may vary from item to item. For instance, detection of an item by a trusted device might be considered sufficient for some less valuable items (e.g., a beach towel or cheap sunglasses), but not for more valuable items (e.g., a user's wallet or expensive sunglasses). Further, such different treatment of certain items may apply in all contexts or just in certain contexts. Yet further, different treatment of certain items may apply to all trusted devices or to specific devices.

Example Communication Technologies

The above-described embodiments generally involve the function of a monitoring device detecting the presence and/or distance to an item. Several of the example communication technologies that may be used to implement this functionality will now be described in greater detail below. It should be understood that the below communication technologies represent only a subset of the potential applicable communication technologies. Accordingly, the list below should not be interpreted as limiting the scope of the invention.

Example Approaches for Sensing Presence Signals from Items

In some embodiments, the Radio Frequency Identification protocol (RFID) may be used to associate items with the monitoring device. The RFID protocol is an electromagnetic communication protocol based on a combination of several ISO/IEC standards, most notably ISO 14223, ISO/IEC 18000, ISO/IEC 15693, ISO/IEC 18092, ISO/IEC 18092, ISO/IEC 21481, and ISO/IEC 14443. RFID devices typically operate in one of several possible frequency bands. The most widely used RFID bands are 125-134.2 kilohertz (kHz), 140-148.5 kHz, 13.56 megahertz (Mhz), 433 MHz, 868-928 MHz and 2.4 gigahertz (GHz). Other frequency bands may also be used for RFID. The typical range of an RFID device can be as small as a few millimeters and as long as 100 meters. An RFID tag can be small approximately a square centimeter or smaller. Additionally, RFID tags can be low cost where several RFID tags may be purchased for a dollar. An RFID tag may be attached to an adhesive and appear to be a common sticker. In one embodiment, target items may be any item that has had an RFID tag attached with a sticker. For example, items in a store may have a bar code sticker with integrated RFID. In an additional embodiment, a person may place RFID enabled stickers on a plurality of items to be monitored.

The two typical means of electromagnetic energy transmission used in an RFID system are either magnetic field induction or electric field induction. At lower frequencies and at shorter distances, a magnetic field may be used to couple energy from one device to the other. For magnetic coupling, typically each device will have a loop antenna. When the two loops are located in a close proximity to each other, they form an air-core transformer where the energy in one loop couples to the second loop. For electric field induction, an antenna is used to either generate or receive an electric field. Typically, electric fields (an antennas) will be used for distances greater than 10 centimeters.

An RFID device can operate in either a passive mode or an active mode. In the passive mode, a monitoring device may provide an electromagnetic field (also known as an RF field or a magnetic field) and upon receiving the field, the target item will modulate the existing field. A reflected signal having an induced modulation is known as modulated backscatter. The monitoring device may be able to detect this modulated backscatter field. The passive target item does not generate its own fields under its own power. Additionally, the target item may be able to rectify some of the field transferred to power itself. For example, the RF field may be used to charge a capacitor in the target item.

In some example embodiments, a passive target item may have a load attached to its loop antenna via a switch; this load can be selectively coupled to the antenna to dynamically change the antenna impedance. By used some power stored in the capacitor, this load may be switched to connect to the antenna or disconnect from the antenna. By changing the impedance of the antenna in the presence of an electrometric field, a modulation can be introduced into the field. This modulation of the electromagnetic field could be detected by the monitoring device as the presence signal.

Additionally, RFID can be used in an active system. In contrast to the passive system, in an active RFID system the monitoring device and the target item each generate their own electromagnetic field usually with an addition of a power supply in the target item. The field generated by the target item may be the presence signal detected by the monitoring device. The loop antenna system for an active device may be the same loop antenna as found on the passive system. The only significant difference is that an active system requires some type of power supply. In more advanced active systems, a processor in the RFID may be able to process data to create an output signal. The power requirements for an active RFID system are usually significantly higher than for a passive system.

In some embodiments, the Near Field Communication protocol (NFC) may be used to associate items with the monitoring device. The NFC protocol may also be backward compatible with RFID. In some instances, NFC may be considered a subset of RFID. The NFC protocol is based on a combination of several ISO/IEC standards, most notably ISO/IEC 18092, ISO/IEC 18092, ISO/IEC 21481, and ISO/IEC 14443. The NFC protocol can provide both a low data rate and low power communication at short distances. In a typical embodiment, an NFC device will operate a frequency of 13.56 MHz in the unlicensed ISM radio band, and support data rates up to 848 kilobits per second. The typical range of an NFC device is approximately 20 centimeters and the typical means of transmission used in an NFC system is magnetic field induction. Each device will typically have a loop antenna. When the two loops are located in a close proximity to each other, they form an air-core transformer where the energy in one loop couples to the second loop. Similar to RFID, an NFC device can operate in either a passive mode or an active mode. Additionally, the presence signal detected by the monitoring device in an NFC system may be similar to the presence signal in an RFID system. In the case of a passive NFC tag, the presence signal may be an RF field modulated by the NFC tag. In an active system, the NFC tag may create the presence signal detected the monitoring device.

The IEEE 802.11 protocol (commonly referred to as Wi-Fi) may be used for sensing and/or communication. There are many different subsets of the 802.11 technologies; the current system is not limited to any specific iteration of 802.11. In some embodiments, a high data speed provided by 802.11n could be advantageous, but other embodiments may use 802.11b. In additional embodiments, the specific 802.11 technology selected may depend on the desired frequency band, either 2.4 GHz or 5 GHz. In some embodiments, the presence signal may be the IEEE 802.11 signal sent from a target item to the monitoring device.

The Bluetooth protocol (IEEE 802.15.1) may be used for sensing and communication as well. Bluetooth is part of the IEEE 802.15 family of Wireless Personal Area Networks (WPAN), any of which may be used as the sensing and communication means in the disclosed embodiments. The different iterations of 802.15 include different technologies to allow WPAN networks to coexist with other devices operating on the same frequency bands. In some embodiments it may be desirable to implement some of the associated 802.15 technologies. For the various IEEE 802.15 technologies, the presence signal may the radio signal generated by the target device. The monitoring device may receive the presence signal from the target device.

An additional wireless protocol, RuBee (IEEE P1902.1), may be used for sensing and communication. Similar to some forms of RFID, RuBee operates in a relatively low frequency band (131 kHz or 450 kHz, typically) and uses very low power. The main difference between RuBee and RFID is the signaling mode. RFID typically uses backscatter to communicate data. The signaling mode of RuBee is much more similar to the peer to peer type signal found in either Wifi (802.11) or Bluetooth (802.15.1). RuBee tags are typically active, containing internal power supplies. In some embodiments, a single button battery may have a 15 year lifespan in a RuBee device.

Due to the low frequency of operation, a RuBee tag does not radiate a significant amount of energy as radio waves. An antenna, inductor, or other electrical detector may detect the energy stored in the magnetic field. The energy stored in the magnetic field may be the presence signal detected by the monitoring device. A RuBee tag will store a majority of the energy as a near field magnetic field. In some embodiments, a RuBee tag reader may be a very large loop of wire. For example, a home may have a large loop wire around it in order to monitor a plurality of target items. In some embodiments, on detector loop may be able to monitor several hundred individual RuBee tags at one time. Thus, a large inventory of items may be simultaneously monitored. Additionally, since a majority of the energy in a RuBee signal is stored in a magnetic field, the system is less susceptible to interference caused by environmental changes. For example, if a tag is buried in mud, a radio wave may propagate poorly, but the magnetic field would still be able to exist.

In some embodiments, sensing and communication is performed with an optical system. The optical system may include a bar code scanner, where every target item has a unique bar code. In other embodiments, the optical system may include optical sensors on the target item as well. There could be a two-way communication link between the target item and the monitoring device to verify the specific target item. In a two way system, the target item may include its own optical generation source. In some embodiments, where line-of-sight-sensing is desired, optical sensing may be beneficial.

In some embodiments, the optical signal may be visible light. In additional embodiment, the optical signal may be light not visible to the human eye, for example ultraviolet light or infrared light. The presence signal may take at least one of two forms in an optical system. In one embodiment, like the barcode example, the presence signal may be light reflected from the target object. In another embodiment, the target object may generate its own light, the generated light being the presence signal.

Additionally, it may desirable for the monitoring device and target items to have acoustic communication or sensing. For example, target items may have a speaker the can produce a sound the monitoring device can detect. If the sound is not detected, the target item may be considered out of range of the monitoring device. The sound produced may be audible to humans or it may be ultrasound (a frequency higher than human audible range). Each target item may have its own sound signature unique to that specific to itself.

The presence signal may take at least one of two forms in an acoustic system. In one embodiment, the presence signal may be sound reflected from the target object. This reflected sound may be known as an echo. In another embodiment, the monitoring device may transmit a unique acoustic signal and a target device may recognize the signal and respond with its own generated acoustic signal. In the active system, the presence signal may be the sound generated by the target item.

The above-described are not meant to be limiting, and are merely examples of different types of communication that can be used with some embodiments of the disclosed methods and apparatuses. For example, some embodiments may implement a form of digital watermarking, which may be encoded in any type of over-the-air signaling. The monitoring device and the target items may implement a form of challenge and response system to verify the identity of the target items. In other embodiments, the target items may be devices that merely transmit information about themselves and all processing occurs on the monitoring device. In still further embodiments, processing may occur on some or all of the target items.

Example Approaches for Location Determination

As described herein, some embodiments may involve a monitoring device determining its own location. Some example techniques for distance determination, which may be applied in the above-described examples, will now be described. However, it should generally be understood that distance determination may be accomplished in any manner, without departing from the scope of the invention.

In many embodiments, the monitoring device may have Global Positioning System (GPS) capabilities, which may allow the monitoring device to obtain its own location.

In other embodiments, the monitoring device may be able to determine relative position information based on known locations and signals received from the items, other monitoring devices, wireless base stations, or any other signal source (e.g., by applying triangulation or angle-of-arrival techniques for location determination).

Ambient Radio Frequency (RF) signals may also be used to determine position information. For example, in Fort Collins, Co, the National Institute of Standards and Technology operates very precise clocks that output the time on 60 kHz carrier wave as radio station WWVB. Additionally, station WWV broadcasts on 2.5, 5, 10, 15 and 20 MHz, also from near Fort Collins, Colo. The time signals from Colorado can be measured virtually anywhere in the United States. Both the WWVB and WWV broadcasts contain modulated data on the carrier signal. This modulated data may be useful to sync clocks in the target items and the monitoring device. Additionally, the modulated data on WWVB and WWV could be used to determine some position information.

Additionally, the target items and the monitoring device may contain additional sensors, such as accelerators, and gyroscopes to aid in positioning. An item or device may be able to communicate its movement to other devices and items, allowing location information to be updated. Additionally, in some embodiments, sensors may be able to detect items within a specific region. For example, a RuBee system may have a large loop antenna surrounding a specific room in a house. Any item in that specific room will be detected. When an object leaves the room, it will no longer be detected. Rather than a specific distance, detection occurs based on specific location.

In some embodiments, peer-to-peer coordination may be used to aid in determining position information. For, if a monitored item knows that it is near to another monitored item, it may relay an approximate position for the additional monitored items to the monitoring device.

In some embodiments, peer-to-peer coordination may be used to aid in determining position information. For, location information known by one of a user's monitoring devices may be shared with the user's other monitoring devices. In some embodiments, it also possible that location information for various items and/or devices may be shared between devices of different users, either directly or via a network.

Example Approaches for Distance Determination

As described herein, some embodiments may involve a monitoring device determining the distance between itself and an item and/or another monitoring device. Some example techniques for distance determination, which may be applied in the above-described examples, will now be described. However, it should generally be understood that distance determination may be accomplished in any manner, without departing from the scope of the invention.

In some embodiments both the monitoring device and the monitored item may have GPS capabilities, or be configured to respectively determine their own locations in another manner. In this case, the monitored item's presence signal may include an indication of its location. Alternatively, if the monitoring device and the monitored item are configured for communication on a common network (e.g., a cellular network), the monitoring device may acquire the item's location via the cellular network. In either scenario, the monitoring device knows its own location and the item's location, and may simply calculate the distance between the two.

In a further aspect, if a monitoring device and a device being monitored are in communication with each other, they may be able to rely on phase information or data carried by the ambient radio signal to help aid in the relative positioning of the two devices. There are many different radio signals that could be used as ambient signals, such as AM, FM, or shortwave radio stations, over-the-air television stations, or possibly even cellular telephone signals. Additionally, some RF signals may be used to calculate an angle of arrival of the RF signal. The angle of arrival may be useful for calculating additional location information.

In some embodiments, peer-to-peer coordination may be used to aid in determining distance. For instance, if a monitored item knows that it is near to another monitored item, it may relay an approximate position for the additional monitored items to the monitoring device. The monitoring device could then be able to estimate a range for the additional monitored items. As a specific example, a monitoring device A may know it is ten meters from item B, and another monitoring device C knows it is three meters from item B. The monitoring device A would then be able to determine that item B is between seven and thirteen meters away. As another example, when there are multiple monitoring devices and items in a network, and some can determine their own location while others can't, the devices and/or items that know their own location can share location information with each other (reporting angles of arrival, etc.) so that collectively they have enough information to perform triangulation for devices that cannot determine their own location.

In a further aspect, a monitoring device may acquire distance information using techniques based on the phase shift of an optical signal or audio signal that is reflected from an item. Such techniques, which typically are implemented with longer waveforms, and involve comparing phase of the waveform on transmission to the phase of waveform when it reflects back to determine distance, are known to those skilled in the art. As another example, a monitoring device may use the Doppler Effect and echo data to determine item location and distance thereto.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

CONCLUSION

With respect to any or all of the block diagrams and flow charts in the figures as discussed herein, each block and/or communication may represent a processing of information and/or a transmission of information in accordance with example embodiments. Alternative embodiments are included within the scope of these example embodiments. In these alternative embodiments, for example, functions described as blocks, transmissions, communications, requests, responses, and/or message may be executed out of order from that shown or discussed, including substantially concurrent or in reverse order, depending on the functionality involved. Further, more or fewer blocks and/or functions may be used with any of the ladder diagrams, scenarios, and flow charts discussed herein, and these ladder diagrams, scenarios, and flow charts may be combined with one another, in part or in whole.

A block that represents a processing of information may correspond to circuitry that can be configured to perform the specific logical functions of a herein-described method or technique. Alternatively or additionally, a block that represents a processing of information may correspond to a module, a segment, or a portion of program code (including related data). The program code may include one or more instructions executable by a processor for implementing specific logical functions or actions in the method or technique. The program code and/or related data may be stored on any type of computer readable medium such as a storage device including a disk or hard drive or other storage medium.

The computer readable medium may also include non-transitory computer readable media such as computer-readable media that stores data for short periods of time like register memory, processor cache, and random access memory (RAM). The computer readable media may also include non-transitory computer readable media that stores program code and/or data for longer periods of time, such as secondary or persistent long term storage, like read only memory (ROM), optical or magnetic disks, compact-disc read only memory (CD-ROM), for example. The computer readable media may also be any other volatile or non-volatile storage systems. A computer readable medium may be considered a computer readable storage medium, for example, or a tangible storage device.

Moreover, a block that represents one or more information transmissions may correspond to information transmissions between software and/or hardware modules in the same physical device. However, other information transmissions may be between software modules and/or hardware modules in different physical devices.

It should be understood that for situations in which the systems and methods discussed herein collect personal information about users, the users may be provided with an opportunity to opt in/out of programs or features that may collect personal information (e.g., information about a user's preferences or a user's contributions to social content providers). In addition, certain data may be anonymized in one or more ways before it is stored or used, so that personally identifiable information is removed. For example, a user's identity may be anonymized so that the no personally identifiable information can be determined for the user and so that any identified user preferences or user interactions are generalized (for example, generalized based on user demographics) rather than associated with a particular user.

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. A computer-implemented method comprising:

generating and storing historical context data, at each of a plurality of instances, comprising:

determining one or more contexts of a monitoring device at the instance;

searching for and receiving presence signals from a plurality of items physically located near the monitoring device, the presence signals receivable by the monitoring device; and generating and storing a data entry for the instance comprising: (a) data indicating the one or more context signals determined and (b) data that either identifies each item from which a presence signal was received, or indicates that no presence signals were receivable by the monitoring device at the instance;

determining a current context for the monitoring device;

retrieving the historical context data;

selecting, from among multiple proximity frameworks, a particular proximity framework between the monitoring device and two or more items from the plurality of items using the historical context data, based on the determined current context, wherein each proximity framework indicates (a) two or more different proximity requirements, each proximity requirement indicating a required proximity between the monitoring device and at least one of the two or more items and (b) a different notification process corresponding to each proximity requirement, and wherein, for a particular item, two different proximity frameworks indicate a different proximity requirement or a different notification process;

monitoring a proximity of each of the two or more items relative to the monitoring device, based on a presence signal from each of the two or more items, in order to determine when one of the proximity requirements of the particular proximity framework is not met; and responsive to determining that one of the proximity requirements is not met, initiating the corresponding notification process.

2. The method of claim 1, wherein determining the current context for the monitoring device comprises receiving one or more context signals from the monitoring device.

3. The method of claim 2, wherein the context signals comprise at least one of the following: (a) a time of day signal, (b) a current location signal, (c) a signal indicating a location of a planned event, (d) a signal identifying a certain event, and (e) a signal indicating whether an event is repeating or non-repeating.

4. The method of claim 1, further comprising receiving an indication of one or more user preferences, the particular proximity framework between the monitoring device and the two or more items selected based on the user preferences.

5. The method of claim 1, wherein generating and storing the historical context data, at each of the plurality of instances, comprises:

for each presence signal received from one of the plurality of items physically located near the monitoring device:

identifying an item from which the presence signal is sent; and determining a distance between the identified item and the monitoring device;

wherein generating and storing a data entry for the instance comprises generating and storing a data entry for the instance comprising data that either identifies each item from which a presence signal was received and the determined distance between the item and the monitoring device, or indicates that no presence signals were receivable.

6. The method of claim 1, wherein at least a portion of the historical context data is generated automatically by the monitoring device.

7. The method of claim 6, wherein generating and storing the historical context data, at each of the plurality of instances, comprises:

receiving user input that comprises: (a) an indication that an item-inventory assessment should be made by the monitoring device, and (b) at least one indication of context; and assessing the item-inventory responsive to the indication that the item-inventory assessment should be made, assessing the item-inventory comprising:

based at least in part on the user-provided indication of context, determining a context; and generating and storing a data entry for the instance comprising: (a) data indicating the determined context, and (b) data that either indicates each item from which a presence signal was receivable, or indicates that no presence signals were receivable.

8. The method of claim 1, wherein at least a portion of the historical context data is generated in response to user input received via a user-interface of the monitoring device.

9. The method of claim 8, wherein generating and storing the historical context data, at each of the plurality of instances, comprises:

receiving user input that comprises an indication that an item-inventory assessment should be made by the monitoring device; and assessing the item-inventory responsive to the indication that the item-inventory assessment should be made, assessing the item-inventory comprising:

determining a context; and generating and storing a data entry for the instance comprising: (a) data indicating the determined context, and (b) data that either indicates each item from which a presence signal was receivable, or indicates that no presence signals were receivable.

10. The method of claim 1, wherein the monitoring device is one of the following: (a) a mobile device, (b) a laptop computer, (c) a tablet computer, (d) headphones, (e) a wallet, (f) a keychain device, (g) a device attached to an article of clothing, (h) a device worn by a user, or (i) a device carried by a user.

11. The method of claim 1, wherein the monitoring device uses a wireless protocol to monitor the proximity of each item.

12. The method of claim 11, wherein the wireless protocol is one of the following: (a) Radio-Frequency Identification (RFID), (b) Near Field Communication (NFC), (c) IEEE 802.11, (d) Worldwide Interoperability for Microwave Access (WiMAX), (e) 3GPP Long Term Evolution (LTE), (f) an acoustic sensing protocol, (h) an electromagnetic (EM) sensing protocol, (i) an induction-based protocol, (j) an infrared protocol, and (k) a watermarking protocol.

13. The method of claim 1, wherein monitoring the proximity of each of the two or more items relative to the monitoring device comprises monitoring whether or not the presence signal from the item is detected by the monitoring device.

14. The method of claim 1, wherein monitoring the proximity of each of the two or more items relative to the monitoring device comprises determining a distance between the item and the monitoring device.

15. The method of claim 14, wherein determining when one of the proximity requirements of the particular proximity framework is not met comprises determining that the distance between the item and the monitoring device is not less than a predetermined distance.

16. The method of claim 14, wherein determining when one of the proximity requirements of the particular proximity framework is not met comprises determining that the distance between the item and the monitoring device is not within a predetermined distance range.

17. The method of claim 14, wherein determining when one of the proximity requirements of the particular proximity framework is not met comprises determining, from a plurality of distance ranges, which distance range includes the distance between the item and the monitoring device.

18. The method of claim 17, wherein the particular proximity framework further comprises a notification process corresponding to each of the plurality of distance ranges.

19. The method of claim 1, further comprising, for at least one of the proximity requirements:

based at least in part on the context and for the particular proximity framework, setting the notification process for the proximity requirement to be one of a plurality of possible notification processes for the proximity requirement.

20. The method of claim 19, wherein the plurality of possible notification processes for the proximity requirement comprises two or more of: (a) an emergency notification process, (b) an alert notification process, and (c) a suggestion notification process.

21. The method of claim 1, further comprising, after determining that one of the proximity requirements is not met, waiting for a predetermined period of time for the proximity requirement to again be met, before initiating the corresponding notification process.

22. A computer-implemented method comprising:

(i) monitoring, for each of a plurality of items and over at least a predetermined period of time, (a) contexts of a monitoring device when the monitoring device detects the respective item, and (b) proximities of the respective item relative to the monitoring device;

(ii) generating historical context data that indicates which contexts of the monitoring device and which items from the plurality of items were detected at substantially the same instant during the predetermined period of time;

(iii) based at least in part on the historical context data, learning a certain context in which a particular proximity framework should be applied to a group of two or more items from the plurality of items;

(iv) determining that a current context of the monitoring device comprises the certain context;

(v) determining that the group of two or more items is associated with the current context using the historical context data;

(vi) selecting, from among multiple proximity frameworks, the particular proximity framework for the group of two or more items based at least in part on the current context, wherein each proximity framework indicates (a) two or more different proximity requirements and (b) at least one notification process corresponding to each proximity requirement, at least two of the notification processes for different proximity requirements being different from each other, and wherein each proximity requirement indicates a required proximity between the monitoring device and at least two of the items from the group of two or more items, and, for a particular item, two different proximity frameworks indicate a different proximity requirement or a different notification process;

(vii) monitoring a proximity of each item from the group of two or more items relative to the monitoring device, based on a presence signal from each item from the group of two or more items and receivable by the monitoring device, in order to detect when any one of the proximity requirements of the particular proximity framework is not met; and (viii) responsive to detecting that one of the proximity requirements is not met, initiating the corresponding notification process.

23. The method of claim 22, further comprising:

before determining the current context, receiving user input that identifies the group of two or more items and defines, at least in part, the particular proximity framework for the group of items; and storing data that associates the group of items with the particular proximity framework for the group of items.

24. The method of claim 23, further comprising, before determining the current context, receiving user input that defines, at least in part, a particular context for the particular proximity framework.

25. The method of claim 24, further comprising performing steps (v)-(viii) in response to a determination that the current context is substantially the same as the particular context for the particular proximity framework.

26. The method of claim 22, further comprising using the historical context data as a further basis for selecting the particular proximity framework for the group of items.

27. The method of claim 26, wherein selecting the particular proximity framework for the group of two or more items further comprises:

using the historical context data as a basis for selecting a particular context; and determining that the current context is the particular context for the particular proximity framework.

28. The method of claim 22, wherein learning the certain context in which the particular proximity framework should be applied to the group of two or more items comprises:

determining that a total number of instances, in which the group of two or more items is detected by the monitoring device when the certain context of the monitoring device is observed, is greater than a threshold number.

29. The method of claim 22, wherein learning the certain context in which the particular proximity framework should be applied to the group of two or more items comprises:

determining that the group of two or more items is detected by the monitoring device in at least a predetermined percentage of instances in which the certain context of the monitoring device is observed.

30. A monitoring device comprising:

a wireless interface configured to wirelessly detect presence signals transmitted from nearby items;

a non-transitory computer-readable medium; and program instructions stored on the non-transitory computer-readable medium and executable by at least one processor to:

determine a context of the monitoring device;

use the determined context as a basis to select, from among multiple proximity frameworks, a particular proximity framework between the monitoring device and two or more items, wherein a presence signal is received from each item, wherein each proximity framework indicates (a) two or more different proximity requirements, each proximity requirement indicating a required proximity between the monitoring device and one of the items, and (b) a different notification process corresponding to each proximity requirement, and wherein, for a particular item, two different proximity frameworks indicate a different proximity requirement or a different notification process;

cause a transmitter of the monitoring device to transmit a presence signal comprising an identifier of the monitoring device, wherein the presence signal is usable by at least one of the two or more items to monitor the proximity of the item relative to the monitoring device;

monitor, via the presence signals detected at the wireless interface, a proximity of each of the items relative to the monitoring device in order to determine when one of the proximity requirements of the particular proximity framework is not met; and responsive to a determination that one of the proximity requirements is not met, cause the monitoring device to initiate the notification process corresponding to the proximity requirement that is not met.

31. The monitoring device of claim 30, further comprising program instructions stored on the non-transitory computer-readable medium and executable by the at least one processor to:

receive, via an intermediary server, an indication that one of the items has determined that the proximity requirement between the item and the monitoring device is no longer met; and responsive to the indication, cause the monitoring device to initiate the notification process corresponding to the proximity requirement that is not met.

32. A computer-implemented method comprising:

generating and storing historical context data, at each of a plurality of instances, comprising:

determining one or more contexts of a monitoring device at the instance;

searching for and receiving presence signals from a plurality of items physically located near the monitoring device, the presence signals receivable by the monitoring device at the instance; and generating and storing a data entry for the instance comprising: (a) data indicating the one or more contexts and (b) data that either identifies each item from which a presence signal was received, or indicates that no presence signals were receivable by the monitoring device;

determining a current context for the monitoring device;

comparing the current context to the historical context data;

selecting, from among multiple proximity frameworks, a particular proximity framework between the monitoring device and two or more items from the plurality of items, based on the comparison between the current context and the historical context data, wherein each proximity framework indicates (a) two or more different proximity requirements, each proximity requirement indicating a required proximity between the monitoring device and at least one of the two or more items and (b) a different notification process corresponding to each proximity requirement, and wherein, for a particular item, two different proximity frameworks indicate a different proximity requirement or a different notification process;

monitoring a proximity of each of the two or more items relative to the monitoring device, based on a presence signal from each of the two or more items, in order to determine when one of the proximity requirements of the particular proximity framework is not met; and responsive to determining that one of the proximity requirements is not met, initiating the corresponding notification process.

33. The method of claim 32, wherein generating and storing the historical context data, at each of the plurality of instances, comprises:

for each presence signal received from the plurality of items physically located near the monitoring device:

identifying an item from which the presence signal is received; and determining a distance between the identified item and the monitoring device;

wherein generating and storing a data entry for the instance comprises generating and storing a data entry for the instance comprising data that either identifies each item from which a presence signal was received and the determined distance between the item and the monitoring device, or indicates that no presence signals were receivable.

34. The method of claim 32, wherein generating and storing the historical context data, at each of the plurality of instances, comprises:

receiving user input that comprises an indication that an item-inventory assessment should be made by the monitoring device; and assessing the item-inventory responsive to the indication that the item-inventory assessment should be made, assessing the item-inventory comprising:

determining a context; and generating and storing a data entry for the instance comprising: (a) data indicating the determined context, and (b) data that either indicates each item from which a presence signal is available, or indicates that no presence signals are available.

35. The method of claim 32, wherein generating and storing the historical context data, at each of the plurality of instances, comprises:

receiving user input that comprises: (a) an indication that an item-inventory assessment should be made by the monitoring device, and (b) at least one indication of context; and assessing the item-inventory responsive to the indication that the item-inventory assessment should be made, assessing the item-inventory comprising:

based at least in part on the user-provided indication of context, determining a context; and generating and storing a data entry for the instance comprising: (a) data indicating the determined context, and (b) data that either indicates each item from which a presence signal is available, or indicates that no presence signals are available.

* * * * *